US006244159B1

(12) United States Patent
Kimura et al.

(10) Patent No.: US 6,244,159 B1
(45) Date of Patent: Jun. 12, 2001

(54) VARIABLE DISPLACEMENT TYPE SWASH PLATE COMPRESSOR AND DISPLACEMENT CONTROL VALVE

(75) Inventors: Kazuya Kimura; Yuji Kaneshige; Hideki Mizutani, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/289,523

(22) Filed: Apr. 9, 1999

(30) Foreign Application Priority Data

Apr. 13, 1998 (JP) ..... 10-101449
Oct. 14, 1998 (JP) ..... 10-292053

(51) Int. Cl.[7] ..... F01B 3/02
(52) U.S. Cl. ..... 92/12.2; 417/222.2
(58) Field of Search ..... 91/506; 92/12.2; 417/222.2

(56) References Cited

U.S. PATENT DOCUMENTS

| | | | | |
|---|---|---|---|---|
| 4,543,043 | | 9/1985 | Roberts | 417/222 |
| 4,606,705 | | 8/1986 | Parekh | 417/222 |
| 4,960,366 | * | 10/1990 | Higuchi | 417/222 |
| 5,056,416 | * | 10/1991 | Ota et al. | 92/12.2 |
| 5,145,326 | | 9/1992 | Kimura et al. | 417/222.2 |
| 5,173,032 | | 12/1992 | Taguchi et al. | 417/222.2 |
| 5,231,914 | | 8/1993 | Hayase et al. | 92/12.2 |
| 5,255,569 | | 10/1993 | Terauchi et al. | 74/60 |
| 5,529,461 | | 6/1996 | Kawaguchi et al. | 417/222.2 |
| 5,573,379 | | 11/1996 | Kimura et al. | 417/222.2 |
| 5,681,150 | | 10/1997 | Kawaguchi et al. | 417/222.2 |
| 5,702,235 | | 12/1997 | Hirota et al. | 417/222.2 |
| 5,785,502 | * | 7/1998 | Ota et al. | 417/222.2 |
| 6,010,312 | * | 1/2000 | Suitou et al. | 417/222.2 |

FOREIGN PATENT DOCUMENTS

| | | |
|---|---|---|
| 19709935A1 | 11/1997 | (DE) . |
| 19733099A1 | 2/1998 | (DE) . |
| 0292288A1 | 11/1988 | (EP) . |
| 0 338 762 A2 | 10/1989 | (EP) . |
| 0 340 024 A1 | 11/1989 | (EP) . |
| 0 491 526 A1 | 6/1992 | (EP) . |
| 0498552A1 | 8/1992 | (EP) . |
| 0628722A1 | 12/1994 | (EP) . |
| 0707182A2 | 4/1996 | (EP) . |
| 0945617A2 | 9/1999 | (EP) . |
| 7-293429 | 11/1995 | (JP) . |
| WO 96/02751 | 2/1996 | (WO) . |

* cited by examiner

*Primary Examiner*—Edward K. Look
*Assistant Examiner*—Thomas E. Lazo
(74) *Attorney, Agent, or Firm*—Morgan Finnegan, LLP

(57) ABSTRACT

A compressor includes swash plate, which is tiltably supported by a drive shaft. The displacement of the compressor changes in accordance with the inclination angle of the swash plate. The minimum inclination angle (θmin) of the swash plate is less than three to five degrees relative to a plane perpendicular to the axis of the drive shaft. The swash plate can be moved from its minimum inclination to increase its angle, despite the small minimum inclination angle, due to a return spring, which urges the swash plate to increase the inclination angle. The return spring positively moves the swash plate in a direction increasing the inclination angle.

20 Claims, 22 Drawing Sheets

VARIABLE DISPLACEMENT TYPE SWASH PLATE COMPRESSOR AND DISPLACEMENT CONTROL VALVE

BACKGROUND OF THE INVENTION

The present invention relates to a variable displacement type swash plate compressor, and, more particularly, to a variable displacement type swash plate compressor capable of reducing power consumption of a compressor when an air-conditioning system is off and a displacement control valve for use in the compressor.

Typically, a compressor for compressing refrigerant gas is incorporated in a cooling circuit for a vehicle air-conditioning system. Such compressors are generally driven by the vehicle's engine and are often coupled to the engine by an electromagnetic clutch mechanism. The electromagnetic clutch connects the compressor to the engine only when a cooling load exists. Providing a compressor with the electromagnetic clutch mechanism however increases the total weight and the manufacturing cost, and the clutch draws power from the engine.

As a solution to those problems, a clutchless compressor has been proposed that directly connects the compressor to the engine and transmits power to the compressor whenever the engine is running. Recently, variable displacement type swash plate compressors have been considered suitable for such clutchless systems. Variable displacement type swash plate compressors are good at variably controlling the compression performance (discharge displacement) according to a variation in cooling load, either automatically or by means of an external control unit. However, they continuously apply a load to the engine.

As long as the cooling load is high and continuous, a clutchless, variable displacement type swash plate compressor works well. However, there is a need to reduce the load applied to the engine by the compressor when the cooling function is stopped in response to an external command, such as when a person in the vehicle turns off the air-conditioning switch.

In general, the discharge displacement of a variable displacement type swash plate compressor is controlled by adjustment of the piston stroke, which is accomplished by controlling the angle (inclination angle) of a swash plate with respect to the drive shaft by means of a displacement control valve. The inclination angle of the swash plate is controlled by controlling the internal pressure (Pc) of a crank chamber defined in the housing. Specifically, the internal pressure Pc of the crank chamber is increased to decrease the inclination angle, which reduces the discharge displacement. To tilt the swash plate in a direction that increases the inclination angle with such a structure, the swash plate must move toward the maximum inclination angle when the internal pressure Pc of the crank chamber falls. To return the swash plate to its maximum inclination angle, the minimum inclination angle should not be in the vicinity of 0° (as measured with respect to a plane perpendicular to the drive shaft). That is, with the minimum inclination angle of the swash plate set near 0°, little or no compression takes place, and no compression reactive force large enough to regain the maximum inclination angle is produced. This makes it very difficult or impossible to return the swash plate back to the maximum inclination angle. It is therefore necessary to set the minimum inclination angle of the swash plate to about a range of +30° to +50°, for example, so that there is some discharge from the compressor, even at the minimum inclination angle, which produces a small but significant compression reactive force. The compression reaction force contributes to increasing the inclination angle of the swash plate at the appropriate time. This permits the swash plate angle to increase in response to a reduction in the internal pressure Pc of the crank chamber, which is caused by the displacement control valve.

If a conventional variable displacement type swash plate compressor is designed as a clutchless type and is installed in a vehicle air-conditioning system, even when the start switch for the air-conditioner is turned off to set the inclination angle of the swash plate to the minimum inclination angle, the compressor continues operation with a minimum discharge displacement to continuously apply a compression reactive force to the swash plate. Thus, a small load is always applied to the vehicle engine. To reduce the load when the air-conditioning system is off, it is necessary to make the compression reactive force as low as possible by reducing the inclination angle of the swash plate as much as possible. If the compression reactive force is set too low, the swash plate cannot be inclined when there a need to increase the displacement. Since there is a compromise between reducing the power consumption under the minimum discharge displacement and using the compression reactive force to incline the swash plate to the maximum inclination angle, it is necessary to precisely adjust the minimum discharge displacement (or the minimum inclination angle) to satisfy both requirements. This is difficult to achieve in conventional variable displacement type swash plate compressors, which leads to increased manufacturing costs.

SUMMARY OF THE INVENTION

Accordingly, it is an objective of the present invention to provide a variable displacement type swash plate compressor which can reduce its power consumption with an air-conditioning system in an OFF state as much as possible without sacrificing the ability to return from the minimum discharge displacement (minimum inclination angle), and which is easy to manufacture. It is another objective of this invention to provide a displacement control valve for use in such a compressor.

To achieve the above objective, the present invention provides a variable displacement compressor including a housing, which defines a cylinder bore, a crank chamber, a suction chamber and a discharge chamber. A piston is accommodated in the cylinder bore. A drive shaft is rotatably supported in the crank chamber by the housing. A drive plate is coupled to the piston for converting rotation of the drive shaft to reciprocation of the piston. The drive plate is supported on the drive shaft to incline with respect to a plane perpendicular to the axis of the drive shaft and to rotate integrally with the drive shaft. The drive plate moves in a range between a maximum inclination angle position and a minimum inclination angle position in accordance with a moment applied to the drive plate. The moment includes a moment based on the pressure in the crank chamber and a moment based on the pressure in the cylinder bore as components. The drive plate varies the stroke of the piston in accordance with its inclination angle to change displacement of the compressor. A pressure control mechanism controls pressure in the crank chamber to change the inclination of the drive plate. The minimum inclination angle is smaller than a limit angle. The limit angle is determined by the lower limit of a range of inclination within which the drive plate can be moved to increase its angle by a reaction force of pressure applied to the piston. An urging member urges the drive plate to increase its inclination angle when the inclination of the drive plate is less than the limit angle.

The present invention also provides a displacement control valve for controlling the displacement of a variable displacement compressor by adjusting inclination angle of a drive plate located in a crank chamber. The compressor includes a supply passage for connecting a discharge chamber to the crank chamber and a bleed passage for connecting the crank chamber to a suction chamber. The displacement control valve includes a first valve located in the supply passage. The first valve includes a first valve body for adjusting an opening size of the supply passage and a first spring for urging the first valve body to open. A second valve is located in the bleed passage. The second valve includes a second valve body for adjusting an opening size of the bleed passage, a pressure sensitive member for urging the second valve body to close with a force related to the pressure in the suction chamber, and a second spring for urging the second valve body to close. A transmitting member transmits the motion of the second valve body to the first valve body. The transmitting member causes the first valve body to open when the second valve body is moved to close. A solenoid is excited based on current supplied from outside the compressor. The solenoid urges the first valve body to close and urges the second valve body to open with a force related to the supplied current. When the solenoid is demagnetized, the first valve body opens the supply passage with the force of the first spring and the second valve body closes the bleed passage with the force of the second spring.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

The following describes first to fourteenth embodiments of the present invention, which relate to variable displacement type swash plate compressors used in vehicle air-conditioning systems. Except for the crank pressure control apparatus (including the displacement control valve), the compressor is the same in all embodiments. The second to fourteenth embodiments involve modifications to the crank pressure control mechanism.

First Embodiment

Figure 4:
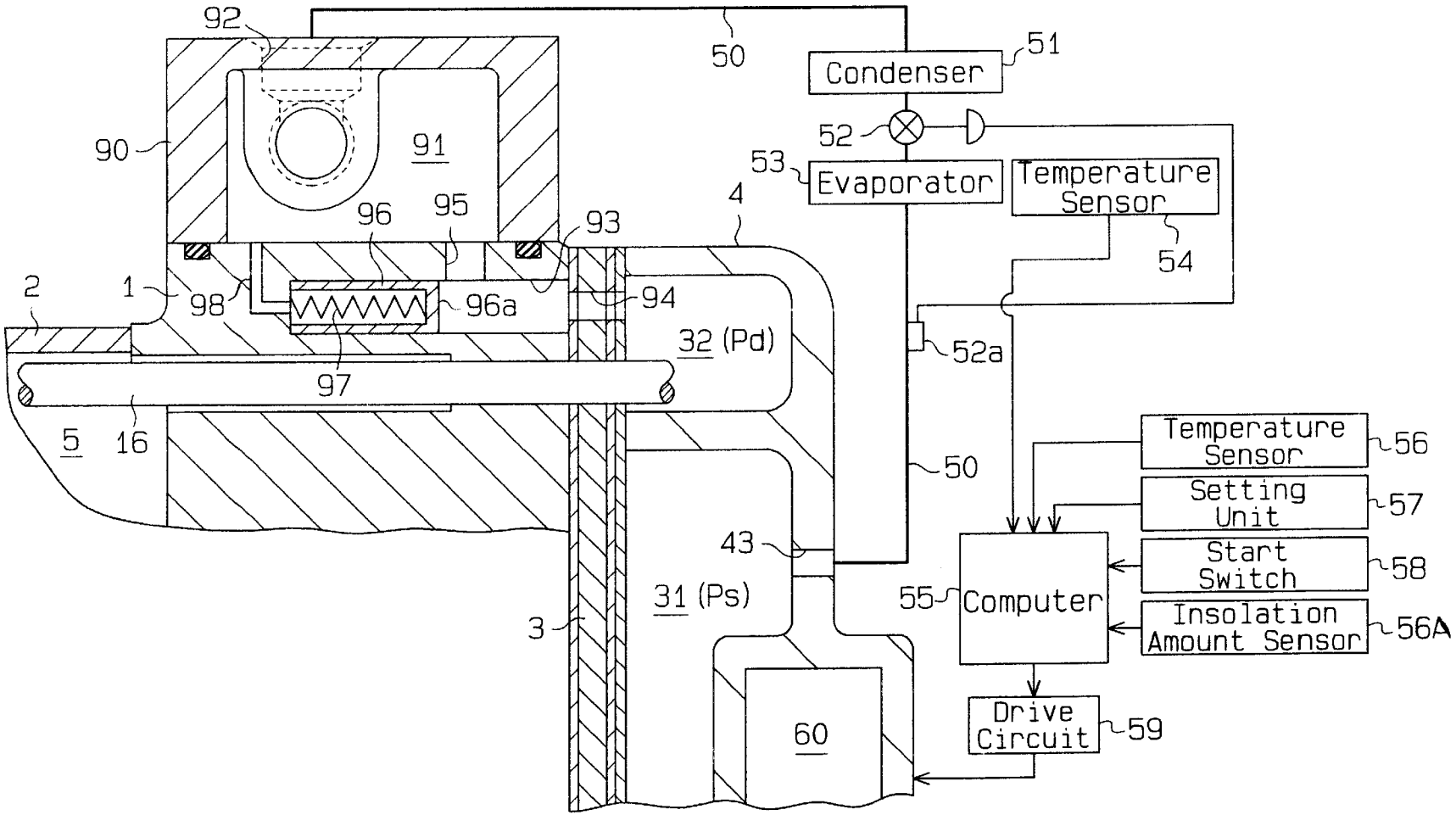
FIG. 4 is a partial cross-sectional view of the swash plate compressor in FIG. 1, which shows a discharge passage.
Figure 5:
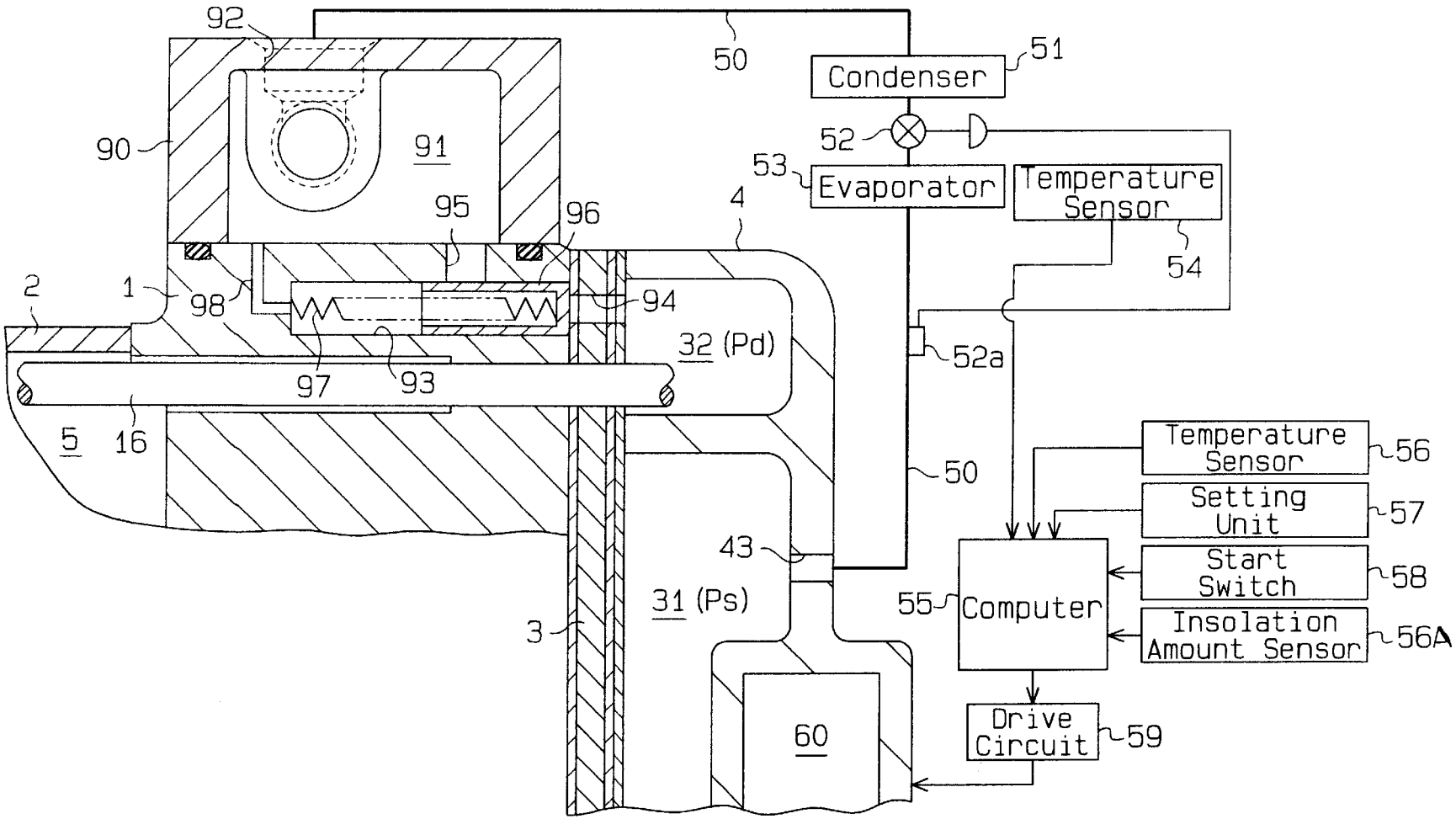
FIG. 5 is a partial cross-sectional view like FIG. 4 showing the discharge passage closed.

The fundamental structure of the variable displacement type swash plate compressor will now be described with reference to FIGS. 1 and 2. The swash plate compressor includes a cylinder block 1, a front housing 2 connected to the front end of the cylinder block 1, and a rear housing 4 connected by a valve plate 3 to the rear end of the cylinder block 1. The cylinder block 1, front housing 2, valve plate 3 and rear housing 4, which are securely connected together by bolts 16 (only one bolt is shown in FIGS. 4 and 5), form a housing. A crank chamber 5 is defined in the area surrounded by the cylinder block 1 and the front housing 2.

A drive shaft 6 is rotatably supported on a pair of front and rear radial bearings 7 and 8, which are provided on the front housing 2 and the cylinder block 1, respectively, in the crank chamber 5. A coil spring 9 and a thrust bearing 10 are provided at the center of the cylinder block 1, and the rear end of the drive shaft 6 is supported by the thrust bearing 10, which is urged forward by the coil spring 9. A lip seal 15 is located between the outer surface of the front end of the drive shaft 6 and the inner wall of the front housing 2 to seal the front of the crank chamber 5.

A pulley 12 is rotatably supported with a ball bearing 11 at the front end cylinder portion of the front housing 2. The pulley 12 is coupled to the front end of the drive shaft 6, which protrudes from the front housing 2. Around the pulley 12 is a belt 13, through which the compressor is clutchlessly coupled to a vehicle engine 14. A compressor that draws power from an external drive source directly, without a clutch mechanism, is referred to as clutchless.

A rotary support 21 is secured on the drive shaft 6 in the crank chamber 5. A swash plate 22, or cam plate, is accommodated in the crank chamber 5. The drive shaft 6 is inserted in a through hole, which is bored in the center portion of the swash plate 22. The drive shaft 6 makes sliding contact with the rim of the through hole. The swash plate is coupled to the rotary support 21 and the drive shaft 6 by a hinge mechanism 23, or linking/guiding mechanism. The swash plate 22 has a counter weight 22*a* on a side opposite to the hinge mechanism 23, with respect to the drive shaft 6.

The hinge mechanism 23 comprises a pair of support arms 24 (only one is shown) protruding from the rear face of the rotary support 21 and a pair of guide pins 25 (only one is shown) protruding from the front face of the swash plate 22. Each support arm 24 has a cylindrical guide hole 24*a* formed in its distal end, and each guide pin 25 has a ball portion 25*a* formed at its distal end. The ball portions 25*a* are fitted in the respective guide holes 24*a* of the support arms 24. The support arms 24 and guide pins 25, which form the hinge mechanism 23, cause the swash plate to rotate with the drive shaft 6. The swash plate 22 is also slidable along the surface of the drive shaft 6 in the direction of the axis L1 and is tiltable with respect to the axis L1 of the drive shaft 6. The rotational center of this inclination is called a pivotal axis A. This pivot axis A extends in a direction perpendicular to the sheet of FIG. 1 and is perpendicular to the axis L1 of the drive shaft 6. The pivot axis A changes its position in accordance with the sliding of the swash plate 22 along the drive shaft 6.

Figure 1:
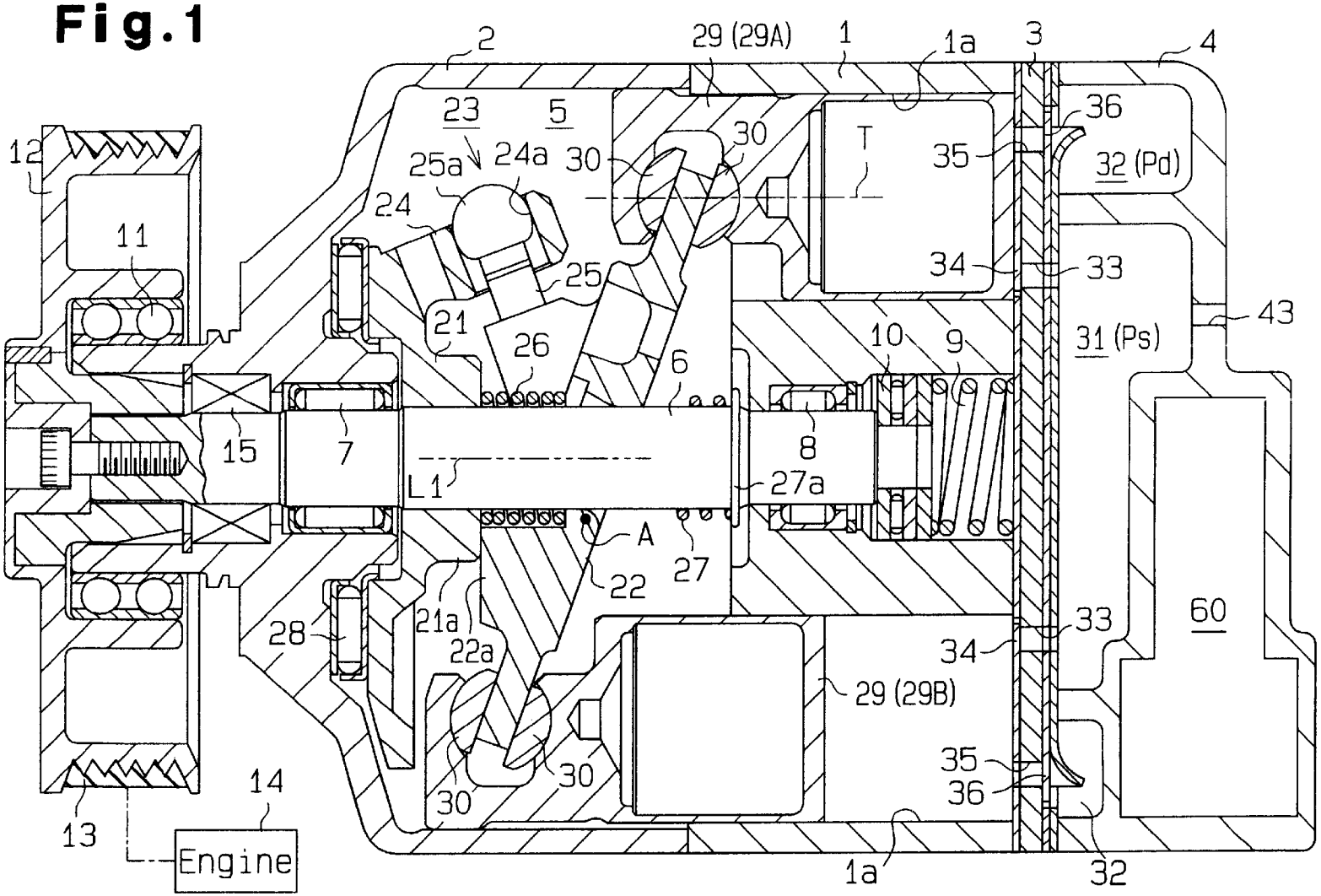
FIG. 1 is a cross-sectional view of a swash plate compressor according to a first embodiment when the swash plate is at the maximum inclination angle.
Figure 2:
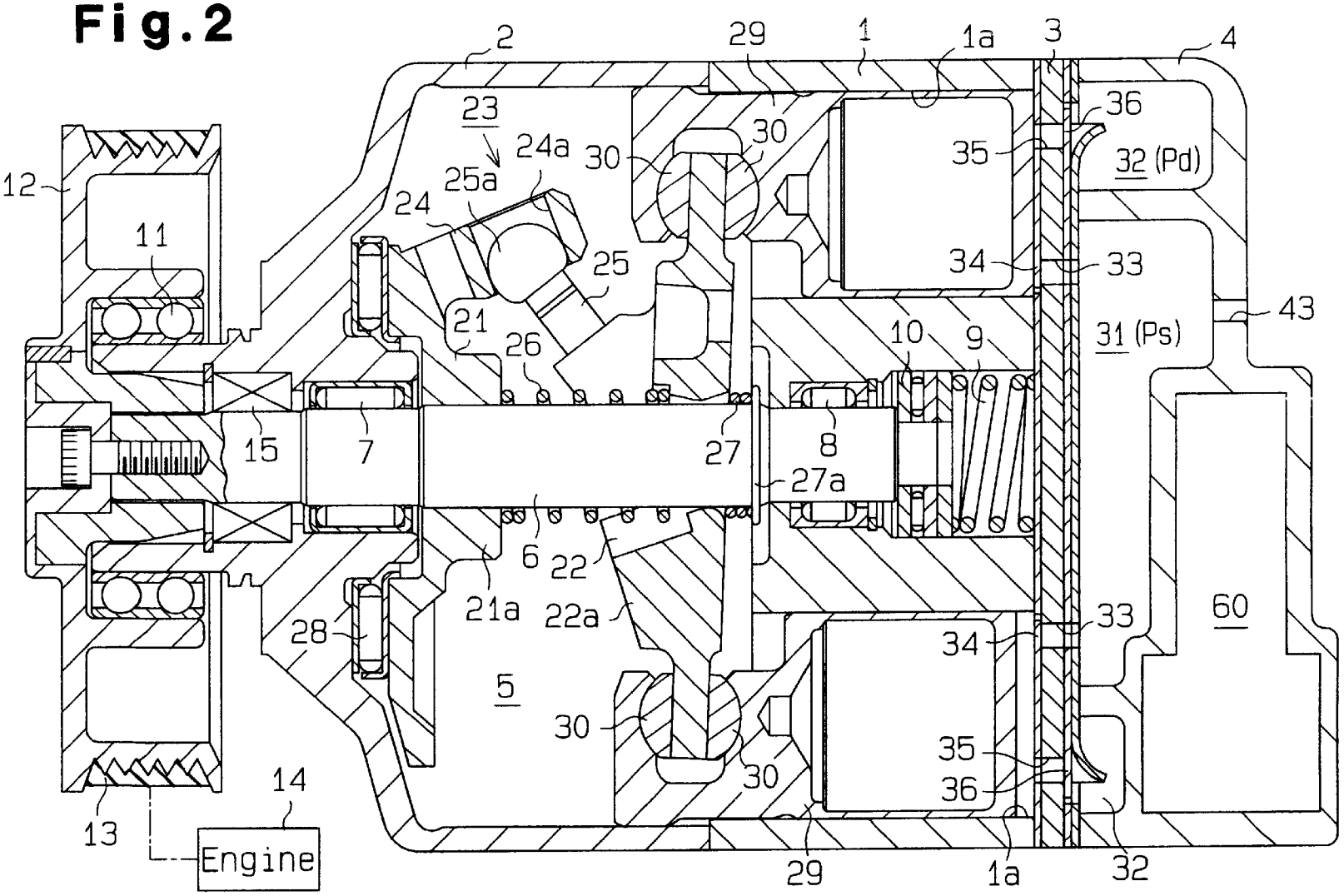
FIG. 2 is a cross-sectional view of the swash plate compressor in FIG. 1 when the inclination angle of the swash plate is decreased.

As shown in FIGS. 1 and 2, a coil disinclination spring 26, the force of which reduces the inclination angle, is provided on the drive shaft 6 between the rotary support 21 and the swash plate 22. The disinclination spring 26 urges the swash plate 22 toward the cylinder block 1 (i.e., in the direction that reduces the inclination angle of the swash plate 22).

A snap ring 27*a* is secured on the drive shaft 6 behind the swash plate 22. A return spring 27, which is a coil spring, is provided between the snap ring 27*a* and the swash plate 22. When pressure from the swash plate 22 is applied to the return spring 27, which is movable back and forth along the drive shaft 6, the return spring 27 urges the swash plate 22 away from the cylinder block 1 (i.e., in the direction that increases the inclination angle). The snap ring 27*a* restricts the rearward movement of the return spring 27.

Figure 6:
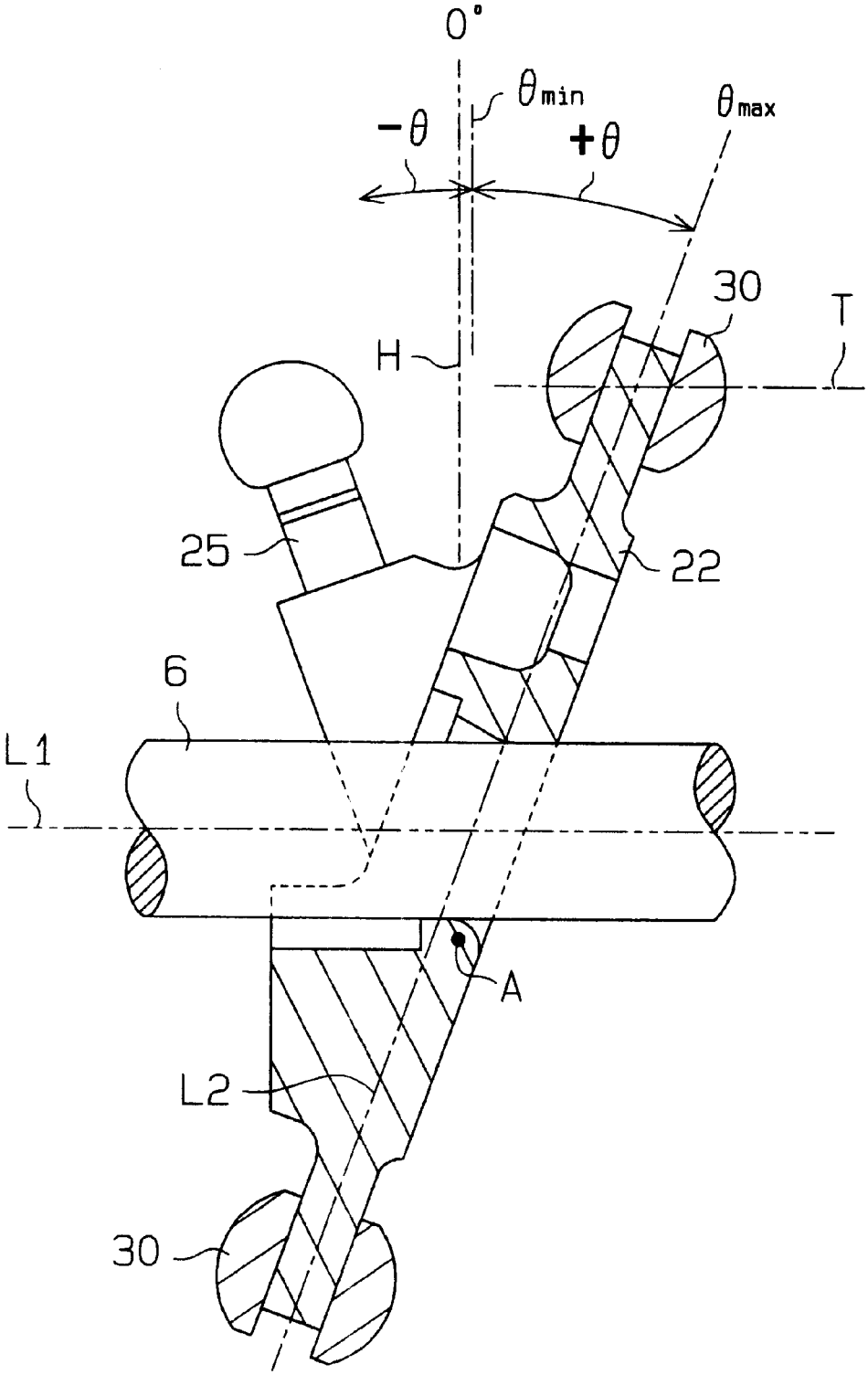
FIG. 6 is a partial cross-sectional view illustrating the inclination range of the swash plate.

The inclination range of the swash plate 22 will now be discussed. As shown in FIG. 6, "H" denotes a vertical plane that is perpendicular to the axis L1 of the drive shaft 6 and that includes the pivotal axis A. The angle between this plane H and the swash plate 22 is the inclination angle of the swash plate 22. When the swash plate 22 is parallel to the plane H, the inclination angle is 0°. At the inclination angle of 0°, the swash plate 22 does not serve as a cam plate and the piston stroke becomes zero, making the discharge displacement zero.

The direction where the upper end of the swash plate 22 is tilted toward the cylinder block 1 (the direction indicated by +θ in FIG. 6) is defined as a positive direction and the opposite direction (the direction indicated by −θ in FIG. 6) is a negative direction. The allowable maximum angle of inclination of the swash plate 22 is θmax and the allowable minimum angle of inclination of the swash plate 22 is θmin, and the tiltable range of the swash plate 22 is from θmin to θmax.

The discharge displacement of the compressor increases as the angle θ of the swash plate 22 increases in the positive direction and becomes maximum (100% displacement) when the inclination angle θ is the maximum inclination angle θmax. The maximum inclination angle θmax is defined by abutment of the counter weight 22*a* of the swash plate 22 against a restriction projection 21*a* provided at the rear face of the rotary support 21, as shown in FIG. 1.

The minimum inclination angle θmin of the swash plate 22 is restricted by one of the following schemes 1 and 2.

Scheme 1: When the swash plate 22 moves in the inclination angle decreasing direction from the maximum discharge displacement state (θmax), the swash plate 22 first abuts one end of the return spring 27. When the swash plate 22 moves further, the return spring 27, which is sandwiched between the snap ring 27*a* and the swash plate 22, is compressed to a minimum length, which defines a point beyond which the swash plate 22 can no longer move. This defines the minimum inclination angle θmin.

Scheme 2: A piston 29B shown at the lower portion of FIG. 1 is at the bottom dead center. When the head of the piston 29B abuts the valve plate 3, further inclination of the swash plate 22 is prohibited. This defines the minimum inclination angle θmin.

The set value of the minimum inclination angle θmin will be discussed below referring to FIGS. 7 and 8. The present inventors found that the power W needed to rotate the swash plate 22 scarcely varies as long as the inclination angle θ of the swash plate 22 lies in a range R including the inclination angle 0°, as shown in FIG. 8. In other words, the present inventors found that the angle range R in which the swash plate 22 can be driven with minimum power lies near 0°. The upper limit θA of the angle range R is smaller than the angle θC, which is the minimum inclination angle in conventional swash plate compressors, and is equal to or smaller than the critical angle θB, below which the compression reaction force is insufficient to cause the swash plate 22 to incline toward the maximum inclination angle. The minimum inclination angle θmin is set to an arbitrary value in the angle range R so that the compressor applies a minimal load when the air-conditioning system is off (see FIG. 7). The individual angles therefore have a relation of $\theta min \leqq \theta A \leqq \theta B \leqq \theta C$.

The minimum inclination angle θmin, which may be set to a small positive value, 0° or a negative value as long as it is equal to or smaller than θA, is set to approximately 0° in this embodiment.

With the compressor completely stopped as a result of deactivation of the engine 14, the disinclination spring 26 and the return spring 27 both apply force to the swash plate 22. The angle θof the swash plate 22 at this time is essentially determined by an equilibrium of the forces of both springs 26 and 27. In this embodiment, the springs 26, 27 are chosen such that the inclination angle θx is equal to or greater than the critical angle θB (see FIG. 7), below which the compression reaction force is insufficient to cause the swash plate 22 to incline toward the maximum inclination angle. This inclination angle θx may be equal to or greater than the minimum inclination angle θc of the prior art.

The minimum inclination angle θmin, the return spring 27 and the setting of the forces of both springs 26 and 27 are characteristic features of this invention. Their technical significance will be discussed in detail in a later description of the operation.

A plurality of cylinder bores la are formed in the cylinder block 1 to surround the drive shaft 6. There are seven cylinder bores 1*a* in this compressor, though only two are shown in FIG. 1. A single-head piston 29 is retained in a reciprocative manner in each cylinder bore 1*a*. The front end of each piston 29 (which is opposite to the head) is connected to the disk-like periphery of the swash plate 22 by a pair of shoes 30. Each piston 29 is coupled to the swash plate 22 by the shoes 30. As long as the swash plate 22 is inclined at an angle other than 0°, therefore, the rotational motion of the swash plate 22 and the drive shaft 6 is converted to the linear reciprocating motion of each piston 29 by the shoes 30. In other words, the stroke of each piston 29 changes in accordance with a change in the inclination angle of the swash plate 22. Changes in the inclination angle change the discharge displacement of the compressor. However, the use of the hinge mechanism 23 causes the top dead center positions of the pistons 29 in the individual cylinder bores 1*a* to be approximately the same. The top clearance in each cylinder bore 1*a* when the piston 29 is at the top dead center position is near zero.

With the swash plate 22 at the positive maximum inclination angle (θmax) (see FIG. 1), the discharge performance of this compressor is maximum. The upper piston 29A is in its top dead center position T, and the lower piston 29B is in its bottom dead center position. The hinge mechanism 23 is aligned with the piston that is in its top dead center position T.

Defined in the rear housing 4 are a suction chamber 31 and a discharge chamber 32, which is almost annular in shape. The discharge chamber 32 surrounds the suction chamber 31. As shown in FIGS. 1 and 4, the suction chamber 31 is connected to the downstream side of an external refrigeration circuit 50 (to be described later) via a suction passage 43 formed in the rear housing 4. The suction chamber 31 and the suction passage 43 form a suction pressure area.

A suction port 33, a suction valve 34 for opening and closing the suction port 33, a discharge port 35 and a discharge valve 36 for opening and closing the discharge port 35 are formed in the valve plate 3 in association with each cylinder bore 1*a*.

As each piston 29 moves toward the bottom dead center from the top dead center, refrigerant gas (at suction pressure Ps) supplied to the suction chamber 31 via the suction passage 43 from the external refrigeration circuit 50 is drawn into the associated cylinder bore 1*a* via the suction port 33 and suction valve 34. As the piston 29 moves toward the top dead center from the bottom dead center, the refrigerant gas supplied to the cylinder bore la is discharged to the discharge chamber 32 via the discharge port 35 and discharge valve 36. The compression reaction force (F), which is transmitted by each piston as it compresses gas, is received by the inner wall of the front housing 2 through a thrust bearing 28, which is located in front of the support 21, the rotary support 21, the hinge mechanism 23, and the swash plate 22.

As shown in FIGS. 4 and 5, a discharge case 90 is attached to a side wall (the upper portion in FIG. 4) of the cylinder block 1, and its internal space forms a discharge muffler 91. Provided in the upper wall of the discharge case 90 is a discharge port 92, which is L-shaped, through which the discharge muffler 91 is connected to the upstream side of the external refrigeration circuit 50. The discharge muffler 91 suppresses noise produced by the discharge pulsation of the compressed refrigerant gas, which is intermittently discharged into the discharge chamber 32 from each cylinder bore 1*a*.

A valve hole 93 extending parallel to the bolts 16 is formed in the side wall portion of the cylinder block 1. The rear end (the right end in FIG. 4) of this valve hole 93 communicates with the discharge chamber 32 in the rear housing 4 via a discharge port 94 bored through the valve plate 3. A hole 95, which connects the approximate center of the valve hole 93 to the discharge muffler 91, is formed in the cylinder block 1. Therefore, the discharge port 94, valve hole 93, hole 95, discharge muffler 91 and discharge port 92 form a discharge passage for guiding the compressed refrigerant gas (discharge pressure Pd), discharged from the discharge chamber 32, to the external refrigeration circuit 50. This discharge passage (91–95) and the discharge chamber 32 form a discharge pressure area.

A valve body 96 is fitted in the valve hole 93 with enough clearance to permit the valve body to slide axially, which forms a spool valve. The interior of the valve body 96 is connected to the discharge muffler 91 via a back-pressure passage 98 formed in the cylinder block 1. The rear end face 96*a* of the valve body 96 completely closes the discharge port 94 when the valve body 96 contacts it. The discharge pressure of the compressor is applied to the rear end face 96*a*.

One end of a valve spring 97 is located in the valve body 96. The opposite end of the valve spring 97 is fastened to the front end (the left end in FIG. 4) of the valve hole 93. The valve spring 97 urges the valve body 96 toward the valve plate 3. As a result, the position of the valve body 96 is determined by an equilibrium of a rightward force, which is a combination of the force of the valve spring 97 and the force of the back pressure within the valve body 96, and a leftward force, which is based on the internal pressure of the discharge passage (i.e., the discharge pressure Pd).

The force of the spring 97 is chosen such that the valve body 96 closes the discharge passage (91–95) when the difference (Pd−Pm) between the internal pressure (discharge pressure Pd) of the discharge chamber 32 and the internal pressure (Pm) of the discharge muffler 91 is less than a predetermined value ΔP (e.g., 0.5 kgf/cm$^2$). When the differential pressure (Pd−Pm) is equal to or greater than the predetermined value ΔP, the valve body 96 is always located at an open position (as shown in FIG. 4) in the front half of the valve hole 93, and the discharge port 94 and the hole 95 are connected via the rear half of the valve hole 93. When the differential pressure (Pd−Pm) is smaller than the predetermined value ΔP, on the other hand, the rightward urging action by the spring 97 overwhelms the leftward force of the discharge pressure Pd, and the valve body 96 is located at a closed position (as shown in FIG. 5) in the rear half of the valve hole 93. As a result, the valve body 96 disconnects the discharge port 94 from the hole 95. The valve body 96 and its associated elements (93, 97) form a stop valve. The predetermined pressure differential ΔP serves as the valve-opening pressure of the stop valve.

Figure 3:
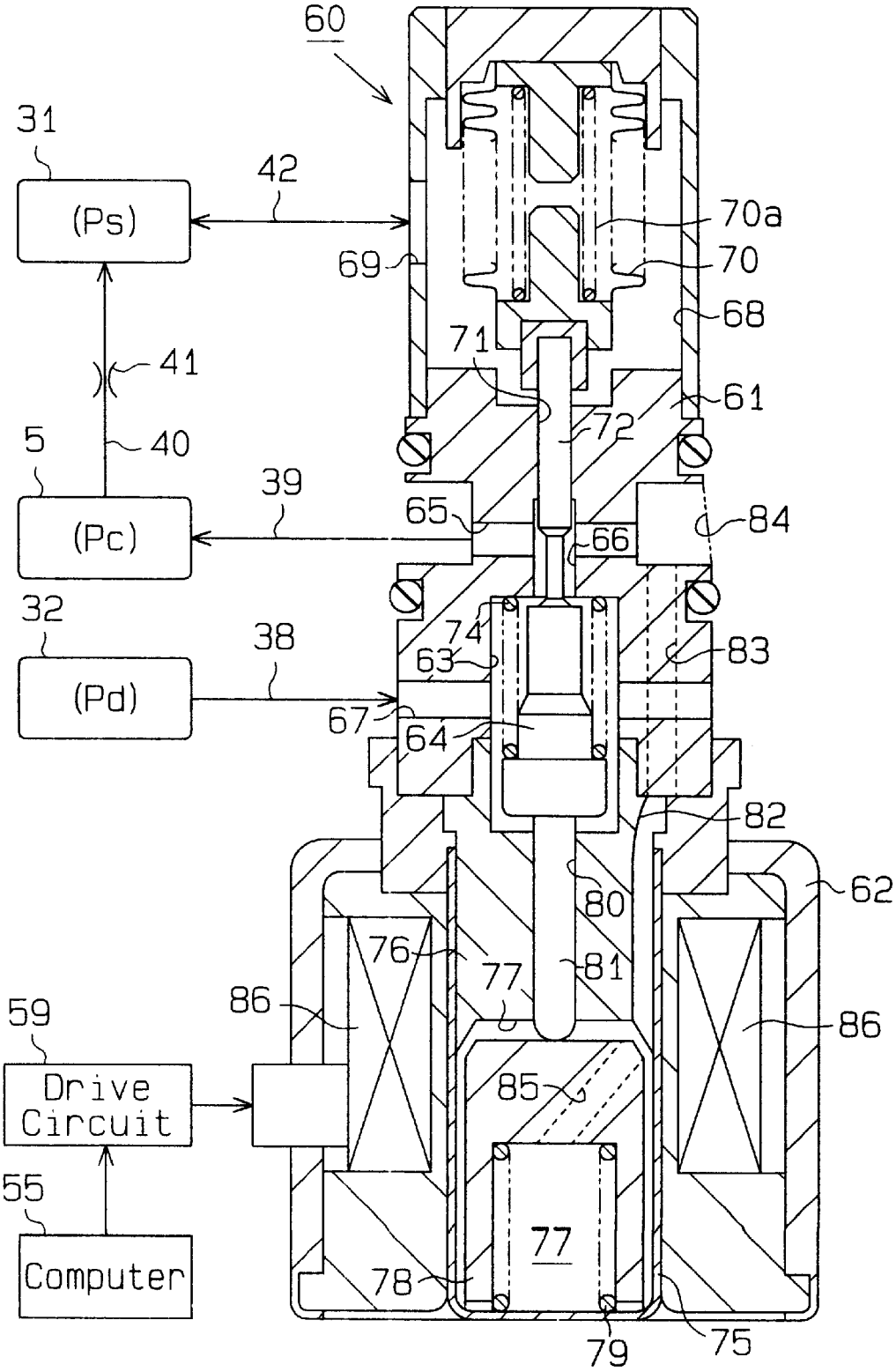
FIG. 3 is a diagram schematically illustrating a crank pressure control apparatus, including a cross sectional view of a displacement control valve.

According to the first embodiment, provided in the cylinder block 1 and the rear housing 4 of the swash plate compressor are a series of gas supply passages 38 and 39 for connecting the discharge chamber 32 to the crank chamber 5 and a bleed passage 40 for connecting the crank chamber 5 to the suction chamber 31, as shown in FIG. 3. A fixed restrictor 41 is located in the bleed passage 40, and a displacement control valve 60 is provided between the gas supply passages 38 and 39. A pressure-sensing passage 42 is provided in the rear housing 4 without interfering with the gas supply passages 38 and 39 and the bleed passage 40. The pressure-sensing passage 42 permits the internal pressure (suction pressure Ps) of the suction chamber 31, or a the suction pressure area, to act on part of the displacement control valve 60.

The passages 38, 39, 40 and 42, the fixed restrictor 41 and the displacement control valve 60 form a crank pressure control apparatus, which controls the internal pressure (crank pressure Pc) of the crank chamber 5 to change the swash plate angle to a target value.

Figure 9:
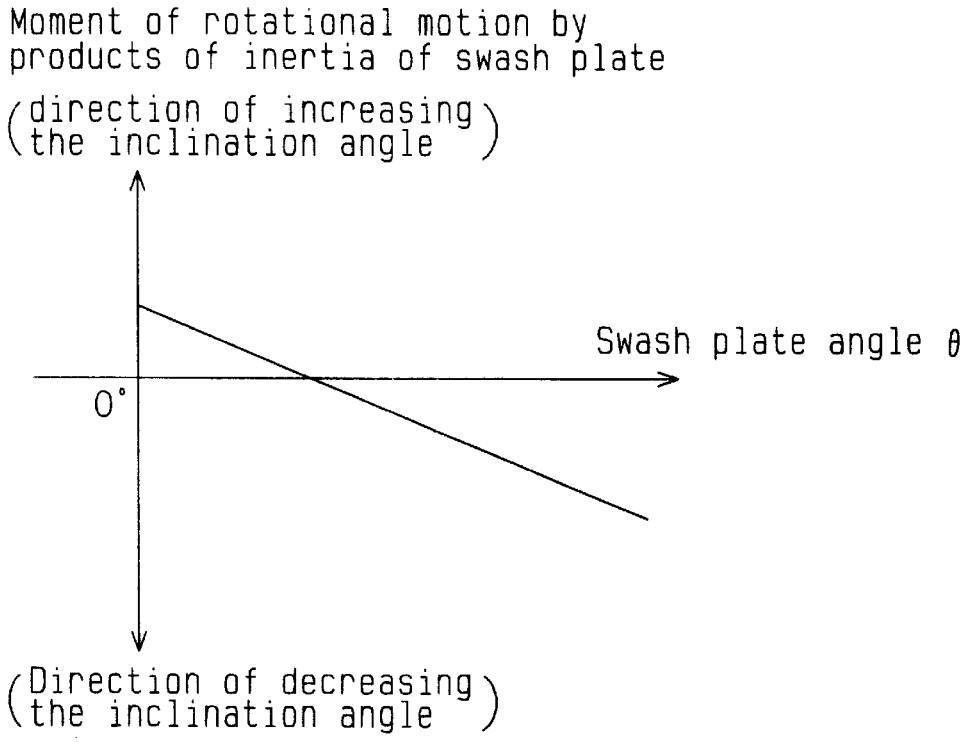
FIG. 9 is a graph showing the characteristic of the rotational moment of the swash plate.

A moment generated by the rotation (or the centrifugal force) of the swash plate 22 acts on the swash plate 22. The swash plate 22 is designed such that when the inclination angle θ of the swash plate 22 is small, the moment acts in a direction to increase the inclination angle, and when the inclination angle θ is large, the moment acts in a direction to decrease the inclination angle, as shown in FIG. 9. More specifically, the shape of the swash plate 22, the coordinates of the center of gravity G thereof, and the mass m thereof are determined such that when the inclination angle of the swash plate 22 is close to 0°, the moment of the rotational motion acts to increase the inclination angle (or becomes zero) as the swash plate 22 rotates.

Japanese Unexamined Patent Publication (Kokai) No. Hei 7-293429 (corresponding to U.S. Pat. No. 5,573,379 and German Patent Laid-open Publication No. 19514748) describes in detail that if the shape, the location of the center of gravity G, and the mass m of the swash plate are selected to properly set the products of inertia of the swash plate, the moment of the rotational motion, which acts on the swash plate when the swash plate 22 rotates, will act as described above.

The moments that determine the inclination angle of the swash plate 22 are the spring force moment, which is based on the balanced urging actions of the disinclination spring 26 and the return spring 27, the moment generated by the force of the gas-pressure, and the moment of the rotational motion described above. Based on these three moments, the inclination angle θ of the swash plate 22 is somewhere between θmin and θmax mentioned earlier.

The moment based on the force of the gas-pressure is generated based on the compression reactive force, which acts on each piston in its cylinder bore during its compression stroke, the internal pressure of the cylinder bore in the suction stroke, and the internal pressure Pc of the crank chamber. This moment is adjusted by controlling the crank pressure Pc by means of the displacement control valve 60, as will be discussed later.

Since the moment of the rotational motion is based on the centrifugal force at the time the swash plate 22 rotates, it is negligible when the swash plate 22 is stopped or is rotating at a low speed.

The spring-force moment acts based on the balanced urging actions of the disinclination spring 26 and the return spring 27. In this compressor, the forces of both springs 26 and 27 are set to have a relationship as shown in FIG. 10.

Figure 10:
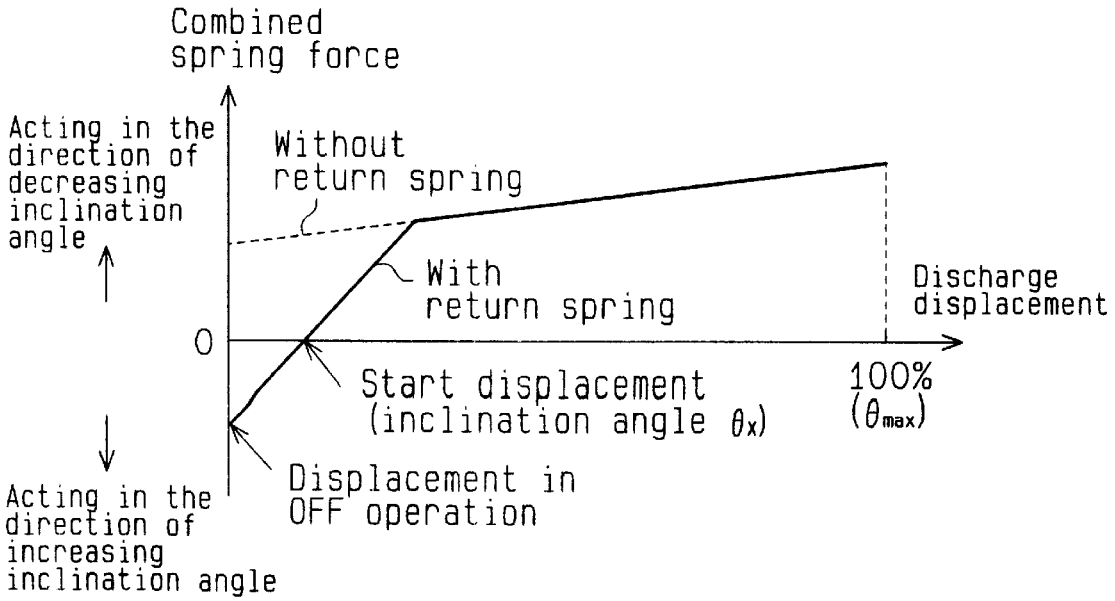
FIG. 10 is a graph illustrating the relationship between a combined spring force, which affects the inclination angle, and the discharge displacement of the compressor.

In FIG. 10, the start displacement is the displacement when the compressor is activated from the completely stopped state and is set to about 2% to 20% (preferably about 4% to 10%) of the maximum discharge displacement. The angle of the swash plate 22 that corresponds to the start displacement is the aforementioned angle θx. As is readily apparent from FIG. 10, when the angle θ of the swash plate 22 is equal to or smaller than θx, the action by the return spring 27 becomes stronger, and the combined force of the two springs 26 and 27 acts to increase the inclination angle. At this time, the spring-force moment also acts increase the inclination angle. When the angle of the swash plate 22 lies in the range of θx to θmax, on the other hand, the combined force of the two springs 26 and 27 (and the spring-force moment) acts to decrease the inclination angle.

Prior to the discussion of the displacement control valve 60, the external refrigeration circuit 50 and an external control system, which are associated with the displacement control valve 60, will be briefly described. As shown in FIG. 4, the discharge port 92 of the discharge case 90 of the compressor and the suction passage 43 of the rear housing 4 are connected together via the external refrigeration circuit 50. This external refrigeration circuit 50 and the compressor form the cooling circuit in the vehicle air-conditioning system.

The external refrigeration circuit 50 is provided with a condenser 51, an expansion valve 52 and an evaporator 53. The expansion valve 52 serves as a variable restriction resistor between the condenser 51 and the evaporator 53. The expansion valve 52 provides a differential pressure between the condenser 51 and the evaporator 53, and supplies a liquid refrigerant matching the thermal load to the evaporator 53. The angle of this expansion valve 52 is subjected to feedback control based on the temperature sensed by a temperature sensing cylinder 52*a*, which is provided at the outlet side of the evaporator 53, and the vapor pressure (specifically, the pressure at the inlet port or outlet port of the evaporator 53). This feedback control adjusts the amount of refrigerant in the external refrigeration circuit 50 so that the evaporation state of the refrigerant in the evaporator 53 has the proper degree of superheat.

A temperature sensor 54 is provided near the evaporator 53. This temperature sensor 54 detects the temperature of the evaporator 53 and provides a control computer 55 with information on the detected temperature. The control computer 55 performs all the heating and cooling control of the air-conditioning system. In addition to the temperature sensor 54, a passenger compartment temperature sensor 56, which detects the temperature of the passenger compartment, a passenger compartment temperature setting unit 57 for setting the passenger compartment temperature of the vehicle, a start switch 58 for the air-conditioning system, and an insolation amount sensor 56A for detecting the amount of solar radiation are connected to the input side of the control computer 55. A drive circuit 59, which controls a current supply to a coil 86 (to be described later) of the displacement control valve 60 is connected to the output side of the control computer 55.

The control computer 55 computes the proper amount of current to the coil 86 based on the evaporator temperature obtained from the temperature sensor 54, the vehicle's passenger compartment temperature obtained from the passenger compartment temperature sensor 56, the information on the insolation amount from the insolation amount sensor 56A, a predetermined passenger compartment temperature previously set by the passenger compartment temperature setting unit 57, and external information like the ON/OFF setting state from the start switch 58. The control computer 55 causes the drive circuit 59 to supply the computed current to the displacement control valve 60, thereby externally performing variable control of the set suction pressure Pset of the displacement control valve 60.

The control computer 55 is also connected to an unillustrated electronic control unit (ECU) for the engine 14, and receives information about the activation or deactivation of the engine 14 and the engine speed from the ECU. The control computer 55 and the drive circuit 59 serve as external control means.

The details of the displacement control valve 60, which is part of the crank pressure control apparatus of the first embodiment, will now be described referring to FIG. 3. The displacement control valve 60 has a valve housing 61 and a solenoid portion 62, which are connected together in the vicinity of the center of the control valve 60. Between the valve housing 61 and the solenoid portion 62 is a valve chamber 63 in which a valve body 64 is retained in a movable manner. This valve chamber 63 is connected to the discharge chamber 32 via a valve chamber port 67, which is formed in the side wall of the valve chamber 63, and the upstream gas supply passage 38.

A valve hole 66 is formed in the upper portion of the valve chamber 63. The valve hole 66 extends in the axial direction of the valve housing 61. Formed in the valve housing 61 above the valve chamber 63 is a port 65, which is perpendicular to the valve hole 66. The valve chamber 63 is connected to the crank chamber 5 via the valve hole 66, the port 65 and the downstream gas supply passage 39.

A pressure sensitive chamber 68 is defined in the upper portion of the valve housing 61. The pressure sensitive chamber 68 is connected to the suction chamber 31 via a pressure supply port 69, which is formed in the side wall of the chamber 68, and the pressure-sensing passage 42, so it is exposed to the suction pressure Ps. A bellows 70 is provided inside the pressure sensitive chamber 68, and a set spring 70*a*, which urges the movable end (lower end) of the bellows 70 in a direction to expand the bellows 70, is provided in the bellows 70. The interior of the bellows 70 is set to a vacuum state or a pressure-reduced state. The bellows 70 and the set spring 70*a* form a pressure sensitive member.

A guide hole 71, which follows the valve hole 66, is formed in the center of the valve housing 61 between the pressure sensitive chamber 68 and the valve chamber 63. A pressure sensitive rod 72 is fitted in the guide hole 71 with enough clearance so that the rod 72 can slide axially. The upper end of the pressure sensitive rod 72 is secured to the movable end of the bellows 70 and the lower end is fixed to the upper end of the valve body 64. The diameter of the lower end of the pressure sensitive rod 72 is significantly smaller than the inside diameter of the valve hole 66 to permit the flow of the refrigerant gas in the valve hole 66. In this manner, the valve body 64 is coupled to the bellows 70 by the pressure sensitive rod 72. The pressure sensitive chamber 68, the bellows 70, the set spring 70*a* and the pressure sensitive rod 72 form a pressure sensing mechanism, which transmits changes in the suction pressure Ps to the valve body 64.

The solenoid portion 62, which occupies the lower half of the displacement control valve 60, has a retainer cylinder 75 with a bottom. A fixed iron core 76 is fitted in the upper portion of the retainer cylinder 75, thereby defining a solenoid chamber 77 in the retainer cylinder 75. A movable iron core 78, forming a nearly cylindrical plunger with a top, is retained in the solenoid chamber 77 in a reciprocative manner. A follow-up spring 79 is located between the movable iron core 78 and the bottom of the retainer cylinder 75. The follow-up spring 79 urges the movable iron core 78 upward (toward the fixed iron core 76). A guide hole 80 is formed axially in the center of the fixed iron core 76, and a solenoid rod 81, which is integral with the valve body 64, is slidably fitted in this guide hole 80. The pressure sensitive rod 72, the valve body 64 and the solenoid rod 81 form a functional member.

A release spring 74 is provided in the valve chamber 63. The release spring 74 urges the valve body 64 and the solenoid rod 81 downward (in a direction to open the valve hole 66). The downward force of the release spring 74 is considerably greater than the upward force of the follow-up spring 79, which normally causes the valve body 64 to open the valve when the electromagnetic force is small or zero.

The lower end portion of the solenoid rod 81 abuts the top surface of the movable iron core 78 based on the equilibrium between the forces of the release spring 74 and the follow-up spring 79. In this manner, the movable iron core 78 and the valve body 64 are coupled together by the solenoid rod 81.

The solenoid chamber 77 communicates with the port 65 via a communication groove 82, which is formed in the side wall of the fixed iron core 76, a communication hole 83, bored through in the valve housing 61, and an annular small chamber 84, which is formed between the control valve 60 and the wall of the rear housing 4 when attaching the control valve 60. In other words, the solenoid chamber 77 is exposed to the same pressure as the valve hole 66 (i.e., the crank pressure Pc). A hole 85 is bored in the cup-like movable iron core 78, and the pressures inside and outside the movable iron core 78 in the solenoid chamber 77 are equalized via this hole 85.

A coil 86 is wound around the fixed iron core 76 and the movable iron core 78 over an area partly covering the iron cores 76 and 78. The drive circuit 59 supplies a predetermined current to this coil 86 based on a command from the control computer 55. The coil 86 produces electromagnetic force corresponding to the supplied current, and the fixed iron core 76 attracts the movable iron core 78 due to the electromagnetic force. This moves the solenoid rod 81 upward. The set pressure Pset of the displacement control valve 60 is variably controlled externally in this manner.

A description will now be given of the actions associated with a change in displacement in the normal operation mode of this compressor. Suppose that when the start switch 58 for the air-conditioning system is ON while the vehicle's engine 14 is running, the passenger compartment temperature detected by the passenger compartment temperature sensor 56 is greater than the temperature set by the passenger compartment temperature setting unit 57. In this case, the control computer 55 computes the amount of current to be supplied to the coil 86 according to computation equations that are specified in the air-conditioning program, and instructs the drive circuit 59 to excite the coil 86 with the computed amount of current. Then, the drive circuit 59 supplies a predetermined current to the coil 86, generating electromagnetic attraction according to the value of the supplied current between the iron cores 76 and 78. This electromagnetic attraction causes the solenoid rod 81 and the valve body 64 to move upward against the force of the release spring 74, which closes or restricts the size of the valve hole 66. As a result, the valve body 64 is moved to the position where the electromagnetic attraction is balanced with the upward force of the follow-up spring 79, and the opening size of the valve hole 66 is adjusted according to the position of the valve body 64 (setting of the set pressure Pset).

With the coil 86 excited in the aforementioned way and the opening size of the valve hole 66 adjusted to a predetermined degree, the bellows 70 is displaced in accordance with a change in suction pressure Ps, which is applied to the pressure sensitive chamber 68 via the pressure-sensing passage 42. The displacement of the bellows 70 is transmitted by the pressure sensitive rod 72 to the valve body 64. Consequently, the opening size of the valve hole 66, which is based on the excitation of the coil 86. is further adjusted, or corrected, by the valve body 64, which is influenced by the bellows 70, and the bellows 70 is responsive to the suction pressure Ps.

The opening size of the valve hole 66 (hereinafter simply called "valve opening size") in the displacement control valve 60 is essentially determined by the equilibrium of four forces, namely, the upward force of the movable iron core 78, which depends on the value of the current supplied from the drive circuit 59, the upward force of the follow-up spring 79, the downward force of the release spring 74 and the force of the pressure sensing mechanism, which is affected by a variation in suction pressure Ps.

Provided that the start switch 58 is ON while the vehicle's engine 14 is running, when the cooling load is large, the vehicle's passenger compartment temperature detected by the passenger compartment temperature sensor 56, for example, becomes greater than the temperature set by the passenger compartment temperature setting unit 57. In this case, based on the detected passenger compartment temperature and the set temperature, the control computer 55 controls the drive circuit 59 to reduce the set suction pressure Pset of the control valve 60. That is, as the detected temperature becomes higher, the control computer 55 instructs the drive circuit 59 to increase the value of the current to be supplied to the coil 86, which increases the electromagnetic attraction between the fixed iron core 76 and the movable iron core 78. This causes the valve body 64 to decrease the valve opening size. Even when the suction pressure Ps is low, the valve hole 66 is easily closed by the valve body 64. In other words, when the cooling load is large (i.e., the passenger compartment temperature is high) and the suction pressure Ps thus becomes higher, the pressure sensing mechanism is sure to close the valve hole 66. This causes the inclination angle of the swash plate 22 to rapidly increase toward the maximum inclination angle (θmax).

The inclination angle of the swash plate 22 increases when the valve hole 66 is closed (or the valve opening size is restricted) for the following reasons. While the crank chamber 5 receives the highly-pressurized refrigerant gas from the discharge chamber 32 via the gas supply passage 38, the displacement control valve 60 and the gas supply passage 39 permit the refrigerant gas to escape to the suction chamber 42 via the bleed passage 40, which has the fixed restrictor 41. As the opening size of the control valve 60 becomes smaller, which makes the discharge flow rate of the refrigerant gas greater than the supply amount of the refrigerant gas, the crank pressure Pc gradually drops. As a result, the back pressure applied to the pistons 29 gradually becomes lower, so the force pushing the pistons 29 toward the cylinder block 1, or the force reducing the inclination angle of the swash plate 22, becomes smaller. This increases the inclination angle of the swash plate 22.

When the valve hole 66 is closed by the valve body 64, thereby making the valve opening size of the displacement control valve 60 zero, the supply of highly-pressurized refrigerant gas to the crank chamber 5 from the discharge chamber 32 is stopped. Consequently, the crank pressure Pc becomes approximately equal to the suction pressure Ps, and the gas-pressure generated moment caused by the compression reactive force becomes relatively large, which maximizes the inclination angle of the swash plate 22. At this maximum inclination angle (θmax), the stroke of each piston 29 is maximum, which maximizes the discharge displacement of the compressor. In this manner, the cooling performance of the air-conditioning system reaches its maximum to handle the large cooling load.

When the cooling load is small and the start switch 58 is ON, on the other hand, the difference between the passenger compartment temperature detected by the passenger compartment temperature sensor 56, for example, and the temperature set by the passenger compartment temperature setting unit 57 becomes smaller. In this case, the control computer 55 controls the drive circuit 59 to raise the set suction pressure Pset. That is, as the detected temperature is lower, the control computer 55 instructs the drive circuit 59 to decrease the value of the current to be supplied to the coil 86, which reduces the electromagnetic attraction between the fixed iron core 76 and the movable iron core 78. This increases the valve opening size. Even when the suction pressure Ps is somewhat high, the valve hole 66 is not easily closed by the valve body 64. In other words, when the cooling load is small (i.e., the passenger compartment temperature is low) and the suction pressure Ps is therefore low, the valve hole 66 can be opened, despite the operation of the pressure sensing mechanism. This rapidly decreases the inclination angle of the swash plate 22 toward the minimum inclination angle.

The inclination angle of the swash plate 22 decreases as the valve opening size becomes greater, because the amount of gas supplied becomes larger than the amount of gas discharged from the crank chamber 5, thus gradually raising the crank pressure Pc. The rise in the crank pressure Pc increases the back pressure applied to the pistons 29. Consequently, the gas-pressure generated moment, which decreases the inclination angle, becomes larger. This reduces the inclination angle of the swash plate 22.

When the thermal load is low, e.g., when the temperature outside the vehicle is lower than the temperature set by the passenger compartment temperature setting unit 57, the inclination angle θ of the swash plate 22 is decreased to or in the vicinity of 0°. In this case, the stroke of each piston 29 is nearly zero, though the swash plate 22 is rotating, which causes the discharge displacement of the compressor to be nearly 0%. At this time, the compressor performs no substantial work despite the power transmitted from the engine 14 and scarcely consumes power.

The operation of the variable displacement type swash plate compressor according to the first embodiment when the compressor is switched off will be described with respect to the following conditions.

Condition 1: When the start switch 58 for the air-conditioning system is switched off while the vehicle's engine 14 is running.

When the start switch 58 is switched off while the compressor is performing a normal suction/compression operation, the control computer 55 stops supplying current to the displacement control valve 60. Then, the control valve 60 is open fully, which allows a large amount of refrigerant gas to flow into the crank chamber 5 from the discharge chamber 32, which raises the crank pressure Pc. The degree of the increase in the crank pressure Pc in this case is considerably greater than that of normal variable operation.

As the crank pressure Pc rises, the gas-pressure generated moment acts decrease the inclination angle, which reduces the displacement. With a small discharge displacement, although the moment of the rotational motion caused by the products of inertia of the swash plate 22 and the moment caused by the spring force act to increase the inclination angle, the gas pressure moment, which decreases the inclination angle due to the increased crank pressure Pc, is stronger than the former two moments. Therefore, the inclination angle θ of the swash plate 22 decreases to near the minimum inclination angle θmin, which makes the discharge displacement approximately zero.

When the discharge displacement becomes approximately zero, gas flows to the crank chamber 5 via the control valve 60 from the discharge chamber 32, which decreases the internal pressure of the discharge chamber 32. Therefore, the differential pressure between the pressures in front of and behind the valve body 96 becomes smaller than the predetermined value (valve opening pressure) ΔP, and the stop valve is closed. This inhibits counter flow of highly-pressurized refrigerant gas to the discharge chamber 32 from the high-pressure side of the external refrigeration circuit 50, which accelerates the reduction of the pressure of the discharge chamber 32. At this time, the crank pressure Pc is determined by the individual internal pressures of the suction chamber 31 and the discharge chamber 32 and the fluid flow resistances at the fully-open control valve 60 and the fixed restrictor 41 on the bleeding side.

When the state where the discharge displacement is zero, the stop valve is closed and the control valve 60 is fully open continues for several seconds to several tens of seconds, the differential pressure between the pressure of the discharge chamber 32 and the pressure of the suction chamber 31 becomes smaller (about equal to or smaller than 0.1 MPa). The reduction in the differential pressure decreases the moment that decreases the inclination angle, which is the gas-pressure generated moment applied to the swash plate 22. The moment that increases the inclination angle, which is caused by the rotational motion of the swash plate 22 and the spring force, becomes relatively larger. Then, the inclination angle of the swash plate 22 slightly increases, and the compressor starts performing the suction/compression operation on the refrigerant gas. As a result, the internal pressure of the discharge chamber 32 rises again and the gas-pressure generated moment that decreases the inclination angle increases again. This slightly decreases the inclination angle again. Although the swash plate 22 is set to the minimum inclination angle θmin by the OFF action of the start switch 58, after the swash plate 22 repeats a slight angle variation around the minimum inclination angle θmin immediately after the start switch 58 is switched off, the swash plate 22 stabilizes at the inclination angle θ where the gas-pressure generated moment that decreases the inclination angle is balanced with the moment caused by the rotational motion and the spring force that increases the inclination angle. The valve opening pressure ΔP of the stop valve is set greater than the differential pressure between the internal pressures of the discharge chamber 32 and the suction chamber 31 under this stable situation. With the control valve 60 fully open, therefore, the stop valve is closed, accomplishing the cooling off state in the external refrigeration circuit 50 where the refrigerant gas does not circulate.

Condition 2: When the start switch 58 for the air-conditioning system is switched on while the vehicle's engine 14 is running.

When the start switch 58 is switched on, the control computer 55 instructs the drive circuit 59 to supply current to the control valve 60, reducing the valve opening size or fully closing the control valve 60. As a result, the amount of refrigerant gas flowing out from the crank chamber 5 via the bleed passage 40 increases, which lowers the crank pressure Pc. This decreases the gas-pressure generated moment that decreases the inclination angle to a level that is less than the combined moment that is the resultant of the rotational motion moment and the spring-force generated moment, which increase the inclination angle. This increases the inclination angle from its position near 0°.

Condition 3: When the engine 14 of the vehicle is activated with the air-conditioning switch 58 turned off and the vehicle is stationary.

When the clutchless compressor is stationary, as discussed earlier, the angle θ of the swash plate 22 is θx as determined by the equilibrium of the forces of the disinclination spring 26 and the return spring 27. This angle θx does not lie near 0°. When the swash plate 22 rotates as a result of activation of the engine 14, the suction/compression operation starts, thus raising the pressure in the discharge chamber 32.

Since the control valve 60 is fully open, the amount of gas supplied to the crank chamber 5 from the discharge chamber 32 increases, making the crank pressure Pc relatively high. As a result, the gas-pressure generated moment decreases the inclination angle, so that, as explained in the discussion of condition 1, the angle of the swash plate 22 eventually stabilizes at the inclination angle θ where the gas-pressure generated moment that decreases the inclination angle is balanced with the combined moment that increases the inclination angle.

As apparent from the foregoing, the displacement control valve 60 forces the compressor to operate with the minimum displacement (nearly zero discharge displacement in the first embodiment), regardless of the suction pressure Ps acting on the pressure sensitive chamber 68, and variably sets the set suction pressure Pset under external control of the control computer 55. The displacement control valve 60 properly controls the cooling performance of the air conditioning system.

When the inclination angle of the swash plate 22 is near 0°, the discharge pressure Pd decreases despite the rotation of the drive shaft 6 and the swash plate 22 by the engine 14, and the differential pressure (Pd−Pm) becomes lower than the valve opening pressure ΔP. Then, the valve body 96 located in the discharge passage (91–95) is shifted to the close position (FIG. 5), completely blocking the passage between the discharge chamber 32 and the external refrigeration circuit 50. As the valve body 96 is moved to the close position when the compressor suppresses its discharge performance as much as possible, the internal circulation path for the lubricating oil in the compressor is secured.

As long as the swash plate 22 has a slight inclination angle, gas is drawn into each cylinder bore 1*a* from the suction chamber 31 and gas is discharged to the discharge chamber 32 from each cylinder bore 1*a*. When the discharge passage (91–95) is blocked by the valve body 96, the internal circulation path for the refrigerant gas is from the suction chamber 31, to the cylinder bore 1*a*, to the discharge chamber 32, to the control valve 60, to the crank chamber 5 and then to the suction chamber 31. As long as the discharge operation, however slight, continues, the refrigerant gas circulates in the internal circulation path and lubricating oil, which is supplied in the compressor, flows with the refrigerant gas inside the compressor. This lubricating oil lubricates the individual sliding parts in the compressor.

In conventional swash plate compressors, the minimum inclination angle θC of the swash plate is restricted as the swash plate directly abuts against a restriction, like a snap ring attached to the drive shaft. The minimum discharge displacement is determined by the restricted minimum inclination angle θC. With conventional clutchless compressors, even with the air-conditioning system switched off, the suction/compression operation continues with the minimum discharge displacement, which is determined by the minimum inclination angle θC, and this minimum discharge displacement is the displacement in the OFF mode.

In contrast, in the swash plate compressor of this invention, the displacement in the OFF mode is determined by the balance among the three moments: the moment resulting from the equilibrium of the forces of the two springs 26 and 27, the moment based on the gas pressure acting on the piston 29, which is produced by the suction pressure Ps, the discharge pressure Pd and the crank pressure Pc, and the moment produced by rotational motion, which is based on the products of inertia of the swash plate 22. Therefore, the displacement in the OFF mode in the illustrated embodiment is not necessarily the same as the minimum discharge displacement of conventional compressors, which is determined by a mechanical restriction. In the compressor of the illustrated embodiment, the minimum discharge displacement and the OFF mode displacement normally satisfy the following relationship: mdd<od, where mdd is the minimum discharge displacement, and od is the displacement in the OFF mode. This characteristic leads to various advantages.

Figure 7:
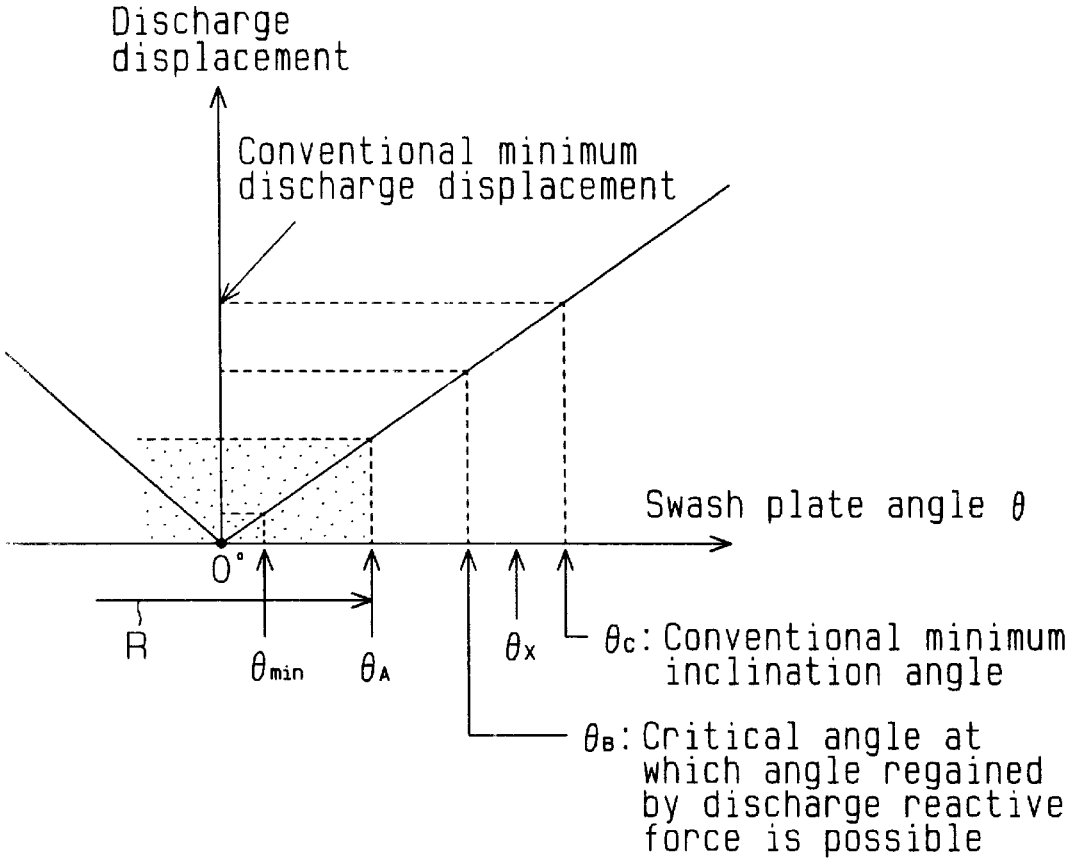
FIG. 7 is a graph illustrating the relationship between the angle of the swash plate and the discharge displacement of the compressor.
Figure 8:
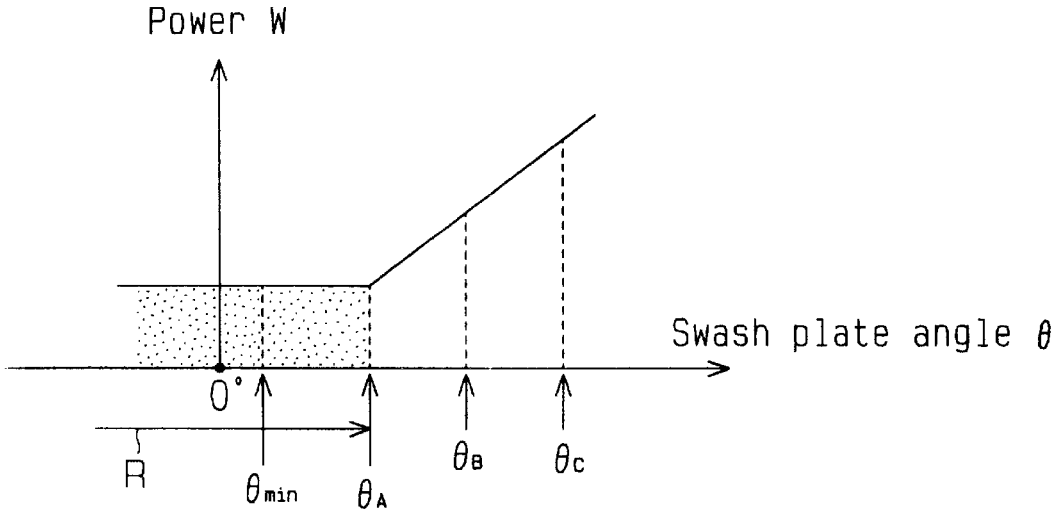
FIG. 8 is a graph illustrating the relationship between the angle of the swash plate and the drive power required by the compressor.

For a variable displacement type swash plate compressor with the maximum discharge displacement of 120 cc, for example, the load in the OFF mode can be minimized by setting the discharge displacement in the OFF mode to about 3 cc or smaller (the upper angle limit θA in FIGS. 7 and 8 is the inclination angle at which the discharge displacement is about 3 cc). Reliable return to larger displacements by the compression reactive force however requires a discharge displacement of 3 to 5 cc or greater (the critical angle limit θB in FIGS. 7 and 8 is the inclination angle at which the discharge displacement is in the range of 3 to 5 cc). If the operation of increasing the displacement is not guaranteed to work, variable displacement type compressors are not practical. Conventional compressors, which lack the return spring, are therefore designed so that the minimum inclination angle θC is equal to or greater than the return critical angle θB, to make the displacement in the OFF mode (or the minimum discharge displacement) greater than 3 to 5 cc. Conventional compressors thus cannot achieve sufficient reduction of the load in the OFF mode. If the minimum discharge displacement is set in the range of 3 to 4 cc in a conventional compressor, the piston stroke per 1 cc becomes about 0.2 mm, and the minimum inclination angle θC must be adjusted very precisely to set the piston stroke to be 0.2 mm or smaller. If θC becomes greater than the target angle even slightly, the power in the OFF mode increases, whereas if θC becomes smaller than the target angle even slightly, the operation of increasing the displacement becomes unreliable.

According to the swash plate compressor of this embodiment, however, the use of the return spring 27 allows the minimum inclination angle θmin to be set to any value in a wide angle range from a small positive angle, to a negative angle range of less than 0° (i.e., the range less than θB, more preferably, the range R in FIGS. 7 and 8). In the OFF mode operation, therefore, a minuscule displacement, which would make increasing the displacement unreliable or impossible in the prior art, is permitted, which significantly reduces the power consumed by the compressor, in the OFF mode, as compared with the prior art. When an increase in the displacement is required, which requires increasing the angle of the swash plate, the crank pressure Pc is rapidly decreased in response to the forced closing of the control valve 60, and the spring force moment resulting from the return spring 27 becomes relatively stronger, which increases the inclination angle. This reliably increases the inclination angle. Further, the swash plate compressor of this embodiment avoids the difficulty in setting the minimum inclination angle, which is a costly drawback of conventional swash plate compressors.

The first embodiment has the following advantages.

When the start switch 58 for the air-conditioning system is off while the vehicle's engine 14 is running, the inclination angle of the swash plate 22 can be set near the minimum inclination angle 0° under the external control of the control computer 55. Although power is always transmitted to the compressor from the engine 14, since the compressor is clutchless, the load applied by the compressor is reduced as much as possible. An air-conditioning system incorporating the swash plate compressor of FIG. 1 is very energy efficient, particularly when off.

In the swash plate compressor of the first embodiment, although the inclination angle θ of the swash plate 22 with the cooling operation stopped is near 0°, it is possible to increase the angle of the swash plate 22 by using the return spring 27 and setting the products of inertia of the swash plate 22 optimally.

Increasing the inclination angle from near 0° is accomplished by the cooperation of the moment generated by the swash plate rotation and the moment generated by the spring force of the return spring 27. If the return spring 27 were omitted, the compressor could be designed such that increasing the inclination angle from near 0° would mainly depend on the rotational motion moment. In this case, however, the products of inertia of the swash plate 22 must be increased to guarantee a force large enough to incline the swash plate when the rotational speed of the swash plate 22 is minimum (during idling). This scheme increases the differential pressure in a fast rotation mode, and would undesirably increase the load or raise the valve opening pressure of the stop valve. The illustrated embodiment, however, avoids these problems by employing the return spring 27.

The displacement control valve 60 can variably set the set suction pressure Pset by adjusting the value of the current supplied to the coil 86 under the external control of the control computer 55 and can change (including fully open or fully close) the size of the opening of the valve hole 66. The displacement control valve 60 therefore is very suitable for promptly altering the setting of the inclination angle of the swash plate in accordance with the ON/OFF switching of the air-conditioning system.

As the valve body 96 is moved to the close position (see FIG. 5) when the start switch 58 for the air-conditioning system is switched off, the flow of the refrigerant in the external refrigeration circuit 50 is inhibited. This positively halts the cooling operation of the air-conditioning system.

As the valve body 96 is moved to the closed position (see FIG. 5) when the start switch 58 is switched off, there remains an internal circulation path for the refrigerant gas and the lubricating oil in the compressor. Unless the engine 14 is stopped, the lubricating oil is normally supplied to the individual sliding parts in the compressor. Therefore internal lubrication is not impeded. The valve body also prevents the lubricating oil from leaking to the external refrigeration circuit 50 from the compressor, thereby avoiding a shortage of lubricating oil in the compressor.

Other Embodiments

Other embodiments of the crank pressure control apparatus, which are usable in the variable displacement type swash plate compressor shown in FIGS. 1, 2, 4 and 5, which is capable of setting the inclination angle of the swash plate to near 0°, will now be described as second to fourteenth embodiments. Because the control computer 55 and drive circuit 59, the external refrigeration circuit 50, and the elements associated with those components are the same as those of the first embodiment, their detailed description will not be repeated.

Second Embodiment

The second embodiment includes an additional opening/closing valve located in the bleed passage, which is capable of selectively opening or closing the bleed passage. This permits the variable displacement swash plate compressor to promptly shift to minimum displacement operation from normal operation.

Figure 11:
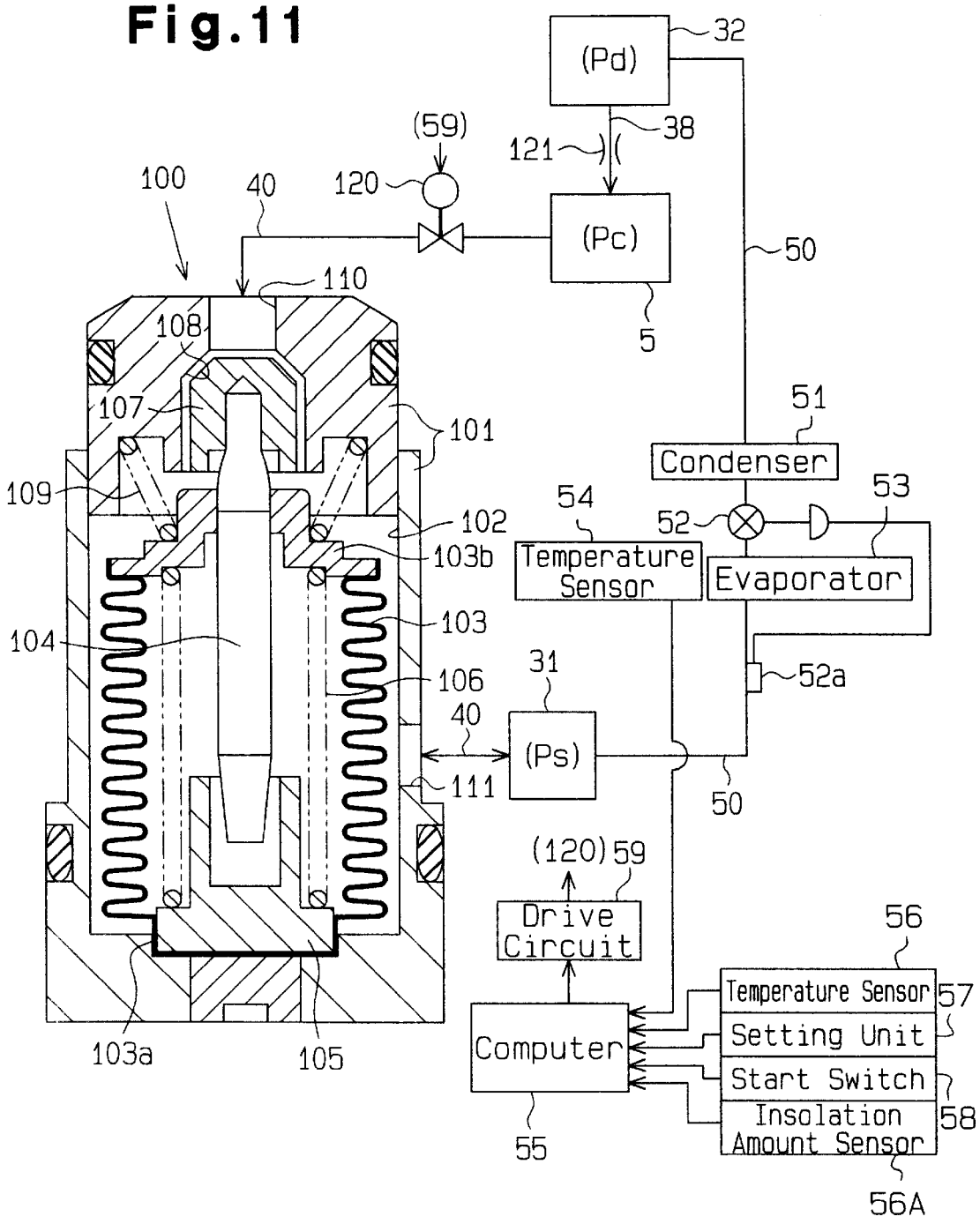
FIG. 11 is a diagram schematically illustrating a crank pressure control apparatus, including a cross sectional view of a displacement control valve.

As shown in FIG. 11, the crank pressure control apparatus of the second embodiment has the gas supply passage 38 for connecting the discharge chamber 32 to the crank chamber 5 and the bleed passage 40 for connecting the crank chamber 5 to the suction chamber 31. Located in the gas supply passage 38 is a fixed restrictor 121, through which the supply of highly-pressurized refrigerant gas to the crank chamber 5 from the discharge chamber 32 is established. An electromagnetic opening/closing valve 120 and a displacement control valve 100 are provided in series in the bleed passage 40. The opening and closing of the electromagnetic valve 120 are controlled by the control computer 55 and the drive circuit 59.

The control valve 100 shown in FIG. 11 is a drain-side control valve of an internal control type. Drain-side control is a control system that controls the opening of the control valve (drain-side control valve) located in the bleed passage 40 to adjust the amount of refrigerant gas to be discharged into the suction chamber 31 from the crank chamber 5, thereby changing the crank pressure Pc to the necessary value to adjust the inclination angle of the swash plate.

The control valve 100 shown in FIG. 11 has a valve housing 101 including a cylinder and a lid, with a pressure sensitive chamber 102 formed in the valve housing 101. A bellows 103, which is provided inside the pressure sensitive chamber 102, has a fixed end 103*a* fitted in the bottom of the pressure sensitive chamber 102, and a movable end 103*b* opposite to the fixed end 103*a*. A pin body 104 extending in the axial direction of the control valve is held in the movable end 103*b* of the bellows 103. When the bellows 103 contracts, the lower end of the pin body 104 (the end in the bellows) abuts against a stopper 105, which is located in the bellows 103. This abutment restricts further contraction of the bellows. The interior of the bellows 103 is in vacuum state, or a depressurized state, and a set spring 106 that extends the bellows 103 is located in the bellows 103. The bellows 103 and the set spring 106 form a pressure sensitive member.

A conical spring 109 for contracting the bellows 103 is located between the lid and the movable end 103*b* of the bellows 103. This spring 109 serves to hold and position the bellows 103 in the pressure sensitive chamber 102 against the force of the set spring 106.

A valve body 107 is supported on the upper end of the pin body 104 (the end outside the bellows 103) and is placed in a recess, or a valve chamber 108, formed in the lid. As the pin body 104 moves in response to the motion of the bellows 103, the valve body 107 changes the cross-sectional area of the opening between a port 110 formed in the valve housing 101 and the pressure sensitive chamber 102. The port 110 is connected to the crank chamber 5 of the compressor, and the pressure sensitive chamber 102 is connected to the suction chamber 31 of the compressor via a port 111 formed in the valve housing 101. The port 110, the valve chamber 108, the pressure sensitive chamber 102 and the port 111 form part of the bleed passage 40. Since the suction pressure Ps is applied to the pressure sensitive chamber 102 via the bleed passage 40, which connects the port 111 to the suction chamber 31, the bleed passage 40 also serves as a pressure-sensing passage for allowing the suction pressure Ps to act on the pressure sensitive chamber 102.

The opening size of the internal control valve 100 is determined mainly by the suction pressure Ps and the equilibrium of the forces of the bellows 103, the set spring 106 and the spring 109. The bellows 103, the pin body 104, the stopper 105, the set spring 106 and the spring 109 in the pressure sensitive chamber 102 form a pressure sensing mechanism, which determines the set pressure Pset of the internal control valve 100 and actuates the valve body 107 in accordance with a change in suction pressure Ps.

The discharge chamber 32 and the suction chamber 31 in the compressor are connected together by the external refrigeration circuit 50.

When the start switch 58 for the air-conditioning system is on, the control computer 55 opens the electromagnetic opening/closing valve 120. Then, the control computer 55 implements internal control to properly adjust the crank pressure Pc by means of the drain-side control valve 100, thereby automatically controlling the angle of the swash plate and, consequently, the discharge displacement of the compressor (the normal operation by the drain-side internal control).

When the start switch 58 is switched off, the control computer 55 closes the electromagnetic opening/closing valve 120. This completely blocks the gas discharge to the suction chamber 31 from the crank chamber 5 via the bleed passage 40 (and the control valve 100), causing the crank pressure Pc to rise. As a result, the angle of the swash plate is set to the minimum inclination angle (near 0°) and the compressor operates at minimum displacement, thus minimizing the load on the engine 14. When the start switch 58 is switched on again, the electromagnetic opening/closing valve 120 is opened, causing the compressor to return to a normal operating condition.

The second embodiment has the following advantages.

The electromagnetic opening/closing valve 120, which can be opened and closed under external control, is provided in the bleed passage 40 equipped with the drain-side control valve 100, and switching the open state and the close state of the electromagnetic opening/closing valve 120 from one to the other is controlled in the above-described manner. This makes it possible to switch the operational state of the compressor between the normal operation state ensured by the typical drain-side internal control and the minimum displacement operation state brought up by the forced increase in crank pressure Pc. This crank pressure control apparatus is therefore considerably suitable for use in the variable displacement type swash plate compressor in FIG. 1, which can set the inclination angle of the swash plate to the vicinity of 0°.

As the electromagnetic opening/closing valve 120 provided between the crank chamber 5 and the drain-side control valve 100 is closed when the start switch 58 is switched off, it is possible to prevent the lubricating oil from flowing out of the crank chamber 5 together with the refrigerant gas in the minimum displacement operation, which would otherwise impair lubrication of the internal mechanisms of the compressor.

Third to Eighth Embodiments

The third to eighth embodiments have two gas supply passages parallel to the gas supply passage connecting the discharge chamber and the crank chamber and has two opening/closing valves or one switching valve located in a set of gas-supply and bleed passages. The set of passages consists of the two gas supply passages and a single bleed passage. By properly controlling the opening/closing valves or the switching valve, the nearly full open state of the gas supply passages and the complete blocking of the bleed passage are achieved at the same time, so that the variable displacement type swash plate compressor swiftly moves to minimum displacement operation from normal operation. Those embodiments will be discussed below one after another.

Third Embodiment

Figure 12:
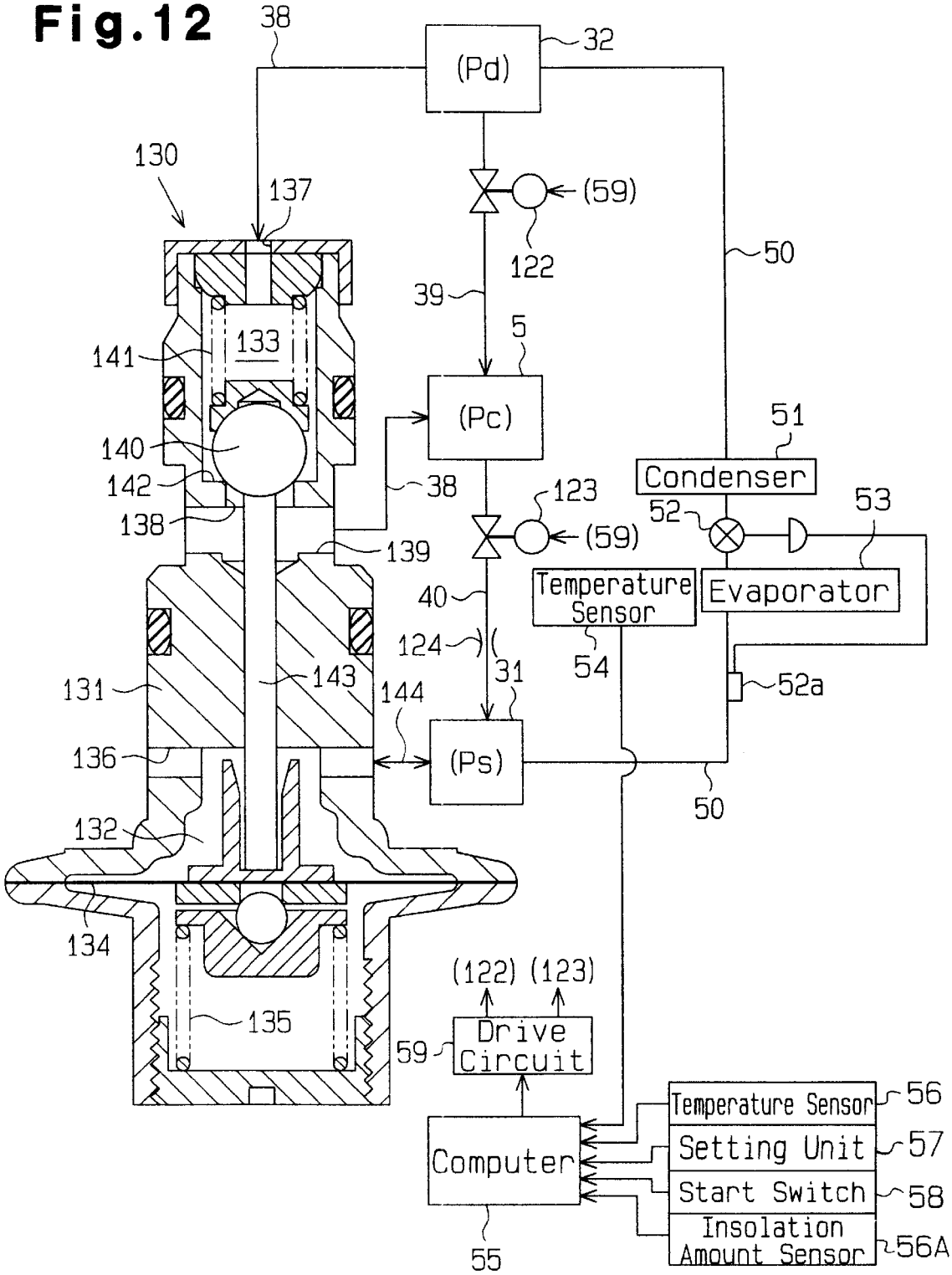
FIG. 12 is a diagram schematically illustrating a crank pressure control apparatus, including a cross sectional view of a displacement control valve.

The crank pressure control apparatus according to the third embodiment illustrated in FIG. 12 has two parallel gas supply passages 38 and 39, which connect the discharge chamber 32 and the crank chamber 5 in the compressor (see FIG. 1) together, and the bleed passage 40 which connects the crank chamber 5 to the suction chamber 31. A displacement control valve 130 to be discussed later is provided in one gas supply passage 38, and a gas-supply side opening/closing valve 122 capable of blocking the other gas supply passage 39 is provided in the passage 39. A bleed-side opening/closing valve 123 capable of blocking the bleed passage 40 and a fixed restrictor 124 are provided in series in the passage 40.

The gas-supply side opening/closing valve 122 located in the gas supply passage 39 and the bleed-side opening/closing valve 123 located in the bleed passage 40 are both electromagnetic type. Those valves 122 and 123 form opening/closing valve means whose opening/closing action is controlled by the control computer 55 by the drive circuit 59.

The control valve 130 shown in FIG. 12 is an inlet-side control valve of an internal control type. The inlet-side control is a control system which controls the opening size of the control valve located in the gas supply passage (inlet-side control valve) to adjust the amount of highly-pressurized refrigerant gas to be supplied into the crank chamber 5 from the discharge chamber 32, thereby setting the crank pressure Pc to the required value to adjust the inclination angle of the swash plate.

The control valve 130 shown in FIG. 12 has a valve housing 131, with a pressure sensitive chamber 132 defined in the lower area of the valve housing 131 and a valve chamber 133 defined in the upper area of the valve housing 131.

Located in the pressure sensitive chamber 132 is a diaphragm 134, which separates the pressure sensitive chamber 132 into upper and lower areas. The inside of the lower area of the pressure sensitive chamber 132 is depressurized to a vacuum state, and a set spring 135 is located in the lower area. The set spring 135 urges the diaphragm 134 upward. The diaphragm 134 and the set spring 135 form a pressure sensitive member. The upper area of the pressure sensitive chamber 132 is connected to the suction chamber 31 of the compressor via a pressure sensitive port 136 and a pressure-sensing passage 144, both formed in the valve housing 131, so that the suction pressure Ps is applied to the upper area of the pressure sensitive chamber 132.

The valve chamber 133 communicates with the discharge chamber 32 via an inlet port 137 formed in the valve housing 131 and communicates with the crank chamber 5 via a valve hole 138 and an outlet port 139, both formed in the valve housing 131. That is, the inlet port 137, the valve chamber 133, the valve hole 138 and the outlet port 139 form part of the gas supply passage 38.

A valve body 140 and an urging spring 141 are provided in the valve chamber 133. The valve body 140, which has a spherical shape, for example, and can move away from and into contact with a valve seat 142, which forms the valve hole 138. The urging spring 141 acts to seat the valve body 140 against the valve seat 142, which closes the valve hole 138.

A pressure sensitive rod 143 extending in the axial direction of the control valve 130 is located in the center of the valve housing 131 to slide axially. The lower end of the pressure sensitive rod 143 enters the upper area of the pressure sensitive chamber 132 and is connected to the diaphragm 134, and the upper end portion of the pressure sensitive rod 143 contacts the valve body 140 in the valve chamber 133. Accordingly, the pressure sensitive rod 143 is supported to be movable in the axial direction by the diaphragm 134 and the valve body 140.

The valve opening size of this internal control valve 130 is determined mainly by the suction pressure Ps, the discharge pressure Pd and the equilibrium of the forces of the urging spring 141, the diaphragm 134 and the set spring 135. The urging spring 141, the pressure sensitive rod 143, the diaphragm 134 and the set spring 135 form a pressure sensing mechanism, which determines the set pressure Pset of the internal control valve 130 and actuates the valve body 140 in accordance with a change in suction pressure Ps.

When the air conditioner switch 58 is on, the control computer 55 closes the gas-supply side opening/closing valve 122 and opens the bleed-side opening/closing valve 123. That is, the control computer 55 establishes the typical inlet-side internal control where the inlet-side control valve 130 is allowed to control the gas supply to the crank chamber 5 while restricting the gas discharge from the crank chamber 5 to a certain level with the fixed restrictor 124. The internal control by the inlet-side control valve 130 adjusts the crank pressure Pc to automatically control the angle of the swash plate and, consequently, the discharge displacement of the compressor.

When the start switch 58 is switched off, the control computer 55 opens the gas-supply side opening/closing valve 122 and closes the bleed-side opening/closing valve 123. This increases the crank pressure (Pc) by delivering gas to the crank chamber 5 from the discharge chamber 32, regardless of the opening size of the control valve 130, while completely blocking the gas discharge from the crank chamber 5 via the bleed passage 40. Consequently, the angle of the swash plate is set to the minimum inclination angle (near 0°), and the compressor begins minimum displacement operation, thus minimizing the load on the engine 14. When the start switch 58 is switched on again, the gas-supply side opening/closing valve 122 is closed and the bleed-side opening/closing valve 123 is opened, which causes the compressor to return to a normal operating condition.

The third embodiment has the following advantages.

The gas supply passage 39 having the gas-supply side opening/closing valve 122 is provided in addition to the gas supply passage 38 having the inlet-side control valve 130, the bleed-side opening/closing valve 123 is provided in the bleed passage 40, and switching between the open and the closed states of the two opening/closing valves 122 and 123 is controlled in the above-described manner. This ensure switching the operational state of the compressor between the normal operation state, which is characterized by typical inlet-side internal control, and minimum displacement operation, which is achieved by the forced increase in crank pressure Pc. This crank pressure control apparatus is therefore well suited for use in the variable displacement type swash plate compressor in FIG. 1, which can set the inclination angle of the swash plate to the vicinity of 0°.

Since the bleed-side opening/closing valve 123 provided in the bleed passage 40 is closed when the start switch 58 is switched off, lubricating oil cannot flow from the crank chamber 5 with the refrigerant gas in the minimum displacement operation, which improves lubrication of the internal mechanisms of the compressor.

Fourth Embodiment

Figure 13:
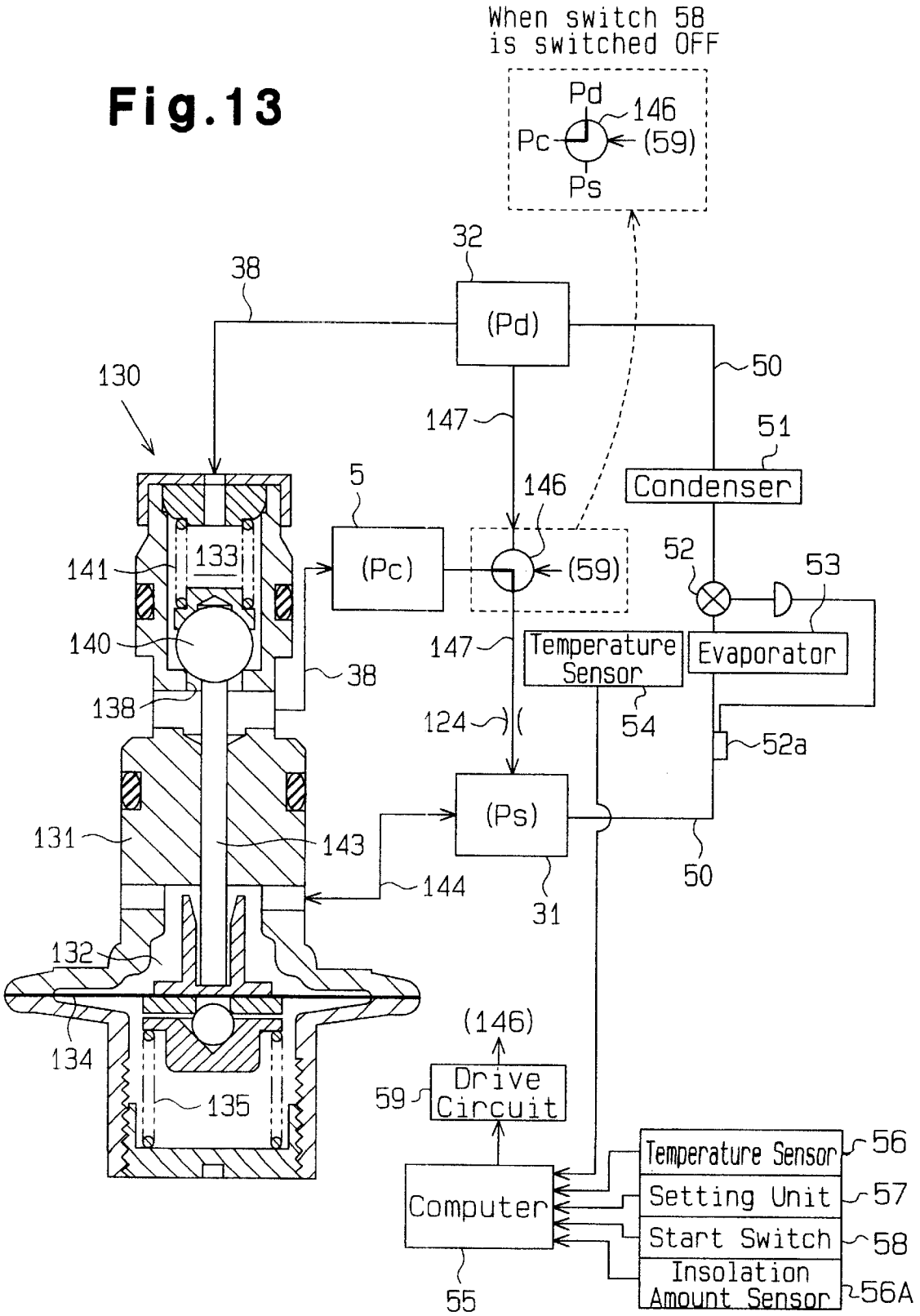
FIG. 13 is a diagram schematically illustrating a crank pressure control apparatus, including a cross sectional view of a displacement control valve.

The crank pressure control apparatus according to the fourth embodiment shown in FIG. 13 has the gas supply passage 38 for connecting the discharge chamber 32 and the crank chamber 5 in the compressor (see FIG. 1), and a gas-supply and bleed passage 147 which has a three-way valve 146, or a switching valve, located in the passage 147. The fourth embodiment is like the third embodiment (FIG. 12) except that the two opening/closing valves 122 and 123 have been replaced with the three-way valve 146.

An inlet-side internal control valve 130 is provided in the gas supply passage 38. This control valve 130 is the same as the control valve 130 in FIG. 12. As the pressure of the suction chamber 31 (suction pressure Ps) acts on the pressure sensitive chamber 132 of the control valve 130 via the pressure-sensing passage 144, the opening size of the inlet-side control valve 130 is automatically adjusted in accordance with a variation in suction pressure Ps.

The three-way valve 146, located at a branching point in the gas-supply and bleed passage 147, is an electromagnetic switching valve for selectively connecting the crank chamber 5 to the suction chamber 31 or the discharge chamber 32. The connection of the three-way valve 146 is switched by the control computer 55 by the drive circuit 59. The fixed restrictor 124 is located in the gas-supply and bleed passage 147 which connects the three-way valve 146 to the suction chamber 31. This fixed restrictor 124 is the same as the fixed restrictor 124 in FIG. 12.

When the start switch 58 for the air-conditioning system is on, the control computer 55 sets the electromagnetic switching valve 146 to a first switch position for connecting the crank chamber 5 to the suction chamber 31. This state is the same as the state in FIG. 12 where the gas-supply side opening/closing valve 122 is closed and the bleed-side opening/closing valve 123 is opened. That is, the control computer 55 establishes the typical inlet-side internal control of allowing the inlet-side control valve 130 to control the gas supply to the crank chamber 5 while restricting the gas discharge from the crank chamber 5 to a certain level by means of the fixed restrictor 124. The internal control by the inlet-side control valve 130 adjusts the crank pressure Pc to thereby automatically control the angle of the swash plate and, consequently, the discharge displacement of the compressor.

When the start switch 58 is switched off, the control computer 55 sets the electromagnetic switching valve 146 to a second switch position for connecting the crank chamber 5 to the discharge chamber 32. This state is the same as the state where the gas-supply side opening/closing valve 122 is opened and the bleed-side opening/closing valve 123 is closed. This increases the crank pressure (Pc) by delivering gas to the crank chamber 5 from the discharge chamber 32, regardless of the opening size of the control valve 130, while completely blocking the gas discharge from the crank chamber 5 via the gas-supply and bleed passage 147. Consequently, the angle of the swash plate is set to the minimum inclination angle (near 0°) and the compressor goes to minimum displacement operation, thus minimizing the load on the engine 14.

The fourth embodiment has the following advantages.

The electromagnetic switching valve 146 is located at a branching point in the gas-supply and bleed passage 147, which connects the crank chamber 5, the suction chamber 31 and the discharge chamber 32, and switching of this electromagnetic switching valve 146 is controlled, whereby the operational state of the compressor can be switched between the normal operation state, characterized by the typical inlet-side internal control, and the minimum displacement operation state, which is achieved by the forced increase in crank pressure Pc. This crank pressure control mechanism is therefore well suited for use in the variable displacement type swash plate compressor in FIG. 1, which can set the inclination angle of the swash plate to the vicinity of 0°.

Since communication between the crank chamber 5 and the suction chamber 31 via the gas-supply and bleed passage 147 is blocked when the start switch 58 is switched off, lubricating oil is prevented from flowing out of the crank chamber 5 with the refrigerant gas during minimum displacement operation, which avoids insufficient lubrication of the internal mechanisms of the compressor.

Fifth Embodiment

Figure 14:
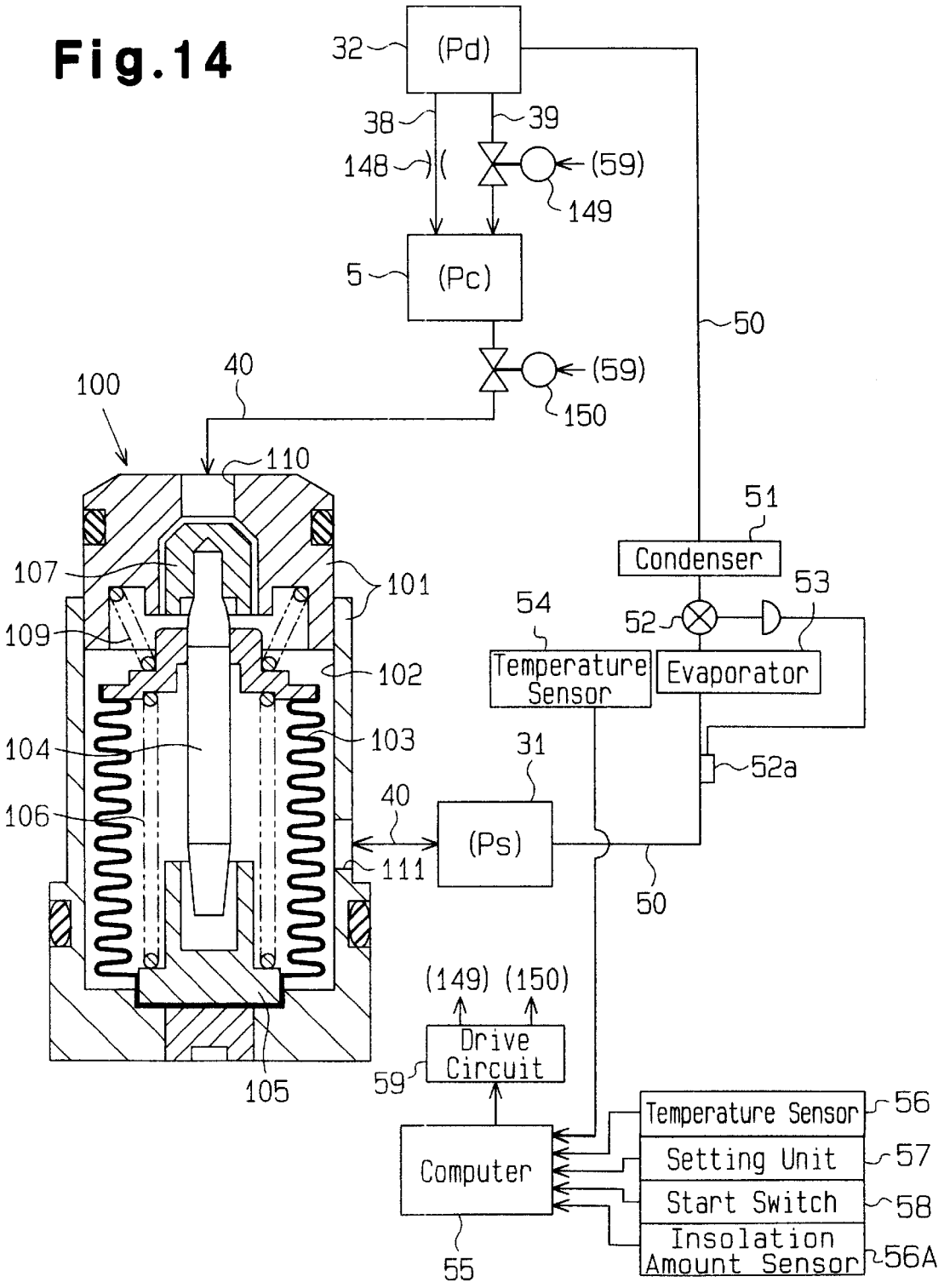
FIG. 14 is a diagram schematically illustrating a crank pressure control apparatus, including a cross sectional view of a displacement control valve.

The crank pressure control apparatus according to the fifth embodiment shown in FIG. 14 has two parallel gas supply passages 38 and 39, which connect the discharge chamber 32 and the crank chamber 5 (see FIG. 1), and the bleed passage 40, which connects the crank chamber 5 to the suction chamber 31. Further, a fixed restrictor 148 is provided in one (38) of the two gas supply passages 38 and 39, and a gas-supply side opening/closing valve 149 capable of blocking the other gas supply passage 39 is provided in the passage 39. A bleed-side opening/closing valve 150 capable of blocking the bleed passage 40 and the bleed-side (drain-side) internal control valve 100 are provided in series in the passage 40.

The gas-supply side opening/closing valve 149 and the bleed-side opening/closing valve 150 shown in FIG. 14 are both electromagnetic, and the valves 149 and 150 form opening/closing valve means, the actuation of which is controlled by the control computer 55 and the drive circuit 59.

The drain-side internal control valve 100 shown in FIG. 14 is the same as the internal control valve 100 in FIG. 11.

As the pressure of the suction chamber 31 (suction pressure Ps) acts on the pressure sensitive chamber 102 of the control valve 100, the opening size of the drain-side control valve 100 is automatically adjusted in accordance with a change in the suction pressure Ps.

When the start switch 58 is switched on, the control computer 55 opens the gas-supply side opening/closing valve 149 and closes the bleed-side opening/closing valve 150. That is, the control computer 55 establishes the typical drain-side internal control where the gas discharge from the crank chamber 5 is controlled by the drain-side internal control valve 100 while restricting the gas supply to the crank chamber 5 to a certain level with the fixed restrictor 148. The internal control by the drain-side control valve 100 adjusts the crank pressure Pc to automatically control the angle of the swash plate and, consequently, the discharge displacement of the compressor.

When the start switch 58 is switched off, the control computer 55 opens the gas-supply side opening/closing valve 149 and closes the bleed-side opening/closing valve 150. This increases the crank pressure (Pc) by delivering gas to the crank chamber 5 from the discharge chamber 32, despite the presence of the fixed restrictor 148, while completely blocking the gas discharge from the crank chamber 5 via the bleed passage 40. Consequently, the angle of the swash plate is set to the minimum inclination angle (near 0°) and the compressor goes to minimum displacement operation, which minimizes the load on the engine 14. When the start switch 58 is switched on again, the gas-supply side opening/closing valve 149 is closed and the bleed-side opening/closing valve 150 is opened, which returns the compressor to a normal operating condition.

The fifth embodiment has the following advantages.

The gas supply passage 39 is provided in addition to the gas supply passage 38 having the fixed restrictor 148, and the gas-supply side opening/closing valve 149, and the bleed-side opening/closing valve 150 are provided in the gas supply passage 39 and the bleed passage 40, respectively. By controlling the states of the two opening/closing valves 149 and 150 in the above-described manner, the compressor can be switched between normal operation, characterized by typical drain-side internal control, and the minimum displacement operation state, which is achieved by the forced increase of the crank pressure Pc. This crank pressure control apparatus is therefore well suited for use in the variable displacement type swash plate compressor in FIG. 1, which can set the inclination angle of the swash plate to the vicinity of 0°.

Since the bleed-side opening/closing valve 150 located in the bleed passage 40 is closed when the start switch 58 is switched off, lubricating oil cannot flow from the crank chamber 5 with the refrigerant gas during minimum displacement operation, which improves lubrication of internal parts.

Sixth Embodiment

Figure 15:
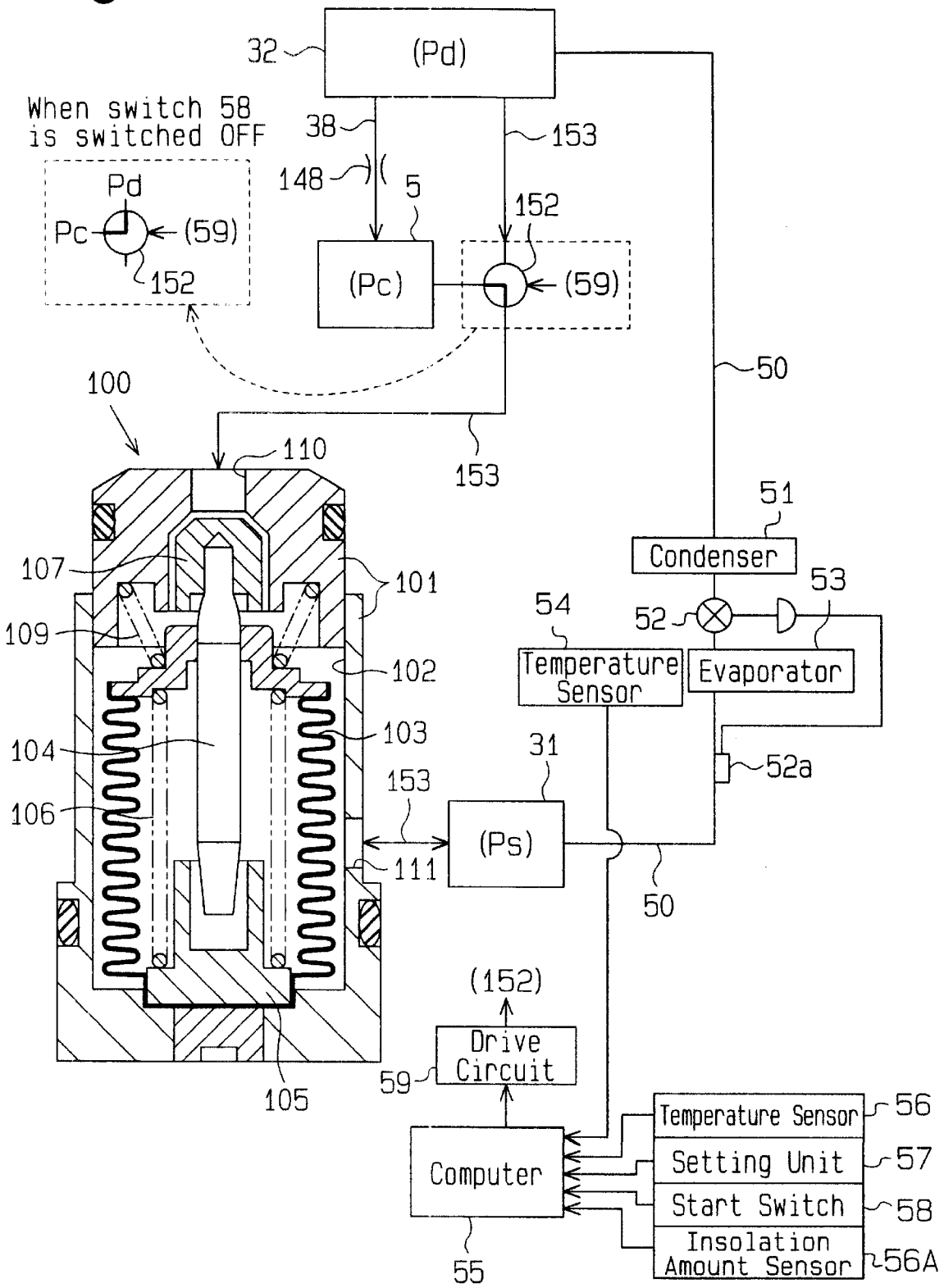
FIG. 15 is a diagram schematically illustrating a crank pressure control apparatus, including a cross sectional view of a displacement control valve.

The crank pressure control apparatus according to the sixth embodiment shown in FIG. 15 has the gas supply passage 38 for connecting the discharge chamber 32 and the crank chamber 5 in the compressor (see FIG. 1) together, and a gas-supply and bleed passage 153 which has a three-way valve 152 or a switching valve as opening/closing valve means located in the passage 153. The sixth embodiment is like the fifth embodiment (FIG. 14) except that the two opening/closing valves 149 and 150 have been replaced with the three-way valve 152.

The fixed restrictor 148, which is provided in the gas supply passage 38, is the same as the one shown in FIG. 14.

The three-way valve 152 and the drain-side internal control valve 100 are provided in series in the gas-supply and bleed passage 153. This drain-side internal control valve 100 is the same as the one shown in FIG. 14. As the pressure of the suction chamber 31 (suction pressure Ps) acts on the pressure sensitive chamber 102 of the control valve 100, the opening size of the drain-side control valve 100 is automatically adjusted in accordance with a change in suction pressure Ps.

The three-way valve 152, located at a branching point in the gas-supply and bleed passage 153, is an electromagnetic switching valve for selectively connecting the crank chamber 5 to the suction chamber 31 or the discharge chamber 32. The connection of the three-way valve 152 is switched by the control computer 55 by the drive circuit 59.

When the start switch 58 for the air-conditioning system is on, the control computer 55 sets the electromagnetic switching valve 152 to a first switch position for connecting the crank chamber 5 to the suction chamber 31. This state is the same as the state in FIG. 14 where the gas-supply side opening/closing valve 149 is closed and the bleed-side opening/closing valve 150 is opened. That is, the control computer 55 establishes the typical drain-side internal control of controlling the gas discharge from the crank chamber 5 by means of the drain-side internal control valve 100 while restricting the gas supply to the crank chamber 5 to a certain level by means of the fixed restrictor 148. The internal control by the drain-side control valve 100 adjusts the crank pressure Pc to thereby automatically control the angle of the swash plate and, consequently, the discharge displacement of the compressor.

When the start switch 58 is switched off, the control computer 55 sets the electromagnetic switching valve 152 to a second switch position for connecting the crank chamber 5 to the discharge chamber 32. This state is the same as the state in FIG. 14 where the gas-supply side opening/closing valve 149 is opened and the bleed-side opening/closing valve 150 is closed. This establishes the enforced crank pressure (Pc) increasing situation of compelling the gas supply to the crank chamber 5 from the discharge chamber 32 despite the presence of the fixed restrictor 148 while completely blocking the gas discharge from the crank chamber 5 via the gas-supply and bleed passage 150. Consequently, the angle of the swash plate is set to the minimum inclination angle (near 0°) and the compressor goes to the minimum displacement operation, thus minimizing the load on the engine 14.

The sixth embodiment has the following advantages.

The electromagnetic switching valve 152 is located at a branching point in the gas-supply and bleed passage 153 which connects the crank chamber 5, the suction chamber 31 and the discharge chamber 32, and switching of this electromagnetic switching valve 152 is controlled, whereby the operational state of the compressor can be switched between the normal operation state established by the typical drain-side internal control and the minimum displacement operation state achieved by the forced increase in crank pressure Pc. This crank pressure control apparatus is therefore well suited for use in the variable displacement type swash plate compressor in FIG. 1, which can set the inclination angle of the swash plate to the vicinity of 0°.

Since communication between the crank chamber 5 and the suction chamber 31 via the gas-supply and bleed passage 153 is blocked when the start switch 58 is switched off, lubricating oil cannot flow from the crank chamber 5 with the refrigerant gas during minimum displacement operation, which improves lubrication of internal parts.

Seventh Embodiment

Figure 16:
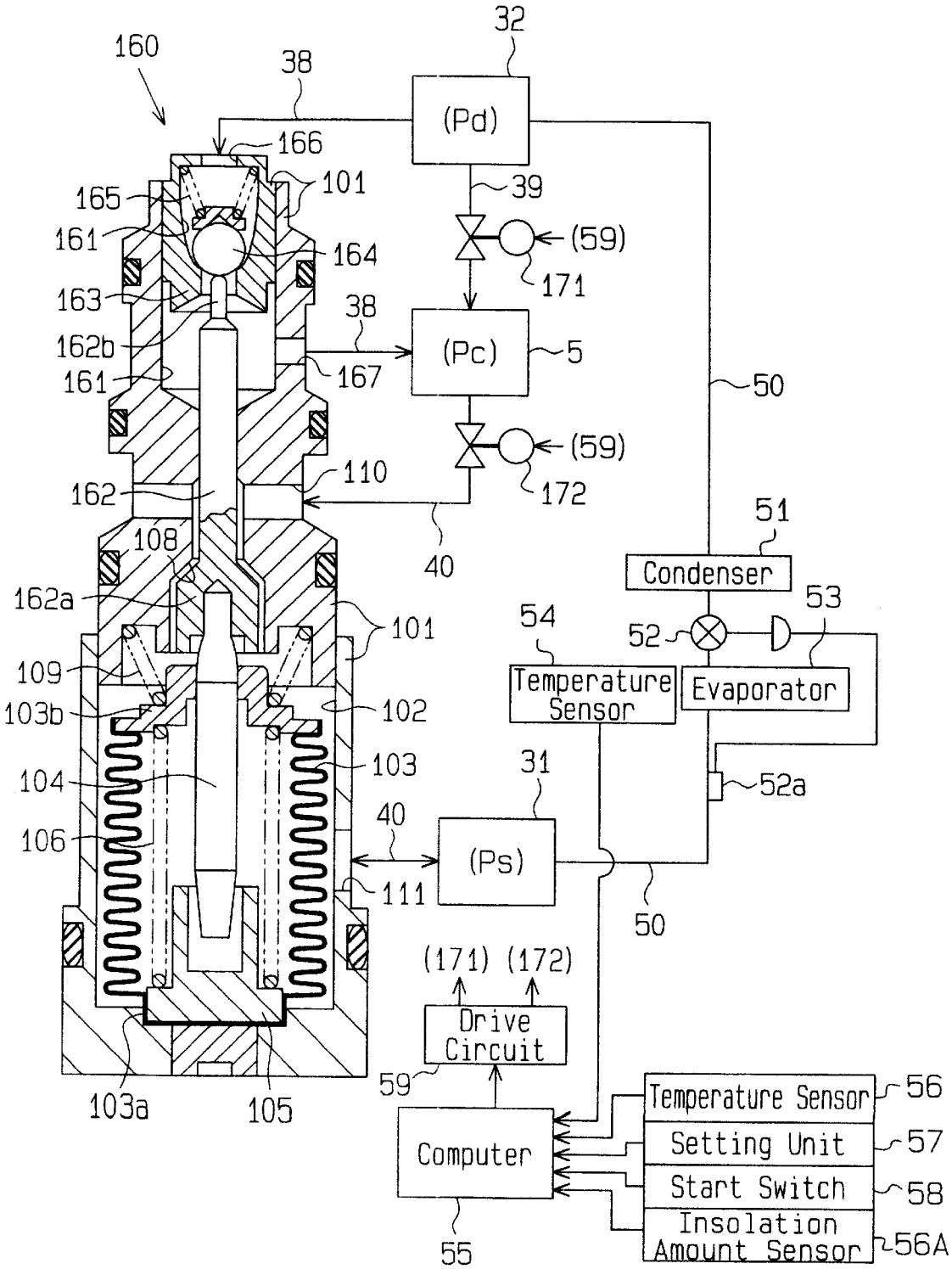
FIG. 16 is a diagram schematically illustrating a crank pressure control apparatus, including a cross sectional view of a displacement control valve.

The crank pressure control apparatus according to the seventh embodiment illustrated in FIG. 16 has two parallel gas supply passages 38 and 39, which connect the discharge chamber 32 and the crank chamber 5 in the compressor (see FIG. 1) together, and the bleed passage 40 which connects the crank chamber 5 to the suction chamber 31. Further, a displacement control valve 160 of an interlocked inlet-side control and drain-side control type to be discussed later is located between the gas supply passage 38 and the bleed passage 40. The crank pressure control apparatus of the seventh embodiment is like the crank pressure control apparatus of the fifth embodiment (FIG. 14) except that the fixed restrictor 148 has been replaced with the inlet-side control valve portion of the interlocked type control valve 160.

As shown in FIG. 16, a gas-supply side opening/closing valve 171 capable of blocking the other gas supply passage 39 is provided in the passage 39, and a bleed-side opening/closing valve 172 capable of blocking the bleed passage 40 is provided in the passage 40. The gas-supply side opening/closing valve 171 and the bleed-side opening/closing valve 172 are both electromagnetic type, and form opening/closing valve means whose opening/closing action is controlled by the control computer 55 by the drive circuit 59. The bleed-side opening/closing valve 172 in the bleed passage 40 is provided in series to the drain-side control valve portion of the interlocked type control valve 160.

The control valve 160 shown in FIG. 16 is an internal control valve of the interlocked inlet-side control and drain-side control type. The interlocked inlet-side control and drain-side control is a control system which implements control of the angle of the inlet-side control valve portion located in the gas supply passage 38 and control of the opening size of the drain-side control valve portion located in the bleed passage 40 in association with each other, thereby adjusting the dominant relationship between the amount of refrigerant gas to be supplied into the crank chamber 5 and the amount of refrigerant gas to be discharged from the crank chamber 5, whereby the crank pressure Pc is set to the required value to adjust the inclination angle of the swash plate.

The control valve 160 shown in FIG. 16 has the valve housing 101 which is comprised of a plurality of members, with the pressure sensitive chamber 102 and drain-side valve chamber 108 defined in the lower area of the valve housing 101 and an inlet-side valve chamber 161 defined in the upper area of the valve housing 101.

The bellows 103, which is provided inside the pressure sensitive chamber 102, has the fixed end 103*a* fitted in the bottom of the pressure sensitive chamber 102, and the movable end 103*b* opposite to the fixed end 103*a*. The pin body 104 extending in the axial direction of the control valve is held in the movable end 103*b* of the bellows 103. When the bellows 103 contracts, the lower end of this pin body 104 (the end in the bellows) contacts the stopper 105, located in the bellows 103, thus restricting further contraction of the bellows. The interior of the bellows 103 is set to a vacuum state or a pressure-reduced state, and a set spring 106 for urging the bellows 103 in the stretching direction is located in the bellows 103. The bellows 103 and the set spring 106 form a pressure sensitive member.

The conical spring 109 for urging the bellows 103 in the contracting direction is located between the valve housing 101 and the movable end 103*b* of the bellows 103. This spring 109 serves to hold and position the bellows 103 in the pressure sensitive chamber 102 against the urging action of the set spring 106.

A pressure sensitive rod 162 is provided in the center area of the valve housing 101 to slide in the axial direction of the control valve. The pressure sensitive rod 162 has a lower end 162*a* formed in substantially the same shape as the valve body 107 in FIG. 11. The lower end 162*a* is supported on the upper end of the pin body 104 (the end positioned outside the bellows 103), and is placed in the drain-side valve chamber 108 to serve as a drain-side valve body. As the pin body 104 moves in response to the stretching/contracting action of the bellows 103, the lower end (drain-side valve body) 162*a* of the pressure sensitive rod 162 changes the cross-sectional area of communication (i.e., the opening size of the drain-side control valve portion) between the port 110, formed in the valve housing 101, and the pressure sensitive chamber 102.

The port 110 communicates with the crank chamber 5 of the compressor, and the pressure sensitive chamber 102 communicates with the suction chamber 31 of the compressor via a port 111 formed in the valve housing 101. The port 110, the drain-side valve chamber 108, the pressure sensitive chamber 102 and the port 111 form part of the bleed passage 40 which connects the crank chamber 5 to the suction chamber 31. As the suction pressure Ps reaches the pressure sensitive chamber 102 via this bleed passage 40, the bleed passage 40 also serves as a pressure-sensing passage for permitting the suction pressure Ps to act on the pressure sensitive chamber 102.

The bellows 103, the pin body 104, the stopper 105, the set spring 106, the spring 109 and the pressure sensitive rod 162, provided in the pressure sensitive chamber 102, form the drain-side control valve portion of this control valve 160, and the opening size of the drain-side control valve portion (the opening size of the bleed passage 40) is controlled in accordance with the arrangement of the drain-side valve body (the lower end 162*a* of the pressure sensitive rod 162).

An approximately annular valve seat 163 (the center being a valve hole) is provided at the inner wall of the valve housing 101 which defines the inlet-side valve chamber 161. With the valve seat 163 as the boundary, the inlet-side valve chamber 161 is separated into an upper area (discharge-chamber side area) and a lower area (crank-chamber side area). Formed in the valve housing 101 are a port 166 for connecting the upper area of the inlet-side valve chamber 161 to the discharge chamber 32, and a port 167 for connecting the lower area of the inlet-side valve chamber 161 to the crank chamber 5. The port 166, the inlet-side valve chamber 161 and the port 167 form part of the gas supply passage 38 that connects the discharge chamber 32 to the crank chamber 5.

An inlet-side valve body 164 is retained in the upper area of the inlet-side valve chamber 161 to move in the axial direction. As this inlet-side valve body 164 sits on the valve seat 163, communication between the upper area and lower area is blocked. The inlet-side valve body 164 is urged in the direction of sitting on the valve seat 163 by a spring 165 located between the inlet-side valve body 164 and the valve housing 101. The pressure sensitive rod 162 has an upper end 162*b* abutting on the bottom of the inlet-side valve body 164 via the valve hole of the valve seat 163, whereby as the pressure sensitive rod 162 moves upward, the inlet-side valve body 164 is lifted upward away from the valve seat 163 against the force of the spring 165.

The pressure sensitive rod 162, the valve seat 163, the inlet-side valve body 164 and the spring 165, provided in the inlet-side valve chamber 161, form the inlet-side control valve portion of this control valve 160, and the opening size of the inlet-side control valve portion (the opening size of the gas supply passage 38) is controlled in accordance with the arrangement of the valve body 164.

In this control valve 160, the bellows 103, the pin body 104, the stopper 105, the set spring 106, the spring 109, the pressure sensitive rod 162 and the spring 165 form a pressure sensing mechanism which determines the set pressure Pset of this control valve 160, and actuates the pressure sensitive rod 162 (or the drain-side valve body) and the inlet-side valve body 164 in accordance with a change in suction pressure Ps. As apparent from the above, the drain-side control valve portion and inlet-side control valve portion of the control valve 160 are interlocked with each other by the common pressure sensing mechanism.

The opening sizes of the drain-side control valve portion and the inlet-side control valve portion of the control valve 160 are determined mainly by the suction pressure Ps, the discharge pressure Pd and the balance of the forces of the set spring 106, and the springs 109 and 165. More specifically, when the suction pressure Ps is high, the pressure sensitive rod 162 and the pin body 104 move downward, reducing the opening size of the inlet-side control valve portion while increasing the opening size of the drain-side control valve portion. In this case, gas discharge from the crank chamber 5 becomes stronger the gas supply to the crank chamber 5, so that the crank pressure Pc drops, thus increasing the inclination angle of the swash plate. When the suction pressure Ps is low, on the other hand, the pressure sensitive rod 162 and the pin body 104 move upward, increasing the opening size of the inlet-side control valve portion while reducing the opening size of the drain-side control valve portion. In this case, gas supply to the crank chamber 5 becomes stronger the gas discharge from the crank chamber 5, so that the crank pressure Pc rises, thus decreasing the inclination angle of the swash plate.

According to this control valve 160, the force of the discharge pressure Pd works against the set spring 106 of the pressure sensing mechanism via the inlet-side valve body 164 and the pressure sensitive rod 162, and cancels out the force of the set spring 106. This achieves a so-called high pressure compensation for reducing the set pressure Pset of the control valve 160 in accordance with the level of the discharge pressure Pd.

When the start switch 58 for the air-conditioning system is on, the control computer 55 closes the gas-supply side opening/closing valve 171 and opens the bleed-side opening/closing valve 172. Then, the control computer 55 implements gas supply to the crank chamber 5 via the gas-supply passage 38 in which the inlet-side control valve portion of the control valve 160 is located, and implements gas discharge from the crank chamber 5 via the bleed passage 40 in which the drain-side control valve portion of the control valve 160 is located. That is, the control computer 55 permits the interlocked internal control valve 160 to execute both control on gas supply to the crank chamber 5 and control on gas discharge from the crank chamber 5. Then, the internal control by the control valve 160 adjusts the crank pressure Pc to thereby automatically control the angle of the swash plate and, consequently, the discharge displacement of the compressor.

When the start switch 58 is switched off, the control computer 55 opens the gas-supply side opening/closing valve 171 and closes the bleed-side opening/closing valve 172. This establishes the enforced crank pressure (Pc) increasing situation of compelling the gas supply to the crank chamber 5 from the discharge chamber 32 regardless of the opening size of the inlet-side control valve portion of the control valve 160 while completely blocking the gas discharge from the crank chamber 5 via the bleed passage 40. Consequently, the angle of the swash plate is set to the minimum inclination angle (near 0°) and the compressor goes to the minimum displacement operation, thus minimizing the load on the engine 14. When the start switch 58 is switched on again, the gas-supply side opening/closing valve 171 is closed and the bleed-side opening/closing valve 172 is opened, causing the compressor to return to a normal operating condition.

The seventh embodiment has the following advantages.

The gas supply passage 39 is provided in addition to the gas supply passage 38 having the inlet-side control valve portion of the control valve 160 located therein, the gas-supply side opening/closing valve 171 and the bleed-side opening/closing valve 172 are respectively provided in the gas supply passage 39 and the bleed passage 40. As switching between the open and the close states of the two opening/closing valves 171 and 172 is controlled in the above-described manner, it is possible to switch the operational state of the compressor between the normal operation state, established by the typical interlocked inlet-side control and drain-side control, and the minimum displacement operation state achieved by the forced increase in crank pressure Pc. This crank pressure control apparatus is therefore well suited for use in the variable displacement type swash plate compressor in FIG. 1, which can set the inclination angle of the swash plate to the vicinity of 0°.

Since the bleed-side opening/closing valve 172 in the bleed passage 40 is closed when the start switch 58 is switched off, lubricating oil cannot flow from the crank chamber 5 with the refrigerant gas during minimum displacement operation, which improves lubrication of internal parts.

Eighth Embodiment

Figure 17:
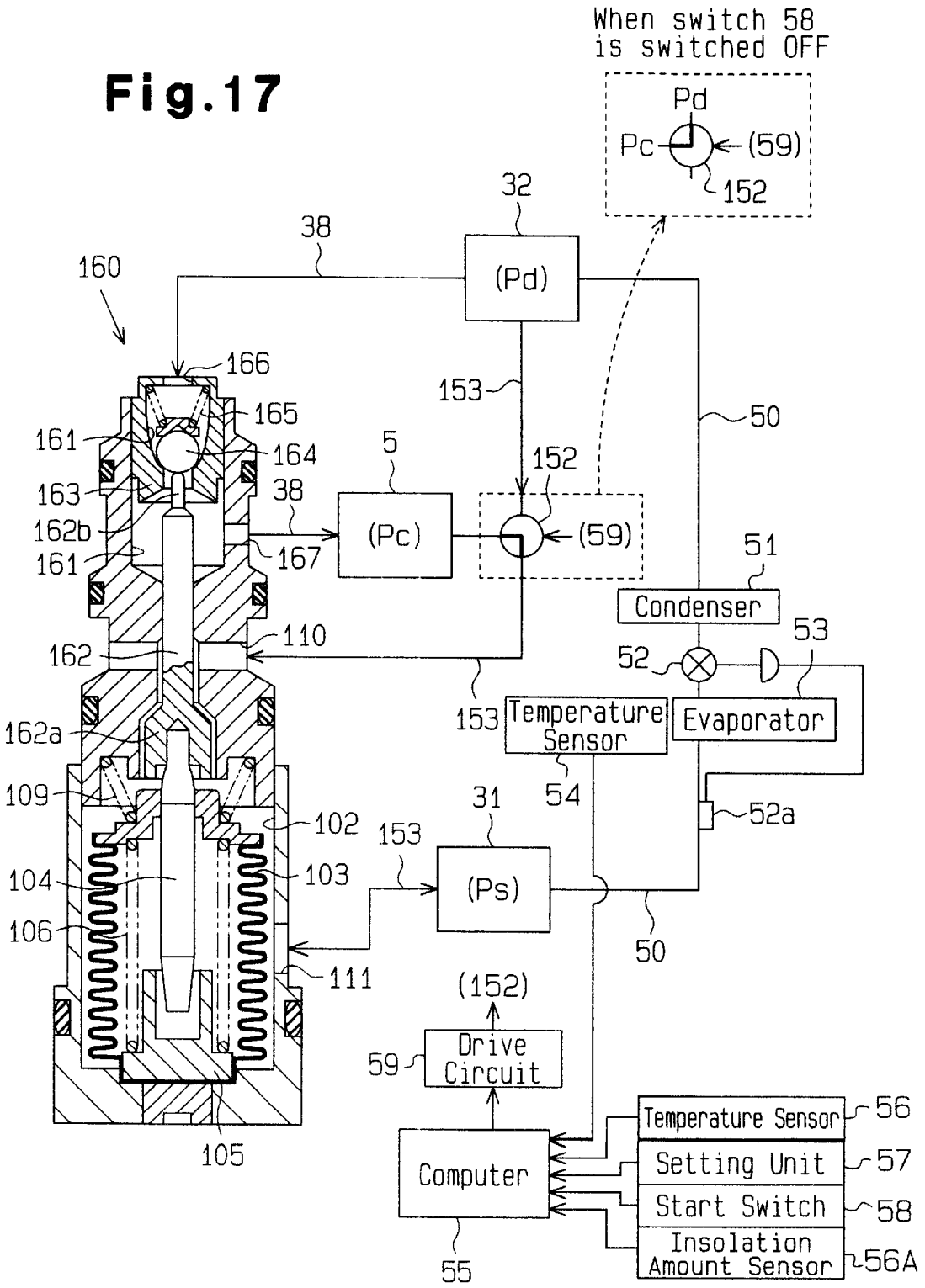
FIG. 17 is a diagram schematically illustrating a crank pressure control apparatus, including a cross sectional view of a displacement control valve.

The crank pressure control apparatus according to the eighth embodiment shown in FIG. 17 has the gas supply passage 38 for connecting the discharge chamber 32 and the crank chamber 5 in the compressor (see FIG. 1) together, the gas-supply and bleed passage 153 which has the three-way valve 152 as opening/closing valve means located therein, and the displacement control valve 160. The displacement control valve 160 in FIG. 17 is the same as the internal control valve 160 of the interlocked inlet-side control and drain-side control type which has been described in the foregoing description of the seventh embodiment (FIG. 16). The eighth embodiment is like the seventh embodiment (FIG. 16) except that the two opening/closing valves 171 and 172 have been replaced with the three-way valve 152.

The inlet-side control valve portion of the control valve 160 is provided in the gas supply passage 38. The three-way valve 152 and the drain-side control valve portion of the control valve 160 are provided in series in the gas-supply and bleed passage 153. As the pressure of the suction chamber 31 (suction pressure Ps) acts on the pressure sensitive chamber 102 of the control valve 160, the valve opening sizes of the inlet-side and drain-side control valve portions are automatically adjusted in accordance with a variation in suction pressure Ps.

The three-way valve 152, located at a branching point in the gas-supply and bleed passage 153, is an electromagnetic switching valve for selectively connecting the crank chamber 5 to the suction chamber 31 or the discharge chamber 32. The connection of the three-way valve 146 is switched by the control computer 55 by the drive circuit 59.

When the start switch 58 for the air-conditioning system is on, the control computer 55 sets the electromagnetic switching valve 152 to a first switch position for connecting the crank chamber 5 to the suction chamber 31. This state is the same as the state in FIG. 16 where the gas-supply side opening/closing valve 171 is closed and the bleed-side opening/closing valve 172 is opened. That is, the control computer 55 permits the interlocked internal control valve 160 to carry out both control on gas supply to the crank chamber 5 and control on gas discharge from the crank chamber 5. The internal control by the control valve 160 adjusts the crank pressure Pc to thereby automatically control the angle of the swash plate and, consequently, the discharge displacement of the compressor.

When the start switch 58 is switched off, the control computer 55 sets the electromagnetic switching valve 152 to a second switch position for connecting the crank chamber 5 to the discharge chamber 32. This state is the same as the state in FIG. 16 where the gas-supply side opening/closing valve 171 is opened and the bleed-side opening/closing valve 172 is closed. This establishes the enforced crank pressure (Pc) increasing situation of compelling the gas supply to the crank chamber 5 from the discharge chamber 32 regardless of the opening size of the inlet-side control valve portion of the control valve 160 while completely blocking the gas discharge from the crank chamber 5 via the gas-supply and bleed passage 153. Consequently, the angle of the swash plate is set to the minimum inclination angle (near 0°) and the compressor goes to the minimum displacement operation, thus minimizing the load on the engine 14.

The eighth embodiment has the following advantages.

The electromagnetic switching valve 152 is located at a branching point in the gas-supply and bleed passage 153 which connects the crank chamber 5, the suction chamber 31 and the discharge chamber 32, and switching of this electromagnetic switching valve 152 is controlled, whereby the operational state of the compressor can be switched between the normal operation state established by the typical inlet-side and drain-side interlocked control and the minimum displacement operation state achieved by the forced increase in crank pressure Pc. This crank pressure control apparatus is therefore well suited for use in the variable displacement type swash plate compressor in FIG. 1, which can set the inclination angle of the swash plate to the vicinity of 0°.

Since communication between the crank chamber 5 and the suction chamber 31 via the gas-supply and bleed passage 153 is blocked when the start switch 58 is switched off, lubricating oil cannot flow from the crank chamber 5 with the refrigerant gas during minimum displacement operation, which improves lubrication of internal parts.

Ninth and Tenth Embodiments

The ninth and tenth embodiments are designed in such a manner that a special internal control valve is located in the bleed passage which connects the crank chamber and the suction chamber and is provided with a function of selectively sealing the bleed passage. Sealing the bleed passage with the internal control valve allows the variable displacement type swash plate compressor to reliably and swiftly shift to minimum displacement operation from normal operation. The ninth and tenth embodiments will be discussed below individually.

Ninth Embodiment

Figure 18:
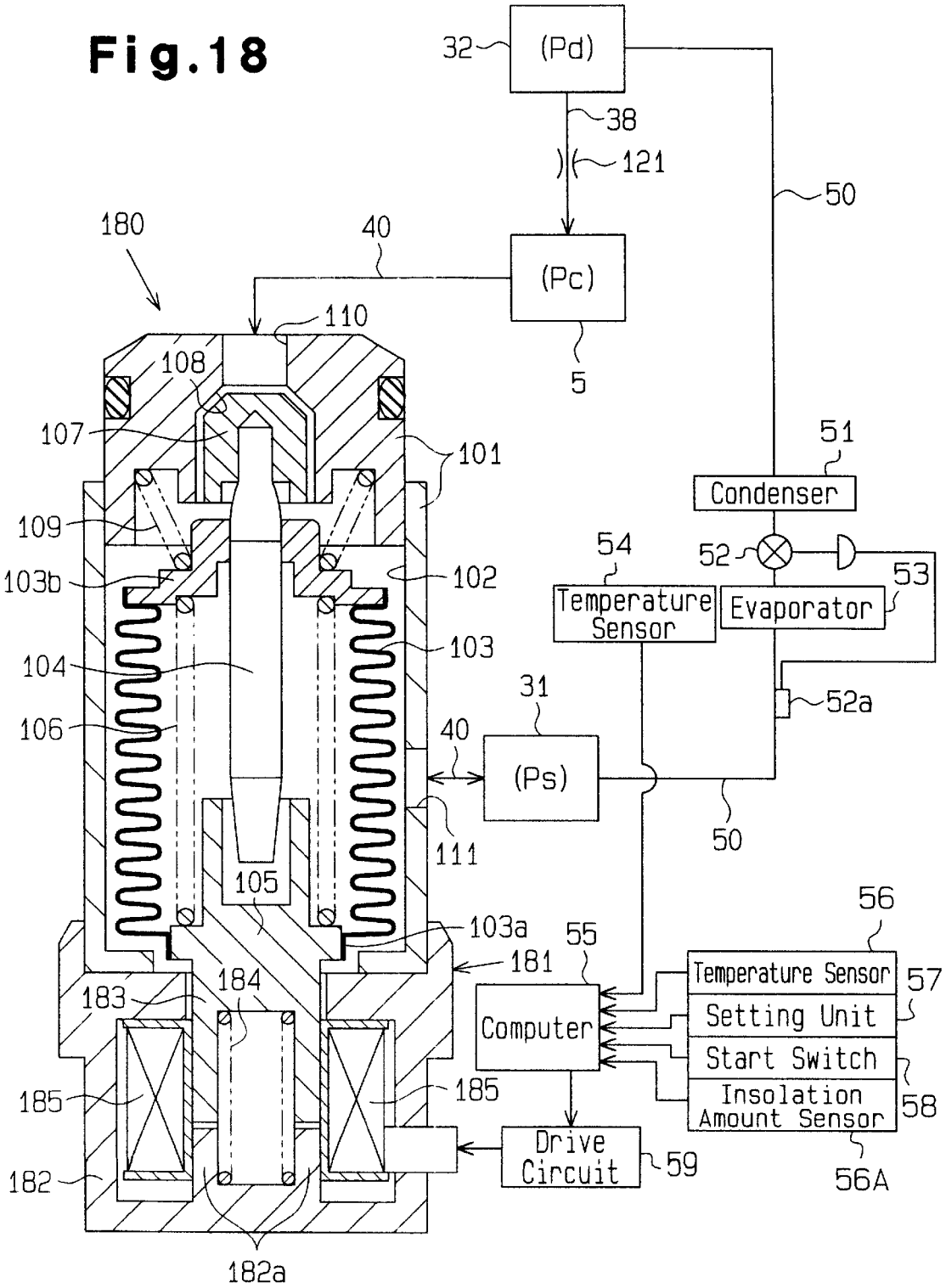
FIG. 18 is a diagram schematically illustrating a crank pressure control apparatus, including a cross sectional view of a displacement control valve.

The crank pressure control apparatus of the ninth embodiment shown in FIG. 18 has the gas supply passage 38 for connecting the discharge chamber 32 to the crank chamber 5 and the bleed passage 40 for connecting the crank chamber 5 to the suction chamber 31. Located in the gas supply passage 38 is the fixed restrictor 121 which is the same as the one shown in FIG. 11. The supply of highly-pressurized refrigerant gas to the crank chamber 5 from the discharge chamber 32 is established via this fixed restrictor 121. A displacement control valve 180 to be discussed below is provided in the bleed passage 40. The displacement control system according to the ninth embodiment is like the displacement control system of the second embodiment (FIG. 11) except that the electromagnetic opening/closing valve 120 has been removed and the control valve 100 has been replaced with the control valve 180.

The control valve 180 shown in FIG. 18 is basically a drain-side control valve of the internal control type, and is like the internal control valve 180 in FIG. 11 except that an electromagnet has been attached to the bottom of the control valve 100. The pressure sensitive chamber 102 and the valve chamber (drain-side valve chamber) 108 are defined in the valve housing 101 of the control valve 180 as in the internal control valve 100 in FIG. 11. Those chambers 102 and 108, together with the ports 110 and 111 formed in the valve housing 101, form part of the bleed passage 40. The bellows 103, the pin body 104, the stopper 105, the set spring 106, the valve body 107 and the spring 109 are provided in the valve housing 101, and form a pressure sensing mechanism which determines the set pressure Pset of the control valve 180 and actuates the valve body 107 in accordance with a change in suction pressure Ps.

The control valve 180 further has an electromagnet 181 attached to the bottom of the valve housing 101. The electromagnet 181 has a housing 182 connected to the bottom of the valve housing 101 and a plunger 183 which is retained in the housing 182 to move in the axial direction. At least the bottom, 182*a*, of the housing 182 is formed of iron, and this bottom 182*a* serves as a fixed iron core. The plunger 183 serves as a movable iron core. The upper end of the plunger 183 extends inside the pressure sensitive chamber 102 to be integrated with the stopper 105, with the fixed end 103*a* of the bellows 103 secured to this upper end. Therefore, the plunger 183 is movable together with the bellows 103 and the stopper 105.

The electromagnet 181 further has a follow-up spring 184 and a coil 185 in the housing 182. The follow-up spring 184 urges the plunger 183 upward (toward the pressure sensitive chamber 102). The coil 185 surrounds the plunger 183 and excitation of the coil 185 is controlled by the control computer 55 via the drive circuit 59. When current is supplied to the coil 185, electromagnetic attraction is produced, which causes the plunger 183 to move downward, against the force of the follow-up spring 184, to the lowermost position where the lower end of the plunger 183 contacts the housing bottom 182*a*. When the current supply to the coil 185 is stopped, on the other hand, the electromagnetic attraction disappears and the plunger 183 moves upward with the force of the follow-up spring 184. In the upward movement of the plunger 183, the stopper 105 abuts the lower end of the pin body 104, after which the pin body 104 and the valve body 107 move upward together with the plunger 183. When the valve body 107 contacts the top wall of the valve chamber 108 and the plunger 183 reaches the uppermost position, further movement of the pin body 104, the valve body 107 and the plunger 183 is restricted and the port 110 is closed. As apparent from the above, the displacement control valve 180 serves as opening/closing valve means, the position of which can be adjusted by external control means.

When the start switch 58 for the air-conditioning system is on, the control computer 55 continues supplying current to the coil 185 of the electromagnet 181. At this time, electromagnetic attraction generated on the coil 185 causes the plunger 183 to move downward to the lowermost position against the force of the follow-up spring 184. In this situation, the control valve 180, like the control valve 100 in FIG. 11, serves as a drain-side internal control valve. That is, the opening size of the control valve 180 is determined mainly by the suction pressure Ps and the balance of the forces of the bellows 103, the set spring 106 and the spring 109. Then, the control computer 55 implements internal control to properly adjust the crank pressure Pc by means of the drain-side control valve 180, thereby automatically controlling the angle of the swash plate and, consequently, the discharge displacement of the compressor (normal operation by drain-side internal control).

When the start switch 58 is switched off, the control computer 55 stops supplying current to the coil 185 of the electromagnet 181. Consequently, the electromagnetic attraction on the coil 185 vanishes and the plunger 183, the stopper 105, the pin body 104 and the valve body 107 move upward due to the force of the follow-up spring 184. As the valve body 107 contacts the top wall of the valve chamber 108, the port 110 is closed. That is, the control valve 180 closes (zero valve opening size). This blocks gas discharge to the suction chamber 31 from the crank chamber 5 via the bleed passage 40. As a result, the crank pressure Pc rises to set the angle of the swash plate to the minimum inclination angle (near 0°), so that the compressor goes to minimum displacement operation, thus minimizing the load on the engine 14. When the start switch 58 is switched on again, the current supply to the coil 185 of the electromagnet 181 restarts, which causes the compressor to return to normal operation.

In the closed state of the control valve 180 (where the valve body 107 contacts the top wall of the valve chamber 108 and closes the port 110), the force of the follow-up spring 184 is transferred to the valve body 107 by the plunger 183, the stopper 105 and the pin body 104. In other words, the force in the valve closing direction (upward), which essentially is the spring force of the follow-up spring 184, acts on the valve body 107. While the crank pressure Pc acts on the top of the valve body 107, which is moved to the closed position of the port 110, the suction pressure Ps acts on the bottom of the valve body 107. Since the inequality Ps<Pc is usually true in variable displacement type swash plate compressors, the force in the valve opening direction (downward) based on the differential pressure (Pc−Ps) between the crank pressure and the suction pressure acts on the valve body 107. If the spring force of the follow-up spring 184 is always weaker than the force based on the differential pressure (Pc−Ps), the control valve 180 cannot be closed. On principle, therefore, the spring force of the follow-up spring 184 is set greater than the differential pressure (Pc−Ps).

When the start switch 58 is switched off and the bleed passage 40 is closed by the control valve 180 in response to the OFF action, the discharge pressure from the crank chamber 5 hardly remains. If the start switch 58 is switched off with considerably high discharge pressure Pd, therefore, the crank pressure Pc would quickly rise to the level equivalent to the high discharge pressure Pd. This may damage the shaft seal unit of the compressor, impairing the airtightness of the crank chamber 5.

According to the control valve 180 of the ninth embodiment, however, the spring force of the follow-up spring 184 can be set slightly lower than the differential pressure (Pc−Ps) in such a manner that when the differential pressure (Pc−Ps) acting on the valve body 107 exceeds a predetermined maximum allowance, the force in the valve opening direction by the differential pressure (Pc−Ps) becomes stronger than the force in the valve closing direction by the spring force of the follow-up spring 184. The maximum allowance of the differential pressure (Pc−Ps) can be determined properly in consideration of the withstand pressure limit of the shaft seal unit of the compressor and the maximum value of the differential pressure (Pc−Ps) needed for the variable displacement control of the compressor. Thus, setting the spring force of the follow-up spring 184 slightly lower can allow the control valve 180 in the closed state to work as a kind of a relief valve. In this case, therefore, the crank pressure Pc which is likely to gradually rise in response to the closing of the bleed passage 40 is prevented from rising excessively above the withstand pressure limit of the shaft seal unit.

The ninth embodiment has the following advantages.

The fixed restrictor 121 is provided in the gas supply passage 38 to be able to always supply a predetermined amount of refrigerant gas to the crank chamber 5 from the discharge chamber 32, and the drain-side control valve 180 provided in the bleed passage 40 is designed in such a way that the control valve 180 can be closed under external current supply control. By controlling the current supply to the coil 185 of the electromagnet 181 in the above-described manner, therefore, it is possible to switch the operational state of the compressor between the normal operation state established by the typical drain-side internal control and the minimum displacement operation state established by the forced increase in crank pressure Pc. This crank pressure control apparatus is thus well suitable for use in the variable displacement type swash plate compressor in FIG. 1, which can set the inclination angle of the swash plate to the vicinity of 0°.

The spring force of the follow-up spring 184 can be set in such a way that when the differential pressure (Pc−Ps) acting on the valve body 107 rises above the predetermined maximum allowance, the force in the valve opening direction by the differential pressure (Pc−Ps) becomes stronger than the force in the valve closing direction by the spring force of the follow-up spring 184. Such setting can allow the control valve 180 in the closed state to work as a relief valve to prevent the crank pressure Pc from rising excessively. Therefore, even after the compressor is shifted to minimum displacement operation by closing the bleed passage 40, it is possible to prevent the crank pressure Pc from rising to a level that would damage the compressor.

Since the control valve 180 located in the bleed passage 40 is closed when the start switch 58 is switched off, lubricating oil cannot flow from the crank chamber 5 with the refrigerant gas during minimum displacement operation, which improves lubrication of internal parts.

Tenth Embodiment

Figure 19:
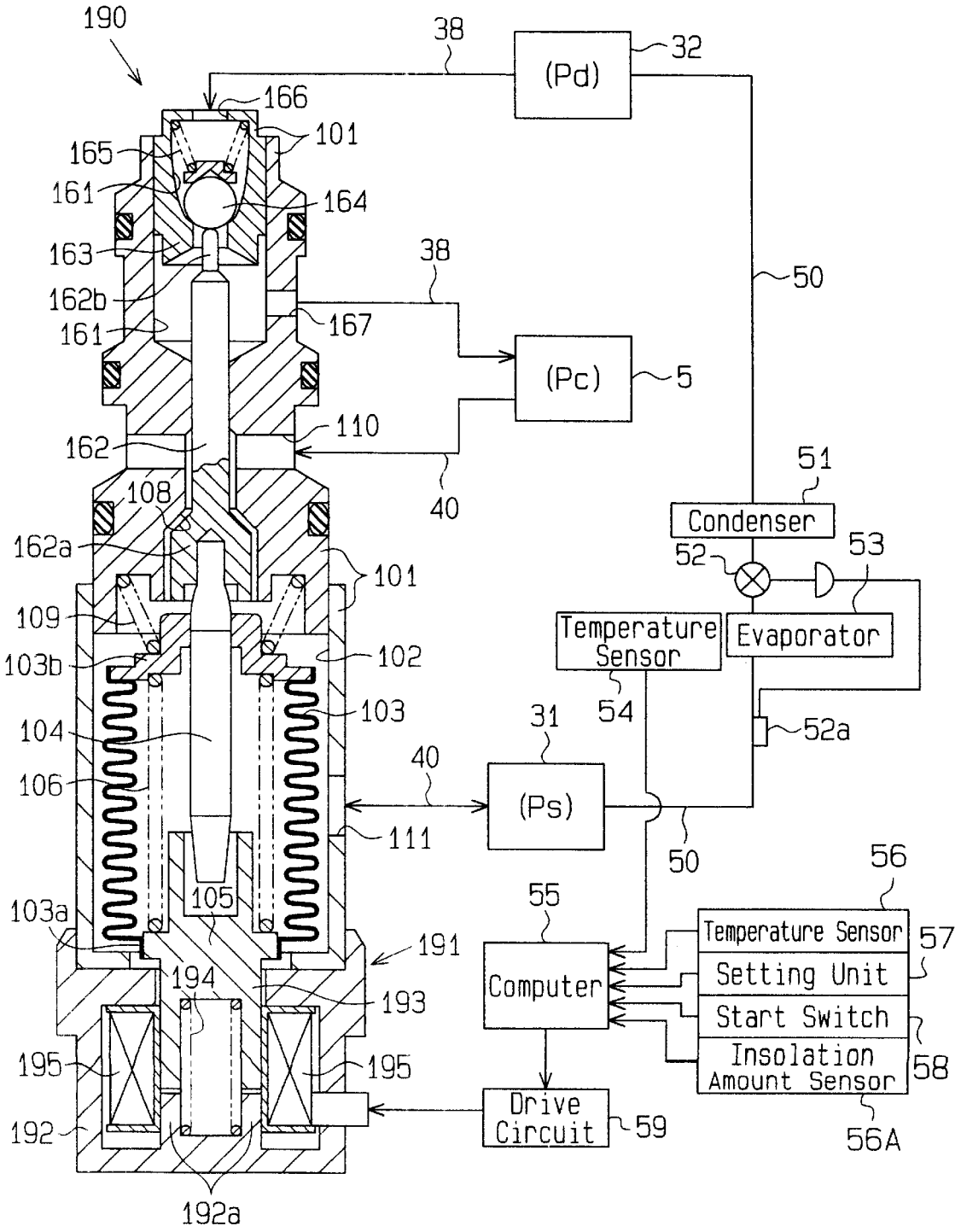
FIG. 19 is a diagram schematically illustrating a crank pressure control apparatus, including a cross sectional view of a displacement control valve.

The crank pressure control apparatus of the tenth embodiment shown in FIG. 19 has the gas supply passage 38 for connecting the discharge chamber 32 to the crank chamber 5 and the bleed passage 40 for connecting the crank chamber 5 to the suction chamber 31. Further, an interlocked inlet-side control and drain-side control type displacement control valve 190 to be discussed below is located between the gas supply passage 38 and the bleed passage 40. The crank pressure control apparatus according to the tenth embodiment is like the crank pressure control apparatus of the ninth embodiment (FIG. 18) except that the fixed restrictor 121 has been replaced with the inlet-side control valve portion of the interlocked type control valve 190.

The control valve 190 shown in FIG. 19 is basically an internal control valve of an interlocked inlet-side control and drain-side control type, and is like the internal control valve 160 in FIG. 16 except that an electromagnet has been attached to the bottom of the control valve 160.

Like the internal control valve 160 in FIG. 16, the control valve 190 has the pressure sensitive chamber 102 and drain-side valve chamber 108 defined in the lower area of the valve housing 101 and the inlet-side valve chamber 161 defined in the upper area of the valve housing 101. Those chambers 102 and 108, together with the ports 110 and 111 formed in the valve housing 101, form part of the bleed passage 40. The inlet-side valve chamber 161, together with the ports 166 and 167 formed in the valve housing 101, forms part of the gas supply passage 38. The pressure sensitive rod 162 is placed in the center area of the valve housing 101 to slide in the axial direction of the control valve.

The bellows 103, the pin body 104, the stopper 105, the set spring 106, the spring 109 and the lower end 162*a* (serving as a drain-side valve body) of the pressure sensitive rod 162 are provided in the pressure sensitive chamber 102 and the drain-side valve chamber 108, and form a drain-side control valve portion of the control valve 190. The opening size of this drain-side control valve portion (i.e., the opening size of the bleed passage 40) is adjusted according to the location of the drain-side valve body 162*a*. The upper end 162*b* of the pressure sensitive rod 162, the valve seat 163, the inlet-side valve body 164 and the spring 165 are provided in the inlet-side valve chamber 161, and form the inlet-side control valve portion of the control valve 190. The opening size of this inlet-side control valve portion (i.e., the opening size of the gas supply passage 38) is adjusted according to the location of the inlet-side valve body 164. The bellows 103, the pin body 104, the stopper 105, the set spring 106, the spring 109, the pressure sensitive rod 162 and the spring 165 form a pressure sensing mechanism which determines the set pressure Pset of the control valve 190 and actuates the pressure sensitive rod 162 (serving as the drain-side valve body) and the inlet-side valve body 164 in accordance with a change in suction pressure Ps. As apparent from the above, the drain-side control valve portion and inlet-side control valve portion of the control valve 190 are interlocked with each other by means of the common pressure sensing mechanism.

The control valve 190 further has an electromagnet 191 attached to the bottom of the valve housing 101. The electromagnet 191 has a housing 192 connected to the bottom of the valve housing 101 and a plunger 193 which is retained in the housing 192 to move in the axial direction. At least the bottom, 192*a*, of the housing 192 is formed of iron, and this bottom 192*a* serves as a fixed iron core. The plunger 193 serves as a movable iron core. The upper end of the plunger 193 extends inside the pressure sensitive chamber 102 to be integrated with the stopper 105, with the fixed end 103*a* of the bellows 103 secured to this upper end. Therefore, the plunger 193 is movable together with the bellows 103 and the stopper 105.

The electromagnet 191 further has a follow-up spring 194 and a coil 195 in the housing 192. The follow-up spring 194 urges the plunger 193 upward (toward the pressure sensitive chamber 102). The coil 195 is so provided as to surround the plunger 193 serving as the movable iron core, and its excitation is controlled by the control computer 55 by the drive circuit 59.

When current is supplied to the coil 195, electromagnetic attraction is produced, causing the plunger 193 to move downward, against the force of the follow-up spring 194, to the lowermost position where the lower end of the plunger 193 contacts the housing's bottom 192*a*. When current supply to the coil 195 is stopped, on the other hand, electromagnetic attraction disappears and the plunger 193 moves upward with the force of the follow-up spring 194.

In the upward movement of the plunger 193, the stopper 105 contacts the lower end of the pin body 104 after which the pin body 104 and the pressure sensitive rod 162 move upward together with the plunger 193. When the drain-side valve body 162*a* contacts the top wall of the drain-side valve chamber 108 and the plunger 193 comes to the uppermost position, further movement of the pin body 104, the pressure sensitive rod 162 and the plunger 193 is restricted. At this time, the port 110 of the drain-side control valve portion is substantially closed, and the valve body 164 of the inlet-side control valve portion is pushed up by the upper end 162*b* of the pressure sensitive rod 162. This forcibly widening the opening size of the inlet-side control valve portion. As apparent from the above, the displacement control valve 190 serves as opening/closing valve means, the opening size of which can be adjusted by external control means.

When the start switch 58 for the air-conditioning system is on, the control computer 55 keeps supplying current to the coil 195 of the electromagnet 191. At this time, electromagnetic attraction generated on the coil 195 causes the plunger 193 to move downward to the lowermost position against the force of the follow-up spring 194. Under this situation, the control valve 190, like the control valve 160 in FIG. 16, serves as an interlocked inlet-side and drain-side internal control valve. That is, the valve opening sizes of the drain-side control valve portion and the inlet-side control valve portion of the control valve 190 are determined mainly by the suction pressure Ps, the discharge pressure Pd and the balance of the forces of the set spring 106, and the springs 109 and 165. Then, the crank pressure Pc is properly adjusted by the internal control of the interlocked control valve, thereby automatically controlling the angle of the swash plate and, consequently, the discharge displacement of the compressor (the normal operation under the inlet-side and drain-side internal control).

When the start switch 58 is switched off, the control computer 55 stops supplying current to the coil 195 of the electromagnet 191. Consequently, the electromagnetic attraction on the coil 195 vanishes and the plunger 193, the stopper 105, the pin body 104 and the pressure sensitive rod 162 move upward due to the force of the follow-up spring 194. As the lower end 162*a* of the pressure sensitive rod 162 contacts the top wall of the drain-side valve chamber 108, the upward movement stops. When the plunger 193 is shifted to the uppermost position, the drain-side control valve portion of the control valve 190 goes to a closed state (valve opening size of zero). This blocks gas discharge to the suction chamber 31 from the crank chamber 5 via the bleed passage 40, and supplies a large amount of refrigerant gas to the crank chamber 5 from the discharge chamber 32 via the gas supply passage 38 with the inlet-side control valve portion the opening size of which has been widened forcibly. As a result, the crank pressure Pc rises to set the angle of the swash plate to the minimum inclination angle (near 0°), so that the compressor goes to the minimum displacement operation, thus minimizing the load on the engine 14. When the start switch 58 is switched on again, current supply to the coil 195 of the electromagnet 191 restarts, causing the compressor to return to a normal operating condition.

According to the tenth embodiment as per the ninth embodiment, the spring force of the follow-up spring 194 can be set slightly lower than the differential pressure (Pc−Ps) in such a manner that when the differential pressure (Pc−Ps) acting on the pressure sensitive rod 162 as the drain-side valve body exceeds a predetermined maximum allowance, the force in the valve opening direction by the differential pressure (Pc−Ps) becomes stronger than the force in the valve closing direction by the spring force of the follow-up spring 194. The maximum allowance of the differential pressure (Pc−Ps) can be determined properly in consideration of the withstand pressure limit of the shaft seal unit of the compressor and the maximum value of the differential pressure (Pc−Ps) needed for the variable displacement control of the compressor. Thus, setting the spring force of the follow-up spring 194 slightly lower can allow the drain-side control valve portion of the control valve 190 in the closed state to work as a kind of a relief valve. In this case, therefore, the crank pressure Pc which is likely to gradually rise in response to the closing of the bleed passage 40 is prevented from rising excessively above the withstand pressure limit of the shaft seal unit.

The tenth embodiment has the following advantages.

The interlocked inlet-side control and drain-side control type control valve 190 is located between the gas supply passage 38 and the bleed passage 40, and this control valve 190 is designed in such a way that the drain-side control valve portion can be closed forcibly and the inlet-side control valve portion can be opened forcibly both under external current supply control. By controlling the current supply to the coil 195 of the electromagnet 191 in the above-described manner, therefore, it is possible to switch the operational state of the compressor between the normal operation state established by the typical interlocked inlet-side and drain-side internal control and the minimum displacement operation state established by the forced increase in crank pressure Pc. This crank pressure control apparatus is thus well suitable for use in the variable displacement type swash plate compressor in FIG. 1, which can set the inclination angle of the swash plate to the vicinity of 0°.

The spring force of the follow-up spring 194 can be set in such a way that when the differential pressure (Pc−Ps) acting on the drain-side valve body 162*a* rises above the predetermined maximum allowance, the force in the valve opening direction by the differential pressure (Pc−Ps) becomes stronger than the force in the valve closing direction by the spring force of the follow-up spring 194. Such setting can allow the control valve 190 whose drain-side control valve portion is in the closed state to work as a relief valve for preventing the crank pressure Pc from rising excessively. Even after the compressor is shifted to minimum displacement operation by closing the bleed passage 40, therefore, it is possible to prevent the crank pressure Pc from rising to a level that would damage the compressor.

Because the drain-side control valve portion in the bleed passage 40 is closed when the start switch 58 is switched off, lubricating oil cannot flow from the crank chamber 5 with the refrigerant gas during minimum displacement operation, which improves lubrication of internal parts.

Eleventh To Thirteenth Embodiments

The eleventh to thirteenth embodiments have a special control valve of a variable set-pressure type located in the bleed passage that connects the crank chamber and the suction chamber and provides the control valve with a function of selectively sealing the bleed passage. Sealing the bleed passage with the control valve allows the variable displacement type swash plate compressor to reliably and swiftly shift to minimum displacement operation from normal operation. Each of the eleventh to thirteenth embodiments will be discussed below.

Eleventh Embodiment

Figure 20:
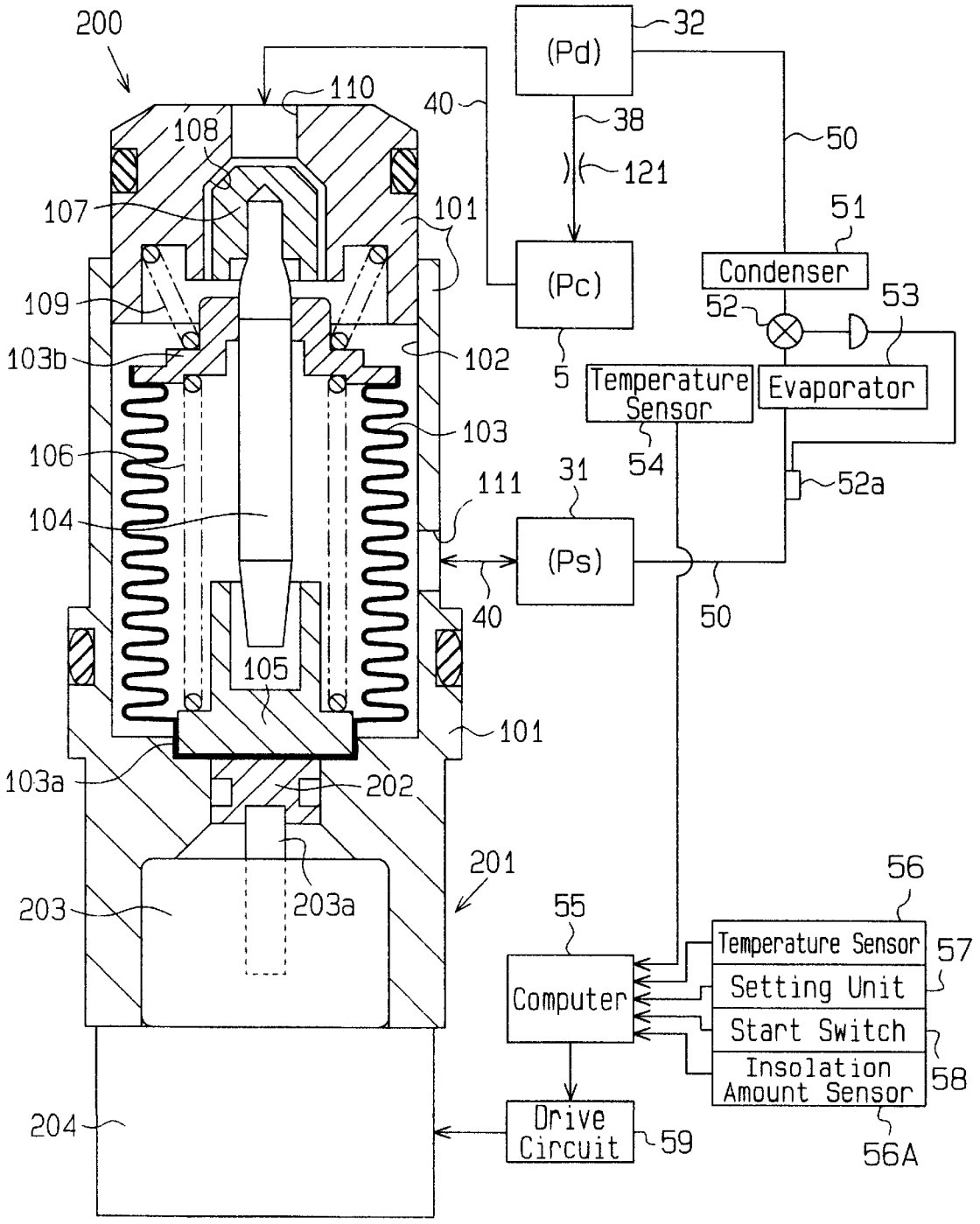
FIG. 20 is a diagram schematically illustrating a crank pressure control apparatus, including a cross sectional view of a displacement control valve.

The crank pressure control apparatus of the eleventh embodiment shown in FIG. 20 has the gas supply passage 38 for connecting the discharge chamber 32 to the crank chamber 5 and the bleed passage 40 for connecting the crank chamber 5 to the suction chamber 31. Located in the gas supply passage 38 is the fixed restrictor 121, which is the same as the one shown in FIG. 11. The supply of highly-pressurized refrigerant gas to the crank chamber 5 from the discharge chamber 32 passes through this fixed restrictor 121. A displacement control valve 200, which is discussed below, is provided in the bleed passage 40. The crank pressure control apparatus according to the eleventh embodiment is like the crank pressure control apparatus of the second embodiment (FIG. 11) except that the electromagnetic opening/closing valve 120 of FIG. 11 has been removed and the control valve 100 of FIG. 11 has been replaced with the control valve 200. The eleventh embodiment is also like to the ninth embodiment (FIG. 18) except that the control valve 180 of FIG. 18 has been replaced with the control valve 200.

The control valve 200 shown in FIG. 20 is a drain-side control valve of the internal control type, in the sense that it can automatically adjust the valve opening size according to a change in suction pressure Ps, and is a drain-side control valve of the external control type, in the sense that the set pressure Pset can be altered under external control. The control valve 200 is like the internal control valve 100 in FIG. 11 with a set-pressure changing unit attached to the bottom.

The pressure sensitive chamber 102 and the valve chamber (drain-side valve chamber) 108 are defined in the valve housing 101 of the control valve 200 as in the internal control valve 100 in FIG. 11. Those chambers 102 and 108, together with the ports 110 and 111 formed in the valve housing 101, form part of the bleed passage 40. The bellows 103, the pin body 104, the stopper 105, the set spring 106, the valve body 107 and the spring 109 are provided in the valve housing 101 and form a pressure sensing mechanism, which determines the set pressure Pset of the control valve 200 and actuates the valve body 107 in accordance with a change in suction pressure Ps.

The control valve 200 further has a set-pressure changing unit 201 attached to the bottom of the valve housing 101. The set-pressure changing unit 201 includes an axially movable body 202 provided at the lower portion of the valve housing 101, a reciprocating mechanism 203, and a motor 204.

The stopper 105 is secured to the upper portion of the movable body 202 with the fixed end 103*a* of the bellows 103 in between, so that the movable body 202, the bellow's fixed end 103*a* and the stopper 105 move together. The energization of the motor 204, which can rotate in the forward as well as reverse directions (e.g., a stepping motor), is controlled by the control computer 55 through the drive circuit 59.

The reciprocating mechanism 203, located between the movable body 202 and the motor 204, functionally couples them. The reciprocating mechanism 203 is constructed by, for example, a screw mechanism, and has a drive shaft 203*a* which reciprocates in the axial direction (vertical direction) of the control valve as the output shaft of the motor 204 rotates in the forward and reverse directions. In other words, the reciprocating mechanism 203 is a drive conversion mechanism for converting the rotational motion of the output shaft (not shown) of the motor 204 to a linear motion of the drive shaft 203*a*. The distal end of the drive shaft 203*a* of the reciprocating mechanism is coupled to the movable body 202, so that the movable body 202 and the stopper 105 also reciprocate in the axial direction in accordance with the movement of the drive shaft 203*a*.

FIG. 20 shows a part (the bottom) of the stopper 105 abutting on the valve housing 101, and the movable body 202 and the stopper 105 being at the lowermost position where no further upper or lower movement is possible. When the movable body 202 is moved upward from this situation, the stopper 105 moves away from the valve housing 101 and approaches the pin body 104. When the stopper 105 contacts the lower end of the pin body 104 during upward movement of the movable body 202, the pin body 104 and the valve body 107 move upward together with the movable body 202 thereafter. When the valve body 107 contacts the top wall of the valve chamber 108 and the movable body 202 is shifted to the uppermost position, further upward movement of the pin body 104, the valve body 107 and the movable body 202 is restricted, closing the port 110. When the rotation of the motor 204 is reversed, the movable body 202 moves toward the lowermost position from the uppermost one through the opposite process to the above-described one.

The set pressure Pset of this control valve 200 can be changed by moving the movable body 202 to anywhere between the uppermost position and the lowermost position. The displacement control valve 200 also serves as opening/closing valve means, the opening size of which can be adjusted by external control means.

When the start switch 58 for the air-conditioning system is on, the control computer 55 occasionally computes the optimal set pressure Pset of the control valve 200 based on input information from, for example, the temperature sensor 54, the passenger compartment temperature sensor 56, the insolation amount sensor 56A and the passenger compartment temperature setting unit 57. Then, the control computer 55 performs energization control on the motor 204 to set the pressure of the control valve 200 to the computed set pressure Pset, thereby shifting the movable body 202 to anywhere between the uppermost position and the lowermost position. Under this situation, the control valve 200, like the control valve 100 in FIG. 11, serves as the drain-side internal control valve. Then, the control computer 55 executes internal control to properly adjust the crank pressure Pc by means of the drain-side control valve 200, thereby automatically controlling the angle of the swash plate and, consequently, the discharge displacement of the compressor (the normal operation by the drain-side internal control).

When the start switch 58 is switched off, the control computer 55 implements energization control on the motor 204 to shift the movable body 202, the stopper 105, the pin body 104 and the valve body 107 to the uppermost position, regardless of the computation result on the set pressure Pset. Then, the control computer 55 causes the valve body 107 to close the port 110 by closing the control valve 200 (zero valve opening size) to block gas discharge into the suction chamber 31 from the crank chamber 5 via the bleed passage 40. As a result, the crank pressure Pc rises to set the angle of the swash plate to the minimum inclination angle (near 0°), so that the compressor goes to the minimum displacement operation, thus minimizing the load on the engine 14.

When the start switch 58 is switched on again later, energization control on the motor 204 moves the movable body 202 back to the initial position, and the drain-side internal control with the computed set pressure Pset restarts, causing the compressor to return to a normal operating condition.

The eleventh embodiment has the following advantages.

The fixed restrictor 121 is provided in the gas supply passage 38 to be able to always supply a predetermined amount of refrigerant gas to the crank chamber 5 from the discharge chamber 32, and the variable set-pressure valve of the drain-side control type located in the bleed passage 40 is provided with the function of selectively sealing the bleed passage. That is, the control valve 200 is designed in such a way that it can be closed under external control. Through the above-described energization control on the motor 204, therefore, it is possible to switch the operational state of the compressor between the normal operation state established by the typical drain-side internal control and the minimum displacement operation state established by the forced increase in crank pressure Pc. This crank pressure control apparatus is thus well suitable for use in the variable displacement type swash plate compressor in FIG. 1, which can set the inclination angle of the swash plate to the vicinity of 0°.

The control valve 200 equipped with the set-pressure changing unit 201 has both the ability to change the set pressure and the valve opening/closing ability to lead the compressor to the minimum displacement operation state, in cooperation of the control computer 55 and the drive circuit 59. The use of this control valve 200 can therefore simplify the crank pressure control apparatus of the compressor.

As the control valve 200 located in the bleed passage 40 is closed when the start switch 58 is switched off, it is possible to inhibit the lubricating oil from flowing out of the crank chamber 5 together with the refrigerant gas in the minimum displacement operation, which would otherwise impair lubrication of the internal mechanisms of the compressor.

Twelfth Embodiment

Figure 21:
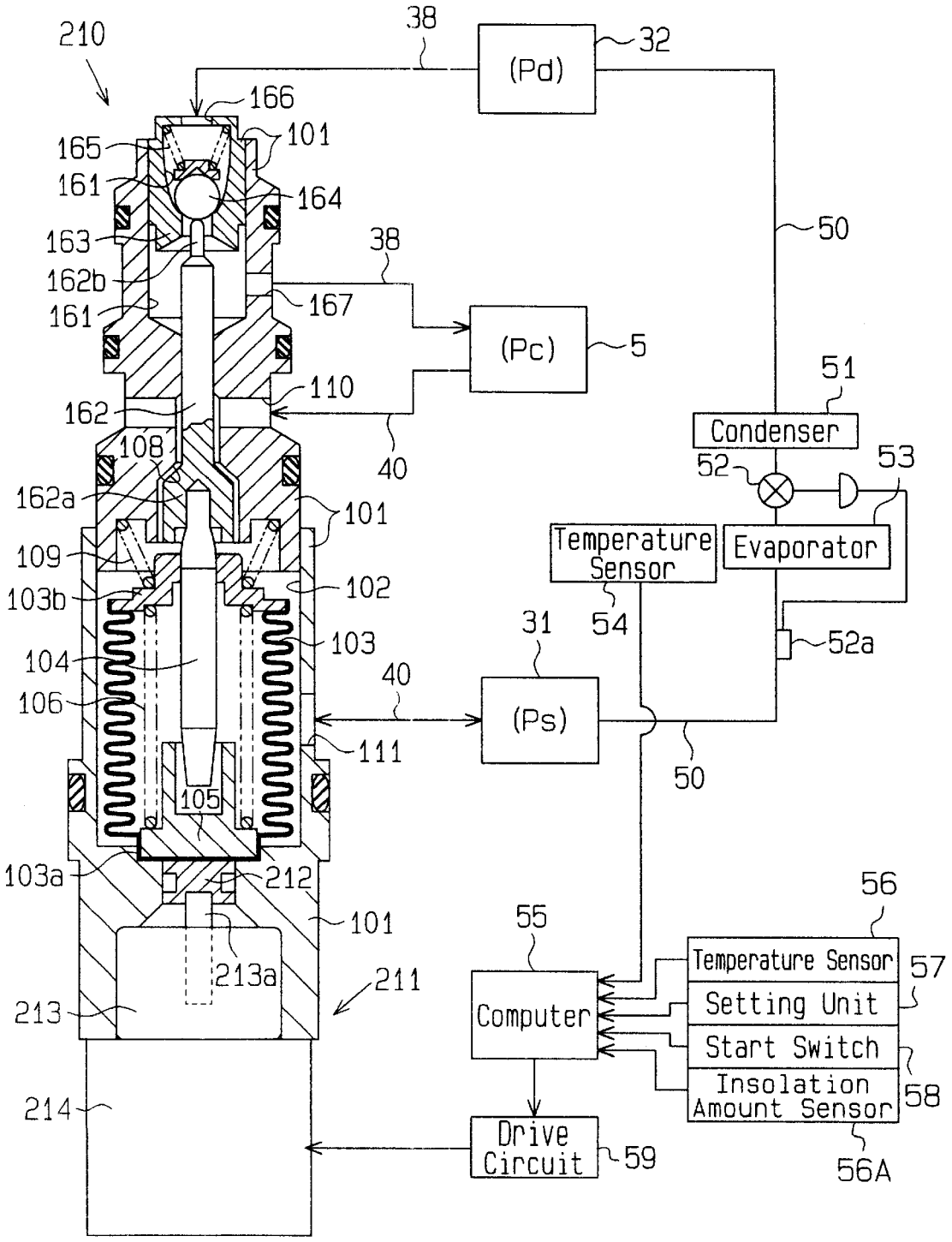
FIG. 21 is a diagram schematically illustrating a crank pressure control apparatus, including a cross sectional view of a displacement control valve.

The crank pressure control apparatus of the twelfth embodiment shown in FIG. 21 has the gas supply passage 38 for connecting the discharge chamber 32 to the crank chamber 5 in the compressor (see FIG. 1) and the bleed passage 40 for connecting the crank chamber 5 to the suction chamber 31. Further, an interlocked inlet-side control and drain-side control type displacement control valve 210 to be discussed below is located between the gas supply passage 38 and the bleed passage 40. The crank pressure control apparatus according to the twelfth embodiment is like the crank pressure control apparatus of the eleventh embodiment (FIG. 20) except that the fixed restrictor 121 has been replaced with the inlet-side control valve portion of the interlocked type control valve 210. The twelfth embodiment is also like the tenth embodiment (FIG. 19) except that the control valve 190 has been replaced with the control valve 210.

The control valve 210 shown in FIG. 21 is a control valve of an interlocked inlet-side control and drain-side control type in the sense that it can automatically adjust the valve opening size according to a change in suction pressure Ps, and is a control valve of the external control type in the sense that the set pressure Pset can be altered under external control. The control valve 210 is like the internal control valve 160 in FIG. 16 except that a set-pressure changing unit has been attached to the bottom of the control valve 160.

Like the internal control valve 160 in FIG. 16, the control valve 210 has the pressure sensitive chamber 102 and drain-side valve chamber 108 defined in the lower area of the valve housing 101 and the inlet-side valve chamber 161 defined in the upper area of the valve housing 101. Those chambers 102 and 108, together with the ports 110 and 111 formed in the valve housing 101, form part of the bleed passage 40. The inlet-side valve chamber 161, together with the ports 166 and 167 formed in the valve housing 101, forms part of the gas supply passage 38. The pressure sensitive rod 162 is formed in the center area of the valve housing 101 to slide in the axial direction of the control valve.

The bellows 103, the pin body 104, the stopper 105, the set spring 106, the spring 109 and the lower end 162*a* (serving as a drain-side valve body) of the pressure sensitive rod 162 are provided in the pressure sensitive chamber 102 and the drain-side valve chamber 108, and form a drain-side control valve portion of the control valve 210. The opening size of this drain-side control valve portion (i.e., the opening size of the bleed passage 40) is adjusted according to the location of the drain-side valve body 162*a*. The upper end 162*b* of the pressure sensitive rod 162, the valve seat 163, the inlet-side valve body 164 and the spring 165 are provided in the inlet-side valve chamber 161, and form the inlet-side control valve portion of the control valve 210. The opening size of this inlet-side control valve portion (i.e., the opening size of the gas supply passage 38) is adjusted according to the location of the inlet-side valve body 164. The bellows 103, the pin body 104, the stopper 105, the set spring 106, the spring 109, the pressure sensitive rod 162 and the spring 165 form a pressure sensing mechanism which determines the set pressure Pset of the control valve 210 and actuates the pressure sensitive rod 162 (serving as the drain-side valve body) and the inlet-side valve body 164 in accordance with a change in suction pressure Ps. As apparent from the above, the drain-side control valve portion and inlet-side control valve portion of the control valve 210 are interlocked with each other by means of the common pressure sensing mechanism.

The control valve 210 further has a set-pressure changing unit 211 attached to the bottom of the valve housing 101. The set-pressure changing unit 211 includes a movable body 212 provided at the lower portion of the valve housing 101 to move in the axial direction, a reciprocating mechanism 213, and a motor 214.

The stopper 105 is secured to the upper portion of the movable body 212 with the fixed end 103*a* of the bellows 103 in between, so that the movable body 212, the bellow's fixed end 103*a* and the stopper 105 can move together. Since the reciprocating mechanism 213 and the motor 214 are the same as the reciprocating mechanism 203 and the motor 204 in FIG. 20, their redundant description will not be given. The output shaft of the motor 214 rotates in the forward and reverse directions under the energization control of the control computer 55 by the drive circuit 59. In accordance with the rotation of the motor's output shaft, the drive shaft, 213*a*, of the reciprocating mechanism 213 reciprocates in the axial direction of the control valve. As the distal end of the drive shaft 213*a* is coupled to the movable body 212, the movable body 212 and the stopper 105 also reciprocate in the axial direction in accordance with the movement of the drive shaft 213*a*.

FIG. 21 illustrates a part (the bottom) of the stopper 105 abutting on the valve housing 101, and the movable body 212 and the stopper 105 being at the lowermost position where no further lower movement is possible. When the movable body 212 is moved upward from this position, the stopper 105 moves away from the valve housing 101 and approaches the pin body 104. When the stopper 105 contacts the lower end of the pin body 104 during the upward movement of the movable body 212, the pin body 104 and the pressure sensitive rod 162 move upward together with the movable body 212 thereafter. When the rod's lower end (drain-side valve body) 162*a* contacts the top wall of the valve chamber 108 and the movable body 212 is shifted to the uppermost position, further upward movement of the pin body 104, the pressure sensitive rod 162 and the movable body 212 is restricted, closing the port 110. When the rotation of the motor 214 is reversed, the movable body 212 moves toward the lowermost position from the uppermost one in a manner reverse to that just described.

The set pressure Pset of this control valve 210 can be changed by moving the movable body 212 to a position anywhere between the uppermost position and the lowermost position. The displacement control valve 210 also serves as opening/closing valve means, the opening size of which can be adjusted by external control means.

When the start switch 58 for the air-conditioning system is on, the control computer 55 occasionally computes the optimal set pressure Pset of the control valve 210 based on input information from, for example, the temperature sensor 54, the passenger compartment temperature sensor 56, the insolation amount sensor 56A and the passenger compartment temperature setting unit 57. Then, the control computer 55 performs energization control on the motor 214 to set the pressure of the control valve 210 to the computed set pressure Pset, thereby shifting the movable body 212 anywhere between the uppermost position and the lowermost position. In this situation, the control valve 210, like the control valve 160 in FIG. 16, serves as the internal control valve of an interlocked inlet-side control and drain-side control type. Then, the control computer 55 executes internal control to properly adjust the crank pressure Pc by means of the interlocked type control valve 210, thereby automatically controlling the angle of the swash plate and, consequently, the discharge displacement of the compressor (normal operation established by the internal control of the interlocked inlet-side control and drain-side control type).

When the start switch 58 is switched off, the control computer 55 performs energization control on the motor 214 to shift the movable body 212, the stopper 105, the pin body 104 and the pressure sensitive rod 162 to the uppermost position, regardless of the computation result of the set pressure Pset. As the movable body 212 is moved to the uppermost position, the port 110 is closed by the drain-side valve body 162*a*, and the drain-side control valve portion of the control valve 210 is closed (valve opening size of zero). Consequently, gas discharge into the suction chamber 31 from the crank chamber 5 via the bleed passage 40 is blocked, and the inlet-side valve body 164 is pushed up by the rod's upper end 162*b*, forcibly widening the opening size of the inlet-side control valve portion. This permits a large amount of refrigerant gas to be supplied to the crank chamber 5 from the discharge chamber 32 via the gas supply passage 38. As a result, the crank pressure Pc rises to change the angle of the swash plate to the minimum inclination angle (near 0°), so that the compressor shifts to minimum displacement operation, thus minimizing the load on the engine 14.

When the start switch 58 is switched on again later, energization control on the motor 214 moves the movable body 212 back to the initial position, and the internal control with the computed set pressure Pset restarts, causing the compressor to return to a normal operating condition.

The twelfth embodiment has the following advantages.

The control valve 210 of the interlocked inlet-side control and drain-side control type and the variable set-pressure type is located between the gas supply passage 38 and the bleed passage 40, and the control valve 210 is provided with the ability to selectively and forcibly open the gas supply passage and the ability to selectively seal the bleed passage. That is, the control valve 210 is designed to be able to force its drain-side control valve portion into the closed state and force its inlet-side control valve portion into the open state under external control. Through the above-described energization control on the motor 214, therefore, it is possible to switch the operational state of the compressor between the normal operation state established by the typical interlocked inlet-side and drain-side internal control and the minimum displacement operation state established by the forced increase in crank pressure Pc. This crank pressure control apparatus is thus well suitable for use in the variable displacement type swash plate compressor in FIG. 1, which can set the inclination angle of the swash plate to the vicinity of 0°.

The control valve 210 equipped with the set-pressure changing unit 211 has both the ability of changing the set pressure and the ability of enforcing valve opening/closing to thereby lead the compressor to the minimum displacement operation state, in cooperation of the control computer 55 and the drive circuit 59. The use of this control valve 210 can therefore simplify the crank pressure control apparatus of the compressor.

As the drain-side control valve portion of the control valve 210 located in the bleed passage 40 is closed when the start switch 58 is switched off, it is possible to inhibit the lubricating oil from flowing out of the crank chamber 5 together with the refrigerant gas in the minimum displacement operation, which would otherwise impair lubrication of the internal mechanisms of the compressor.

Thirteenth Embodiment

Figure 22:
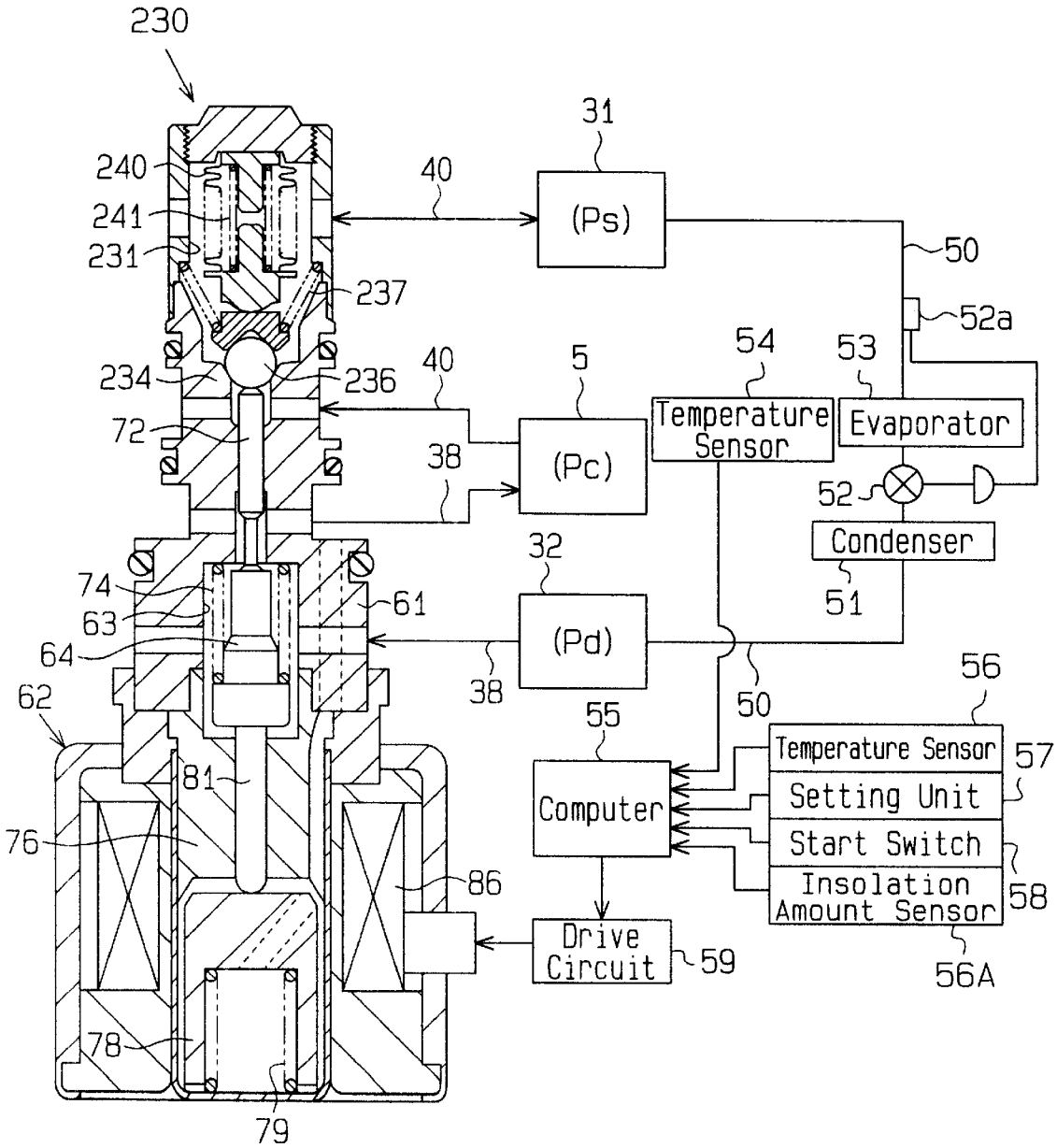
FIG. 22 is a diagram schematically illustrating a crank pressure control apparatus, including a cross sectional view of a displacement control valve.
Figure 23:
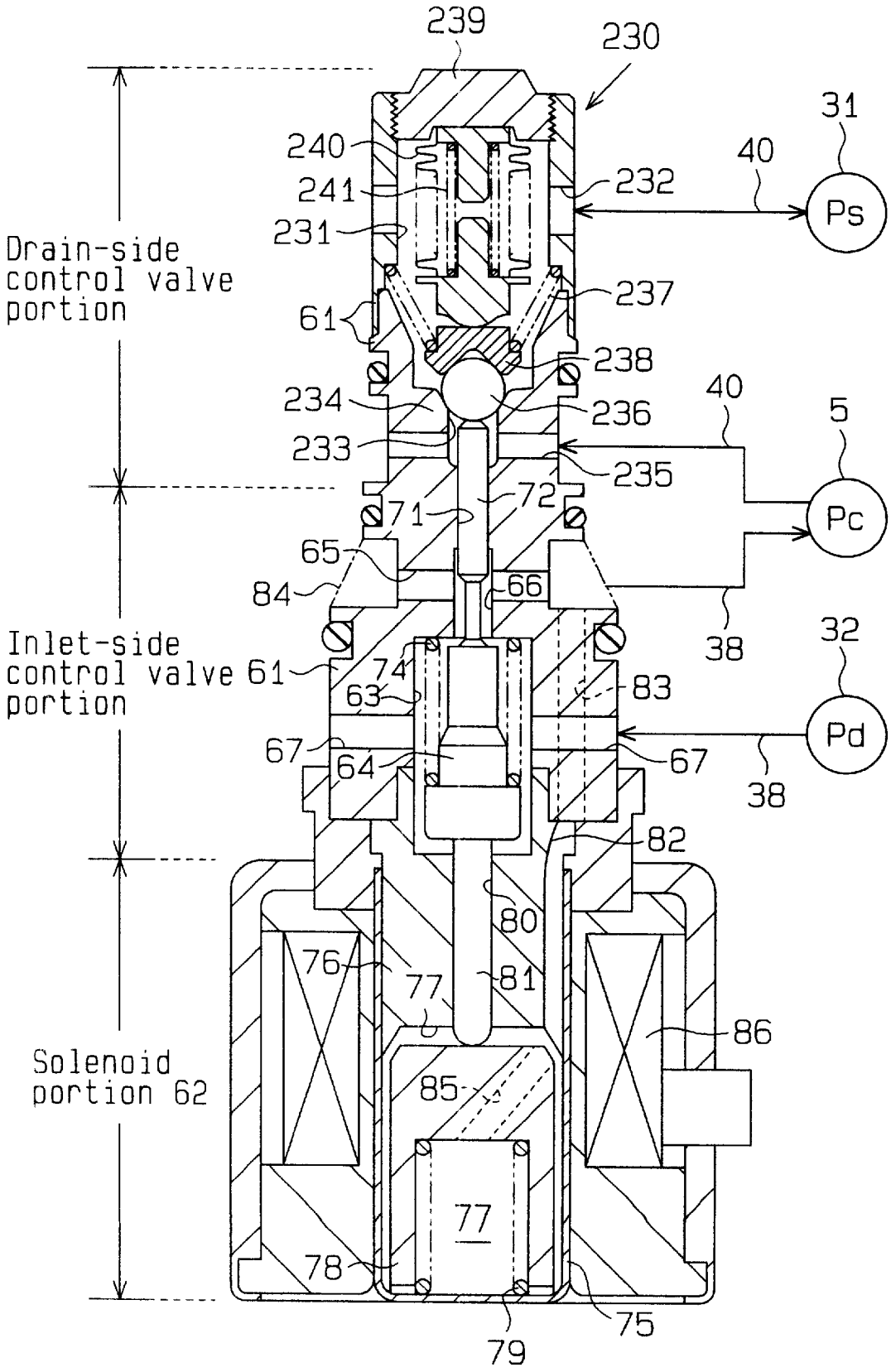
FIG. 23 is a cross-sectional view of the displacement control valve in FIG. 22.

The crank pressure control apparatus of the thirteenth embodiment shown in FIGS. 22 and 23 has the gas supply passage 38 for connecting the discharge chamber 32 to the crank chamber 5 in the compressor (see FIG. 1) and the bleed passage 40 for connecting the crank chamber 5 to the suction chamber 31. Further, an interlocked inlet-side control and drain-side control type displacement control valve 230 to be discussed below is located between the gas supply passage 38 and the bleed passage 40. The crank pressure control apparatus according to the thirteenth embodiment is like the crank pressure control apparatus of the twelfth embodiment (FIG. 21) except that the control valve 210 has been replaced with the control valve 230.

The control valve 230 shown in FIG. 22 is a control valve of an interlocked inlet-side control and drain-side control type in the sense that it can automatically adjust the valve opening size according to a change in suction pressure Ps, and is a control valve of the external control type in the sense that the set pressure Pset can be altered under external control. FIG. 23 is an enlarged cross-sectional view of the control valve 230. As apparent from comparison between FIG. 23 and FIG. 3, the control valve 230 is the inlet-side control valve 60 in FIG. 3 redesigned into an interlocked type by modifying the design of the upper half of the control valve 60.

As shown in FIG. 23, the control valve 230 has the valve housing 61 and the solenoid portion 62, which are connected together near the center of the control valve 230. The solenoid portion 62 serves as the set-pressure changing unit 211 of the control valve 230. The valve housing 61 is separated into an upper half portion serving as a drain-side control valve portion and a lower half portion serving as an inlet-side control valve portion.

The inlet-side valve chamber 63 is defined in the portion of the valve housing 61 which forms the inlet-side control valve portion. This valve chamber 63 is connected to the discharge chamber 32 via the valve chamber port 67, formed in the side wall of the valve chamber 63, and the upstream gas supply passage 38. The valve hole 66 extending in the axial direction of the control valve 230 is formed in the upper portion of the valve chamber 63, and the port 65 perpendicularly intersecting the valve hole 66 is formed in the valve housing 61 above the valve chamber 63. The port 65 is connected to the crank chamber 5 via the downstream gas supply passage 38. The valve chamber port 67, the inlet-side valve chamber 63, the valve hole 66 and the port 65 form part of the gas supply passage 38.

The inlet-side valve body 64 is retained in the inlet-side valve chamber 63 to move in the axial direction of the control valve. In other words, the inlet-side valve chamber 64 is so provided as to be able to move close to and away from the valve hole 66 to change the flow area of the gas supply passage 38. The release spring 74 is retained in the valve chamber 63. This release spring 74 urges the valve body 64 in the direction of moving away from the valve hole 66 (downward) to make the opening size of the inlet-side control valve portion (the flow area of the gas supply passage 38) larger as much as possible. The inlet-side valve body 64 adjusts the opening size of the inlet-side control valve portion of the control valve 230 in accordance with its position in the valve chamber 63.

A drain-side valve chamber 231 is defined in the portion of the valve housing 61 which forms the drain-side control valve portion. This valve chamber 231 is connected to the suction chamber 31 via a port 232, formed in the side wall of the valve chamber 231, and the downstream bleed passage 40. The downstream bleed passage 40 serves as a pressure sensing passage, and the suction pressure Ps acts on the interior of the drain-side valve chamber 231 via the passage 40. A valve seat 234 which defines a valve hole 233 is provided at the lower portion of the valve chamber 231. The valve hole 233 extends in the axial direction of the control valve 230. A port 235 perpendicularly intersecting the valve hole 233 is formed in the valve housing 61, and is connected to the crank chamber 5 via the upstream bleed passage 40. The port 235, the valve hole 233, the drain-side valve chamber 231 and the port 232 form part of the bleed passage 40.

A drain-side valve body 236 is retained in the drain-side valve chamber 231 to move in the axial direction of the control valve. As the valve body 236 moves, it can contact or move away from the valve seat 234. The drain-side valve body 236 is preferably spherical. When the drain-side valve body 236 sits on the valve seat 234, the valve body 236 closes the valve hole 233, thus blocking the flow through the bleed passage 40. A closing valve spring 237 is located in the drain-side valve chamber 231. The closing valve spring 237 has one end (upper end) fastened to the inner peripheral portion of the valve housing 61, and the other end (lower end) fastened to an intervening member 238 on the valve body 236. The closing valve spring 237 with the intervening member 238 always urges the valve body 236 in the direction of sitting on the valve seat 234 (in the direction of closing the valve hole 233).

A bellows 240 is provided inside the drain-side valve chamber 231. An adjuster 239 is attached to the upper portion of the valve housing 61 by pressure, and the upper end (fixed end) of the bellows 240 is secured to the adjuster 239. The lower end of the bellows 240 is a movable end. The interior of the bellows 240 is set to a vacuum state or a pressure-reduced state, and an extensible spring 241 is located in the bellows 240. This extensible spring 241 urges the movable end of the bellows 240 in the stretching direction. The bellows 240 and the extensible spring 241 form a pressure sensitive member.

The suction pressure Ps acting inside the drain-side valve chamber 231 acts in the direction of contracting the bellows 240. In accordance with the balance of the force of the extensible spring 241 and the suction pressure Ps, therefore, the movable end of the bellows 240 pushes the valve body 236 in the valve closing direction by the intervening member 238 or moves away from the intervening member 238 to disengage the functional coupling to the valve body 236. The drain-side valve body 236 adjusts the opening size of the drain-side control valve portion of the control valve 230 (or the opening size of the bleed passage 40) according to its position in the valve chamber 231.

The guide hole 71 is formed perpendicularly in the center of the valve housing 61 at the boundary between the drain-side control valve portion and the inlet-side control valve portion, and the pressure sensitive rod 72 is inserted in this guide hole 71 in a slidable manner. The lower end of the pressure sensitive rod 72 is fixed to the upper end of the inlet-side valve body through the valve hole 66. The diameter of the lower end of the pressure sensitive rod 72 is made smaller than the inside diameter of the valve hole 66 to secure the flow of the refrigerant gas in the valve hole 66. The upper end of the pressure sensitive 72 can come in contact with or move away from the bottom of the drain-side valve body 236 in accordance with the movement of the rod 72.

The solenoid portion 62 which occupies the lower portion of the control valve 230 has substantially the same structure as the solenoid portion 62 of the control valve 60 shown in FIG. 3. Specifically, the fixed iron core 76 is fitted in the upper portion of the retainer cylinder 75 with a bottom, thereby defining the solenoid chamber 77 in the retainer cylinder 75. The movable iron core 78 as a plunger is retained in the solenoid chamber 77 in a perpendicularly reciprocative manner. The movable iron core 78 has an approximately cylindrical shape with a lid. The guide hole 80 is formed perpendicularly in the center of the fixed iron core 76, and the solenoid rod 81 is slidably fitted in this guide hole 80. The upper end of the solenoid rod 81 is integrated with the valve body 64. The pressure sensitive rod 72, the inlet-side valve body 64 and the solenoid rod 81 thus form a single integrated functional member (72, 64, 81).

The lower end portion of the solenoid rod 81 (the end portion on that side of the movable iron core 78) contacts the top surface of the movable iron core 78, and the follow-up spring 79 is located between the movable iron core 78 and the bottom of the retainer cylinder 75. The follow-up spring 79 normally urges the movable iron core 78 upward (toward the fixed iron core 76). Therefore, the movable iron core 78 and the valve body 64 are coupled by the solenoid rod 81. The functional member which is comprised of the rod 72, the valve body 64 and the rod 81, is held movable vertically between the movable iron core 78 which is urged upward by at least the follow-up spring 79 and the drain-side valve body 236 which is urged downward at least by the closing valve spring 237. This functional member (72, 64, 81) serves as means for permitting the functional coupling of the drain-side valve body 236 and inlet-side valve body 64 at least to the movable iron core (plunger) 78 keeping the interlocking of those valve bodies 236 and 64.

The solenoid chamber 77 communicates with the port 65 via the communication groove 82, formed in the side wall of the fixed iron core 76, the communication hole 83, bored through in the valve housing 61, and the annular small chamber 84, which is formed between the control valve 230 and the wall of the rear housing 4 at the time of assembling this control valve 230 into the compressor. In other words, the solenoid chamber 77 is placed under the same pressure environment as the valve hole 66 (i.e., under the crank pressure Pc). The hole 85 is bored in the cylindrical movable iron core 78 with a top, and the pressures inside and outside the movable iron core 78 in the solenoid chamber 77 are equalized via this hole 85.

In the solenoid portion 62, the coil 86 is wound around the fixed iron core 76 and the movable iron core 78 over an area partly covering the iron cores 76 and 78. The drive circuit 59 supplies a predetermined current to this coil 86 based on a command from the control computer 55. The coil 86 produces electromagnetic force of the strength corresponding to the supplied current. This generates upward electromagnetic force such that the fixed iron core 76 attracts the movable iron core 78 due to the electromagnetic force, moving the solenoid rod 81 upward.

The release spring 74 in the inlet-side valve chamber 63 urges the functional member (72, 64, 81) downward. This downward force of the release spring 74 is set considerably greater than the upward force of the follow-up spring 79. Without the upward electromagnetic force, the release spring 74 moves the functional member (72, 64, 81) at the lowermost position, lifting of the drain-side valve body 236 from below by the pressure sensitive rod 72 does not occur. As a result, while the inlet-side control valve portion is opened to the maximum amount, the closing valve spring 237 causes the drain-side valve body 236 to close the valve hole 233, thus closing the drain-side control valve portion. In this sense, the displacement control valve 230 serves as opening/closing valve means, the opening size of which can be adjusted by external control means.

When current is supplied to the coil 86 and the solenoid portion 62 generates upward electromagnetic force, the entire functional member (72, 64, 81) is moved up, establishing the functional coupling of the functional member to the drain-side valve body 236 and bellows 240. This provides an interlocked relation between the inlet-side control valve portion and the drain-side control valve portion. At this time, the set pressure Pset of the interlocked control valve 230 is determined based on the relationship between the spring forces of the springs 79, 74, 237 and 241 and the electromagnetic force. Variable control on the set pressure Pset of the control valve 230 is implemented externally by adjusting the electromagnetic force externally.

As long as the movable end of the bellows 240 contacts the intervening member 238, the expansion/contraction action of the bellows 240 affects the positioning of the valve body 236 and the function member (72, 64, 81). In this sense, the bellows 240, the extensible spring 241, the intervening member 238, the closing valve spring 237, the valve body 236 and the pressure sensitive rod 72 form a pressure sensitive mechanism which transmits a change in suction pressure Ps to the drain-side valve body 236 and the inlet-side valve body 64 and actuates both valve bodies 236 and 64 in accordance with the change in suction pressure Ps. Under given conditions, the drain-side control valve portion and the inlet-side control valve portion of the control valve 230 are interlocked with each other by the common pressure sensitive mechanism.

When the start switch 58 for the air-conditioning system is on, the control computer 55 occasionally computes the optimal set pressure Pset of the control valve 230 based on input information from, for example, the temperature sensor 54, the passenger compartment temperature sensor 56, the insolation amount sensor 56A and the passenger compartment temperature setting unit 57, and then controls the amount of current to be supplied to the coil 86 to set the pressure of the control valve 230 to the computed set pressure Pset. Accordingly, the aforementioned upward electromagnetic force is adjusted, positioning the inlet-side valve body 64 and the drain-side valve body 236.

Under this situation, the drain-side valve body 236 and the function member (72, 64, 81) are coupled to the bellows 240, and the expansion/contraction action of the bellows 240 corresponding to the change in suction pressure Ps affects the positioning of both valve bodies 64 and 236. In other words, the control valve 230 works as an interlocked inlet-side and drain-side internal control valve which responds to the suction pressure Ps under the circumstance where the set pressure Pset is changeable by external control. The valve opening sizes of the inlet-side control valve portion and the drain-side control valve portion are finely adjusted by the cooperation of the external control and internal control. In this manner, the crank pressure Pc is adjusted and the angle of the swash plate and, consequently, the discharge displacement of the compressor are automatically controlled (the normal operation established by the interlocked inlet-side control and drain-side control).

At the time the control computer 55 computes the set pressure Pset of the control valve 230, the size of the cooling load is considered as in the case of the control valve 60 of the first embodiment. When the cooling load is large, e.g., when the temperature detected by the passenger compartment temperature sensor 56 is higher than the temperature set by the passenger compartment temperature setting unit 57, the control computer 55 increases the value of the current to be supplied to the coil 86, increasing the upward electromagnetic force and reducing the set pressure Pset of the control valve 230. When the cooling load is large and the suction pressure Ps gets high, therefore, the pressure sensitive mechanism including the bellows 240 works to restrict the opening size of the inlet-side control valve portion (including the case of the valve opening size being zero) and widens the opening size of the drain-side control valve portion. This lowers the crank pressure Pc, facilitating an increase in the angle of the swash plate.

When the cooling load is small, on the other hand, e.g., when the difference between the temperature detected by the passenger compartment temperature sensor 56 and the temperature set by the passenger compartment temperature setting unit 57 is small, the control computer 55 reduces the value of the current to be supplied to the coil 86, reducing the upward electromagnetic force and increasing the set pressure Pset of the control valve 230. When the cooling load is small and the suction pressure Ps is low, therefore, the opening size of the inlet-side control valve portion is kept large and the opening size of the drain-side control valve portion is restricted (including the case of the valve opening size being zero), despite the action of the pressure sensitive mechanism including the bellows 240. This raises the crank pressure Pc, facilitating a decrease in the angle of the swash plate. As apparent from the above, the external control using the control computer 55 always implements feedback control of the set pressure Pset of the control valve 230.

When the start switch 58 is switched off, the control computer 55 stops supplying current to the coil 86, regardless of the result of computation of the set pressure Pset. Then, the action of the release spring 74 pushes the whole function member (72, 64, 81) downward, so that the drain-side control valve portion is closed, while the inlet-side control valve portion is opened to the maximum size. As a result, gas discharge into the suction chamber 31 from the crank chamber 5 via the bleed passage 40 is blocked, while a large amount of refrigerant gas is supplied to the crank chamber 5 from the discharge chamber 32 via the gas supply passage 38. Consequently, the crank pressure Pc rises to set the angle of the swash plate to the minimum inclination angle (near 0°), so that the compressor goes to the minimum displacement operation, thus minimizing the load on the engine 14.

When the start switch 58 is switched on again later, control on current supply to the coil 86 restarts, and variable control on the set pressure Pset and the internal control by the pressure sensitive mechanism are performed, causing the compressor to return to a normal operating condition.

The thirteenth embodiment has the following advantages.

The control valve 230 of the interlocked inlet-side control and drain-side control type and the variable set-pressure type is located between the gas supply passage 38 and the bleed passage 40, and the control valve 230 is provided with the ability to selectively and forcibly open the gas supply passage and the ability to selectively seal the bleed passage. That is, the control valve 230 is designed to be able to force its drain-side control valve portion closed and force its inlet-side control valve portion open under external control. Based on the above-described control on current supply to the coil 86, therefore, it is possible to switch the operational state of the compressor between the normal operation state established by the typical interlocked inlet-side and drain-side internal control and the minimum displacement operation state established by the forced increase in crank pressure Pc. This crank pressure control apparatus is thus quite suitable for use in the variable displacement type swash plate compressor in FIG. 1, which can set the inclination angle of the swash plate to the vicinity of 0°.

The control valve 230 equipped with the solenoid portion 62 as the set-pressure changing unit has both the ability of changing the set pressure and the ability of enforcing valve opening/closing to thereby lead the compressor to the minimum displacement operation state, in cooperation of the control computer 55 and the drive circuit 59. The use of this control valve 230 can therefore simplify the crank pressure control apparatus of the compressor.

As the drain-side control valve portion of the control valve 230 located in the bleed passage 40 is closed when the start switch 58 is switched off, it is possible to inhibit the lubricating oil from flowing out of the crank chamber 5 together with the refrigerant gas in the minimum displacement operation, which would otherwise impair lubrication of the internal mechanisms of the compressor.

The control valve 230 is so designed to normally urge the drain-side valve body 236 in the closing direction by of the closing valve spring 237 and to make the movable end of the bellows 240 move away from the intervening member 238. When the outside temperature gets higher, the saturation pressure of the external refrigeration circuit 50 and, eventually, the output pressure of the evaporator 53 (equivalent to the suction pressure Ps) get higher, causing the bellows 240 to contract against the force of the extensible spring 241, and the coupling between the bellows 240 and the drain-side valve body 236 is disconnected. When the start switch 58 for the air-conditioning system is off and current supply to the solenoid portion 62 is stopped, therefore, the displacement control valve 230 can surely be maintained at the state where the drain-side control valve portion is closed and the inlet-side control valve portion is open, irrespective of the level of the outside temperature.

If the bellows 240 is so designed as to be always coupled to the drain-side valve body 236 and the function member (72, 64, 81), when the outside temperature gets high, the bellows 240 responsive to the temperature increase affects the drain-side valve body 236, making it difficult to keep the drain-side control valve portion closed. In such is the case, the minimum displacement operation of the compressor may not be accomplished. The displacement control valve 230 of this thirteenth embodiment does not suffer such an inconvenience.

Even with the drain-side control valve portion of the control valve 230 being closed, this drain-side control valve portion can work as a relief valve to prevent the crank pressure Pc from rising excessively high. Specifically, the drain-side control valve portion can be provided with the function of a relief valve by setting the force of the closing valve spring 237 in such a way that when the differential pressure (Pc−Ps) acting on the drain-side valve body 236 exceeds a predetermined maximum allowance, the force in the valve opening direction based on the differential pressure (Pc−Ps) becomes greater than the force of the closing valve spring 237 in the valve closing direction. In this case, even after the compressor is set to the minimum displacement operation state by closing the bleed passage 40, it is still possible to prevent the crank pressure Pc from rising so high that the compressor would be damaged.

Fourteenth Embodiment

According to the crank pressure control apparatuses of the second to twelfth embodiments (FIGS. 11 to 23), when the start switch 58 for the air-conditioning system is switched off, the bleed passage (or the bleed path) which connects the crank chamber 5 and the suction chamber 31 of the compressor together is completely blocked to encourage rising of the crank pressure Pc so that the compressor can quickly go to the minimum displacement operation state.

If the bleed passage is closed completely, the amount of lubricating oil remaining in the crank chamber 5 gradually decreases. This phenomenon will be discussed specifically below. When the compressor is at the minimum displacement operation state (the angle of the swash plate is near 0°) and the bleed passage is closed while the gas supply passage is open, the suction pressure Ps, the crank pressure Pc and the discharge pressure Pd have the relationship of Ps<Pc=Pd. That is, if the minimum displacement operation state continues, the crank pressure Pc always gets higher than the suction pressure Ps. This undesirably causes the lubricating oil in the crank chamber 5 to enter the cylinder bore 1*a* in the suction stroke from a slight clearance between the piston 29 and the cylinder bore 1*a*, and further travel from there into the discharge chamber 32 via the discharge port 35 and remains in the chamber 32. Complete blocking of the bleed passage therefore leads to an undesirable situation where the lubricating oil gradually escapes into the discharge chamber 32 from the crank chamber 5.

Figure 24:
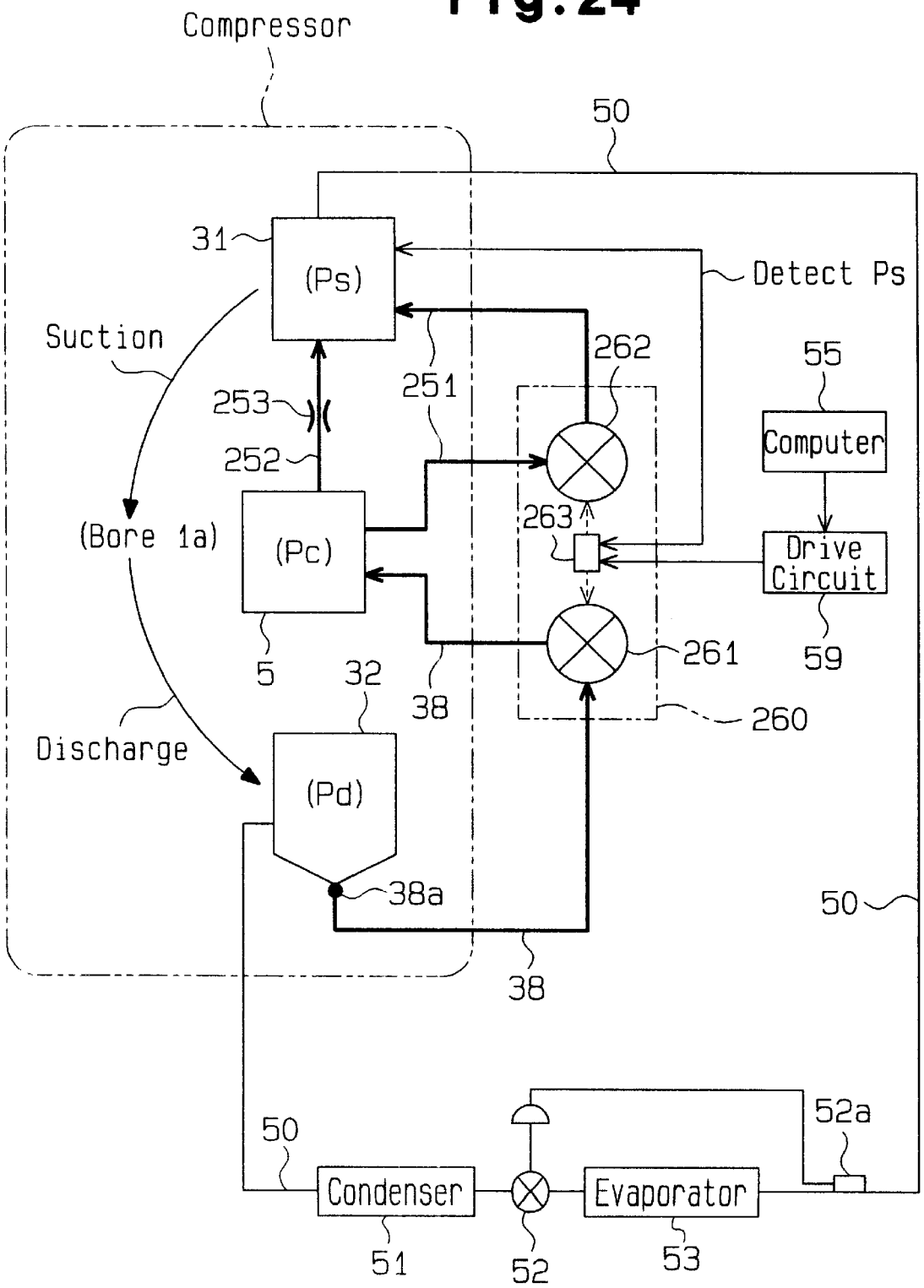
FIG. 24 is a diagram schematically illustrating a crank pressure control mechanism according to a fourteenth embodiment.

The fourteenth embodiment has been devised as a solution to the above problem. As shown in FIG. 24, the crank pressure control apparatus of this embodiment comprises the gas supply passage 38, which connects the crank chamber 5 and the discharge chamber 32 in the compressor (see FIG. 1, etc.), two parallel bleed passages 251 and 252, which connect the crank chamber 5 to the suction chamber 31, and a displacement control valve 260 of an interlocked inlet-side control and drain-side control type.

The interlocked control valve 260 comprises an inlet-side control valve portion 261, a drain-side control valve portion 262 and a pressure sensitive mechanism 263 which accomplishes internal control by interlocking both control valve portions 261 and 262 with each other in accordance with a change in suction pressure Ps. The inlet-side control valve portion 261 is located in the gas supply passage 38, and the drain-side control valve portion 262 in the first bleed passage 251. The control valve 260 undergoes external control by the control computer 55 using the drive circuit 59. When the start switch 58 for the air-conditioning system is switched off, the inlet-side control valve portion 261 is fully opened, and the drain-side control valve portion 262 is fully closed. Thus, the displacement control valve 260 also serves as opening/closing valve means which adjusts the size of the bleed passage under the control of external control means.

The control valve 190 in FIG. 19, the control valve 210 in FIG. 21 and the control valve 230 in FIG. 23, for example, may be used as the interlocked control valve 260 of the fourteenth embodiment.

As shown in FIG. 24, the inlet port, 38*a*, of the gas supply passage 38 is connected to the bottom (the lowermost position) of the discharge chamber 32 of the compressor. A fixed restrictor 253 is located in the second bleed passage 252 provided in parallel to the first bleed passage 251. The bleed passage 252 equipped with the fixed restrictor 253 can ensure the minimum communication from the crank chamber 5 to the suction chamber 31, irrespective of the opening size of the drain-side control valve portion 262.

The fourteenth embodiment has the following advantages.

Even with the compressor in the minimum displacement operation state as a result of the start switch 58 switched off (the drain-side control valve portion 262 being closed), the bleed passage 252 equipped with the fixed restrictor 253 can ensure the minimum communication from the crank chamber 5 to the suction chamber 31. It is thus possible to secure the internal circulation of refrigerant gas inside the compressor from the suction chamber 31, to the cylinder bore 1*a*, to the discharge chamber 32, to the gas supply passage 38 and the inlet-side control valve portion 261 (open), to the crank chamber 5, to the bleed passage 252 with the fixed restrictor 253, then back to the suction chamber 31. Therefore, the amount of oil carried out from the crank chamber 5 with the refrigerant gas is balanced with the amount of oil coming into the crank chamber 5, thereby always keeping the amount of the lubricating oil in the crank chamber 5 constant. This inhibits an undesirable situation where the amount of the lubricating oil present in the crank chamber 5 gradually decreases when the minimum displacement operation state continues. It is thus possible to prevent the internal mechanisms of the compressor from being burnt and thus to elongate the lifetime of the compressor.

Connecting the inlet port 38*a* of the gas supply passage 38 to the bottom (the lowermost position) of the discharge chamber 32 can allow the lubricating oil, which is likely to stay at the bottom of the discharge chamber 32, to efficiently return into the crank chamber 5 via the control valve 260.

Since the internal circulation of the refrigerant gas in the compressor is enabled as mentioned above even in the minimum displacement operation state, the heat generated in the crank chamber 5 can be absorbed by the refrigerant gas and is discharged in the suction chamber 31 or the like. This can suppress a temperature rise in the crank chamber 5.

The displacement control valve 260 of an interlocked inlet-side control and drain-side control type is located between the gas supply passage 38 and the bleed passage 251, and the control valve 260 is provided with the ability to selectively and forcibly open the gas supply passage 38 and the ability to selectively seal the bleed passage 251. That is, the control valve 260 is designed to be able to force its drain-side control valve portion 262 closed and force its inlet-side control valve portion 261 open under external control. Based on the external control by the control computer 55, therefore, it is possible to switch the operational state of the compressor between the normal operation state established by the typical interlocked inlet-side and drain-side internal control and the minimum displacement operation state established by the forced increase in crank pressure Pc. This crank pressure control apparatus is therefore quite suitable for use in the variable displacement type swash plate compressor in FIG. 1, which can set the inclination angle of the swash plate to the vicinity of 0°.

Although the second bleed passage 252 with the fixed restrictor 253 is provided in the control valve 260 in FIG. 24, those components may be omitted if the control valve 260 is designed so that in the minimum displacement operation state brought by the OFF action of the start switch 58, the opening size of the drain-side control valve portion 262 of the interlocked control valve 260 becomes equivalent to the cross-sectional area of the fixed restrictor 253. Even in such a case, the same effects can result.

The embodiments of this invention may be modified as follows.

Although FIG. 1 shows a clutchless swash plate compressor, this invention may be adapted for an air-conditioning system which selectively transmits power to the compressor from an external drive source by means of an electromagnetic clutch mechanism located between the compressor and the external drive source. This modification is advantageous in that the number of connecting/disconnecting operations of the electromagnetic clutch mechanism can be reduced.

The return spring 27, or return aiding means, is not limited to the coil spring as shown in FIGS. 1 and 2, but may be replaced with a leaf spring, or other springs, or any urging member that acts like a spring.

The range in which the return spring 27 applies force to the swash plate 22 may cover the entire inclination range ($\theta$min to $\theta$max) of the swash plate 22.

Although the stop valve (93, 96 and 97) is provided in the housing of the compressor, the stop valve may be provided outside of the housing at an upstream part of the external refrigeration circuit 50.

In FIG. 12, the bleed-side opening/closing valve 123 located in the bleed passage 40 may be omitted. In this case, while only the fixed restrictor 124 is located in the bleed passage 40, substantially the same advantages as the embodiment in FIG. 12 are obtained. Since the bleed passage 40 is not closed completely, advantages similar to those of the sixth embodiment in FIG. 24 will also result.

A receiver (fluid receiver) may be provided between the condenser 51 and the expansion valve 52 as a depressurizing unit. The receiver stores excess refrigerant to compensate for variations in the required amount of refrigerant in the air-conditioning system and to perform gas-liquid separation at the outlet side of the condenser 51 so that only liquid refrigerant is fed to the expansion valve 52.

Although the external refrigeration circuit 50 employs the expansion valve 52 as a depressurizing unit, an external refrigeration circuit that has a condenser, a fixed orifice as a depressurizing unit, an evaporator and an accumulator tank may be used instead. The accumulator tank serves to store excess refrigerant in place of the aforementioned receiver and to manage the superheat at the outlet of the evaporator in place of the expansion valve 52.

The phrase "swash plate compressor" in this specification refers not only to a compressor equipped with a swash plate but also includes a wobble type compressor and includes every type of compressor that reciprocates pistons by means of an inclined cam plate.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor comprising:

a housing, which defines a cylinder bore, a crank chamber, a suction chamber and a discharge chamber;

a piston accommodated in the cylinder bore;

a drive shaft rotatably supported in the crank chamber by the housing;

a drive plate coupled to the piston for converting rotation of the drive shaft to reciprocation of the piston, wherein the drive plate is supported on the drive shaft to incline with respect to a plane perpendicular to the axis of the drive shaft and to rotate integrally with the drive shaft, wherein the drive plate moves in a range between a maximum inclination angle position and a minimum inclination angle position in accordance with a moment applied to the drive plate, wherein the moment includes a moment based on the pressure in the crank chamber and a moment based on the pressure in the cylinder bore as components, wherein the minimum inclination angle is smaller than a limit angle, the limit angle being determined by the lower limit of a range of inclination within which the drive plate can be moved to increase its angle by a reaction force of pressure applied to the piston, and wherein the drive plate varies the stroke of the piston in accordance with its inclination angle to change displacement of the compressor;

a pressure control mechanism for controlling pressure in the crank chamber to change the inclination of the drive plate; and an urging member for urging the drive plate to increase its inclination angle when the inclination of the drive plate is less than the limit angle.

2. The compressor according to claim 1, wherein the inclination angle of the drive plate is zero degrees when located on a plane perpendicular to the axis of the drive shaft, wherein a minimum inclination angle of a drive plate is set to zero degrees, or to an angle that produces a load that is substantially the same as that when the inclination angle of the drive plate is zero degrees.

3. The compressor according to claim 1, wherein the drive plate is constructed and arranged such that a moment is applied to the drive plate to increase its inclination angle when rotating while positioned at an angle of inclination that is smaller than the limit angle.

4. The compressor according to claim 1, wherein the urging member continuously urges the drive plate at least until the drive plate is inclined at a predetermined angle, which corresponds to two to twenty percent of the maximum displacement of the compressor.

5. The compressor according to claim 4, wherein the predetermined angle is equal to or greater than the limit angle.

6. The compressor according to claim 1, wherein the urging member is a first urging member, and the compressor further includes a second urging member that urges the drive plate to reduce its inclination angle, wherein the first and second urging members cooperate to position the drive plate at a predetermined angle corresponding to two to twenty percent of the maximum displacement of the compressor when the compressor is stopped and when the pressure in the cylinder bore is equal to that in the crank chamber.

7. The compressor according to claim 6, wherein the predetermined angle is equal to or greater than the limit angle.

8. The compressor according to claim 1, wherein an outer drive source is directly connected to the drive shaft to rotate the drive shaft.

9. The compressor according to claim 1, wherein the pressure control mechanism includes:

a supply passage for connecting the discharge chamber to the crank chamber; and a displacement control valve located in the supply passage to control supply of gas to the crank chamber from the discharge chamber through the supply passage, wherein the displacement control valve substantially fully opens the supply passage to position the drive plate at a minimum inclination angle position, based on an external instruction.

10. The compressor according to claim 9, wherein the pressure control mechanism further includes a bleed passage for connecting the crank chamber to the suction chamber, wherein the bleed passage includes a restriction for restricting the amount of gas that flows in the bleed passage.

11. The compressor according to claim 1, wherein the pressure control mechanism includes:

a supply passage for connecting the discharge chamber to the crank chamber;

a bleed passage for connecting the crank chamber to the suction chamber;

a displacement control valve provided in at least one of the supply passage and the bleed passage, wherein the displacement control valve adjusts opening in accordance with an operating pressure, which is the pressure in a selected chamber in the compressor; and an open-close valve device for selectively opening and closing the bleed passage, wherein the valve device substantially closes the bleed passage to position the drive plate at a minimum inclination angle position, based on an external instruction.

12. The compressor according to claim 1, wherein the pressure control mechanism includes:

a supply passage for connecting the discharge chamber to the crank chamber;

a bleed passage for connecting the crank chamber to the suction chamber; and a displacement control valve including a first valve, a second valve and a solenoid, wherein the first valve is located in the supply passage and the second valve is located in the bleed passage, wherein the first and second valves cooperate to maintain the pressure in a selected chamber in the compressor at a predetermined target value, wherein the solenoid is excited to change the target value based on current supplied from outside the compressor, and wherein the solenoid permits the first valve to open the supply passage and permits the second valve to close the bleed passage to position the drive plate at a minimum inclination position, based on an external instruction.

13. The compressor according to claim 12, wherein the second valve serves as a relief valve for relieving abnormally high pressure in the crank chamber when the bleed passage is closed.

14. The compressor according to claim 12, wherein the bleed passage is a first bleed passage, and wherein the pressure control mechanism includes a second bleed passage, which is parallel to the first bleed passage, wherein the second bleed passage includes a restriction for restricting the amount of gas flow in the second bleed passage.

15. The compressor according to claim 1, wherein an external refrigerant circuit is connected to the compressor, and a stop valve is provided between the discharge chamber and the external refrigerant circuit to prevent gas from flowing from the external refrigerant circuit to the discharge chamber, wherein the stop valve is closed to stop discharging gas from the discharge chamber to the external refrigerant circuit when the difference between the pressure in the discharge chamber and the pressure in the external refrigerant circuit is below a predetermined value.

16. A variable displacement compressor comprising:

a housing, which defines a cylinder bore, a crank chamber, a suction chamber and a discharge chamber, a piston accommodated in the cylinder bore;

a drive shaft rotatably supported in the crank chamber by the housing;

a drive plate connected to the piston for converting rotation of the drive shaft to reciprocation of the piston, wherein the drive plate is supported on the drive shaft to incline with respect to a plane perpendicular to the axis of the drive shaft and to rotate integrally with the drive shaft, wherein the drive plate moves in a range between a maximum inclination angle position and a minimum inclination angle position in accordance with a moment applied to the drive plate, wherein the moment includes a moment based on the pressure in the crank chamber and a moment based on the pressure in the cylinder bore as components, wherein the minimum inclination angle is smaller than a limit angle, the limit angle being determined by the lower limit of a range of inclination within which the drive plate can be moved to increase its angle by a reaction force of pressure applied to the piston, and wherein the drive plate varies the stroke of the piston in accordance with its inclination angle to change displacement of the compressor;

a pressure control mechanism for controlling pressure in the crank chamber to change the inclination of the drive plate, wherein the pressure control mechanism increases the pressure in the crank chamber to position the drive plate at a minimum inclination angle position, based on an external instruction; and a spring for urging the drive plate to increase its inclination angle when the inclination of the drive plate is less than the limit angle, wherein the spring continuously urges the drive plate at least until the drive plate is inclined at a predetermined angle, which corresponds to two to twenty percent of the maximum displacement of the compressor.

17. The compressor according to claim 16, wherein the predetermined angle is equal to or greater than the limit angle.

18. A displacement control valve for controlling the displacement of a variable displacement compressor by adjusting inclination angle of a drive plate located in a crank chamber, wherein the compressor includes a supply passage for connecting a discharge chamber to the crank chamber and a bleed passage for connecting the crank chamber to a suction chamber, the displacement control valve comprising:

a first valve located in the supply passage, wherein the first valve includes a first valve body for adjusting an opening size of the supply passage and a first spring for urging the first valve body to open;

a second valve located in the bleed passage, wherein the second valve includes a second valve body for adjusting an opening size of the bleed passage, a pressure sensitive member for urging the second valve body to close with a force related to the pressure in the suction chamber, and a second spring for urging the second valve body to close;

a transmitting member for transmitting the motion of the second valve body to the first valve body, wherein the transmitting member causes the first valve body to open when the second valve body is moved to close; and a solenoid, which is excited based on current supplied from outside the compressor, wherein the solenoid urges the first valve body to close and urges the second valve body to open with a force related to the supplied current, and wherein, when the solenoid is demagnetized, the first valve body opens the supply passage with the force of the first spring and the second valve body closes the bleed passage with the force of the second spring.

19. The displacement control valve according to claim 18, wherein the pressure sensitive member and the second valve body operate in connection with one another and are separable from one another.

20. The displacement control valve according to claim 19, wherein the pressure sensitive member includes bellows, wherein the bellows extend when the pressure in the suction chamber decreases, and the bellows contract when the pressure in the suction chamber increases, wherein the extension of the bellows urges the second valve body to close, and when the bellows contract with the solenoid demagnetized, the bellows separate from the second valve body.

* * * * *

UNITED STATES PATENT AND TRADEMARK OFFICE

CERTIFICATE OF CORRECTION

PATENT NO. : 6,244,159 B1 
APPLICATION NO. : 09/289523
DATED : June 12, 2001
INVENTOR(S) : Kazuya Kimura et al.

It is certified that error appears in the above-identified patent and that said Letters Patent is hereby corrected as shown below:

In The Specification

Column 1, line 65, please delete "+30°" and "+50°" and insert therefor -- +3° and +5° --

Column 6, line 66, please delete "θof" and insert therefor -- θx of --.

Signed and Sealed this

Nineteenth Day of February, 2008

JON W. DUDAS
*Director of the United States Patent and Trademark Office*